US010603600B2

(12) United States Patent
Farrell et al.

(10) Patent No.: US 10,603,600 B2
(45) Date of Patent: Mar. 31, 2020

(54) AUTONOMOUS, GRAVITY-ASSISTED MOTORIZED RACER CONFIGURED TO TRAVEL THROUGH NON-STRAIGHT TUBE SEGMENTS

(71) Applicant: MIEH, Inc., Highland Park, IL (US)

(72) Inventors: Diane M. Farrell, Northfield, IL (US); Jason M. Lynch, Lemont, IL (US); James M. Rasmussen, Chicago, IL (US); Maxwell B. Rothschild, Northbrook, IL (US); Wayne H. Rothschild, Northbrook, IL (US)

(73) Assignee: MIEH, Inc., Highland Park, IL (US)

( * ) Notice: Subject to any disclaimer, the term of this patent is extended or adjusted under 35 U.S.C. 154(b) by 0 days.

(21) Appl. No.: 16/134,636

(22) Filed: Sep. 18, 2018

(65) Prior Publication Data

US 2019/0076746 A1 Mar. 14, 2019

Related U.S. Application Data

(63) Continuation of application No. 15/788,758, filed on Oct. 19, 2017, which is a continuation-in-part of (Continued)

(51) Int. Cl.
*A63H 18/02* (2006.01)
*A63H 17/00* (2006.01)
(Continued)

(52) U.S. Cl.
CPC ..... *A63H 18/028* (2013.01); *A63H 17/004* (2013.01); *A63H 17/14* (2013.01);
(Continued)

(58) Field of Classification Search
CPC ..... A63H 17/00; A63H 17/14; A63H 17/004; A63H 17/262; A63H 17/34; A63H 18/028; A63H 18/02; F16L 55/26
See application file for complete search history.

(56) References Cited

U.S. PATENT DOCUMENTS 1,661,674 A 3/1928 Osborn
2,537,284 A 1/1951 Schuder
(Continued)

FOREIGN PATENT DOCUMENTS

DE 1813995 A 12/1969
DE 1813995 A1 12/1969
(Continued)

OTHER PUBLICATIONS

International Search Report issued in corresponding International Patent Application No. PCT/US2017/028565, dated Sep. 7, 2017 (6 pages).
(Continued)

*Primary Examiner* — Eugene L Kim
*Assistant Examiner* — Alyssa M Hylinski
(74) *Attorney, Agent, or Firm* — Nixon Peabody LLP

(57) ABSTRACT

A vehicle configured to move through a network of interconnected tubes includes a body, a motor, a motorized wheel, a biasing assembly, and a first element. The motorized wheel directly engages an inner surface of the tubes. The biasing assembly causes the motorized wheel to maintain continuous contact with the inner surface of the tubes during operation. A waist of the vehicle is constrained by an inner diameter (D) of the curved tube, a radius of curvature (R) of the curved tube, and a length (L) of the wheelbase of the vehicle. The waist of the body is sized such that the vehicle can freely move within any of the tubes without getting stuck therein.

29 Claims, 38 Drawing Sheets

Related U.S. Application Data application No. PCT/US2017/028565, filed on Apr. 20, 2017.

(60) Provisional application No. 62/325,293, filed on Apr. 20, 2016.

(51) Int. Cl.

| | |
|---|---|
| ***A63H 17/14*** | (2006.01) |
| ***A63H 17/26*** | (2006.01) |
| ***A63H 18/08*** | (2006.01) |
| ***A63H 18/04*** | (2006.01) |
| ***A63H 33/10*** | (2006.01) |
| ***A63H 17/28*** | (2006.01) |
| ***A63H 17/34*** | (2006.01) |
| ***A63H 30/04*** | (2006.01) |
| *A63H 18/16* | (2006.01) |

(52) U.S. Cl.

CPC ..... *A63H 17/262* (2013.01); *A63H 17/28* (2013.01); *A63H 17/34* (2013.01); *A63H 18/02* (2013.01); *A63H 18/04* (2013.01); *A63H 18/08* (2013.01); *A63H 30/04* (2013.01); *A63H 33/105* (2013.01); *A63H 33/106* (2013.01); *A63H 2018/165* (2013.01)

(56) References Cited

U.S. PATENT DOCUMENTS

| | | | | |
|---|---|---|---|---|
| 3,066,959 | A | 12/1962 | White | |
| 3,069,805 | A | 12/1962 | Burrows | |
| 3,343,793 | A | 9/1967 | Waser | |
| 3,633,309 | A * | 1/1972 | Yoshie | A63H 18/02 446/445 |
| 3,752,472 | A | 8/1973 | Snead | |
| 4,231,294 | A | 11/1980 | Arzoumanian | |
| 4,770,105 | A * | 9/1988 | Takagi | F16L 55/30 104/138.2 |
| 4,838,170 | A | 6/1989 | Illakowicz | |
| 5,142,989 | A | 9/1992 | Suzumori et al. | |
| 5,392,715 | A * | 2/1995 | Pelrine | F16L 55/28 104/138.2 |
| 5,507,679 | A | 4/1996 | Getsay | |
| 5,878,783 | A * | 3/1999 | Smart | F16L 55/28 104/138.2 |
| 5,971,404 | A | 10/1999 | Stoves | |
| 6,123,027 | A * | 9/2000 | Suyama | F16L 55/28 104/138.2 |
| 7,017,953 | B2 | 3/2006 | Benscoter | |
| 7,025,656 | B2 * | 4/2006 | Bailey | A63H 17/14 104/138.1 |
| 8,571,711 | B2 * | 10/2013 | Jacobsen | B08B 9/045 180/9.21 |
| 9,027,740 | B2 | 5/2015 | Boehrer | |
| 9,528,651 | B2 * | 12/2016 | Hsu | F16L 55/40 |
| 9,731,212 | B2 * | 8/2017 | Cheung | A63H 18/02 |
| 2005/0266768 | A1 | 12/2005 | Bailey | |
| 2009/0130946 | A1 | 5/2009 | Fink | |
| 2010/0304640 | A1 | 12/2010 | Sofman | |
| 2011/0006978 | A1 | 1/2011 | Yuan | |
| 2011/0052335 | A1 | 3/2011 | Haberl | |
| 2013/0040767 | A1 * | 2/2013 | Gill | A63B 43/06 473/465 |
| 2013/0171910 | A1 | 7/2013 | Mimlitch, III et al. | |
| 2015/0122903 | A1 * | 5/2015 | Boyce | A63H 18/028 238/10 A |
| 2015/0285424 | A1 * | 10/2015 | Hsu | F16L 55/32 180/15 |
| 2016/0220915 | A1 * | 8/2016 | Cheung | A63H 18/02 |

FOREIGN PATENT DOCUMENTS

| | | | |
|---|---|---|---|
| GB | 2096474 | A | 10/1982 |
| GB | 2301162 | A | 11/1996 |
| HK | 1209265 | A | 3/2016 |
| HK | 1209265 | A2 | 3/2016 |
| JP | 5507679 | B2 | 5/2014 |
| KR | 201000024 | U | 1/2010 |
| TW | M497044 | U | 3/2015 |
| WO | 99/16523 | A1 | 4/1999 |
| WO | 2015009305 | A1 | 1/2015 |
| WO | WO 2016/026039 | | 2/2016 |

OTHER PUBLICATIONS

Written Opinion of the International Searching Authority issued in corresponding International Patent Application No. PCT/US2017/028565, dated Sep. 7, 2017 (7 pages).

Third-Party Observation in International Patent Application No. PCT/US2017/028565, dated Jul. 20, 2018 (50 pages).

International Search Report and Written Opinion of International Searching Authority in International Application No. PCT/US2018/056573, dated Jan. 2, 2019 (16 pages).

Extended European Search Report for Application No. EP 17786621.7, dated Oct. 8, 2019 (10 pages).

* cited by examiner

AUTONOMOUS, GRAVITY-ASSISTED MOTORIZED RACER CONFIGURED TO TRAVEL THROUGH NON-STRAIGHT TUBE SEGMENTS

CROSS-REFERENCE TO RELATED APPLICATIONS

This application is a continuation of U.S. patent application Ser. No. 15/788,758, filed Oct. 19, 2017, which is a continuation-in-part of International Application No. PCT/US17/028565, filed Apr. 20, 2017, which claims priority to and the benefit of U.S. Provisional Application No. 62/325,293, filed Apr. 20, 2016, each of which is hereby incorporated by reference herein in its entirety.

FIELD OF THE INVENTION

Aspects of the present disclosure relate to autonomous, gravity-assisted motorized toy racers and tube assemblies through which the toy racers run.

BACKGROUND OF THE INVENTION

Kids love to race cars. Conventionally, cars are raced on tracks, which can be assembled together to form a variety of configurations. The tracks are open, which means that the cars frequently come off the tracks, and there is a practical limit or constraint on how convoluted the track can be formed due to the reliance upon gravity and that the car can succumb to gravity and come off the track, particularly when ascending vertically, undergoing a twisting or rotational motion, or looping around a loop section of the track.

SUMMARY OF THE INVENTION

A tube assembly is disclosed that includes curved tubes or tube segments that are connected together, and they can be connected and rotated in virtually an unlimited number of configurations. Variations on the tube segments, as well as support post or structures to support the assembled tube configuration, are also disclosed. The tubes or tube segments can snap together (e.g., via one or more tube-couplers) to prevent horizontal sliding.

An autonomous, gravity-assisted motorized toy racer vehicle is also disclosed having a form factor and geometry that allows the vehicle to be able to navigate autonomously inside the tubes without getting stuck, while maintaining drive contact with the inside of the tubes surface (even if sideways or upside down relative to earth). By "autonomous" it is meant that the racer vehicle does not require any manual human energy to impart forward momentum to the vehicle. The autonomous vehicle disclosed herein can be operated by remote control, or it can be automatically controlled.

The tube segments are assembled together to form a tube assembly to form a desired racing path for the racer vehicle. Thus, there are at least two play components: construction and play. The tube assembly provides the construction component, and racing the motorized racer vehicle through the tubes provides the play component. The racer vehicle includes a battery and a motor powered by the battery. The motor is connected to a wheel that propels the racer vehicle through the tubes, but the racer vehicle also gains speed from gravity when heading in a direction back toward earth. The motorized component allows the racer vehicle to go in a direction opposite earth or transverse to earth.

The tubes can be closed loops or open ended. If the tubes are of the closed loop type, then an entry point can be used so that the vehicle can be inserted or retrieved without disassembling any part of the tube assembly.

The racer vehicle can include lights, such as one or more light emitting diodes, which can be powered (for free as it were, meaning without drawing any power from the battery) by the drivetrain, or by the battery.

Lights and sound will make this product even more innovative, fun, and wild.

Because the tubes can be transparent or semi-transparent (non-opaque) and clear or in color, the illuminated racer vehicle is visible through the tube segments. Because sound travels well and bounces around in and through the pipes, the sound of the vehicle as it races through the tubes and around turns will provide an aural experience in addition to the visual experience due to the transparent tubes. The visual experience is enhanced when the racer vehicle is raced through the tube assembly in a darkened room.

The system disclosed herein is infinitely expandable with additional pipe (tubes), special feature sets, additional autonomous or remote-controlled racer vehicles, remote control valves in the pipes, to name a few examples.

An accelerometer connected to the lights and sounds controller can further enhance visual and aural and other sensory special effects. The system as a whole contributes to a fun, engaging, educational, and exciting (re)-construction and play experience.

The ability to race in the tube and also on the floor constrains the design of the body because the body must not interfere with tangency of adjacent wheels, which is required to run on the floor. The vehicle can be designed to only run in the tube, or to run on the tube and on the floor.

According to some aspects of the present disclosure, a vehicle is configured to move through a network of interconnected tubes. The network of interconnected tubes includes a curved tube having a radius of curvature (R) and an inner diameter (D). The vehicle includes a body, a motor, a motorized wheel, a biasing assembly (e.g., a resilient element, a spring-loaded element, a compressible element/wheel like a hollow tire, etc.), and a first element. The body has a longitudinal axis and a waist that is generally perpendicular to the longitudinal axis and defines a circumferentially extending width of the body at a central portion of the body. The motor is positioned within the body and coupled to a battery that powers the motor. The motorized wheel is mechanically coupled to the motor. The motorized wheel at least partially extends out from the body adjacent to a first end of the body such that the motorized wheel is configured to directly engage an inner surface of the series of tubes. The biasing assembly is positioned to cause the motorized wheel to maintain continuous contact with the inner surface of the series of tubes during operation of the motor. The first element at least partially extends out from the body adjacent to a second opposing end of the body such that the first element is configured to directly engage the inner surface of the series of tubes. A length (L) of a wheelbase of the vehicle is the distance between a center of the motorized wheel and a center of the first element. The waist is constrained by (i) the inner diameter (D) of the curved tube, (ii) the radius of curvature (R) of the curved tube, and (iii) the length (L) of the wheelbase. The waist of the body is sized such that the vehicle can freely move within any of the series of tubes without getting stuck therein.

According to some aspects of the present disclosure, a vehicle is configured to propel through a network of interconnected tubes including at least one curved tube having a radius of curvature (R) and an inner diameter (D). The vehicle includes a body, a motor, a motorized wheel, a biasing member, and a first contacting element. The body has a longitudinal axis and a circumferential waist that is orthogonal to the longitudinal axis and that circumscribes the outermost structures of the vehicle at a central portion thereof. The motor is positioned within the body and coupled to a battery that powers the motor. The motorized wheel is positioned along the body and mechanically coupled to the motor. The motorized wheel at least partially extends out from the body adjacent to a first end of the body such that the motorized wheel is configured to directly engage an inner surface of the network of interconnected tubes. The biasing member is configured to cause the motorized wheel to maintain contact with the inner surface of the network of interconnected tubes during operation of the motor. The first contacting element at least partially extends out from the body adjacent to a second opposing end of the body such that the first contacting element is configured to directly contact the inner surface of the network of interconnected tubes as the vehicle is propelled therethrough by the motor. A length (L) of a wheelbase of the vehicle corresponds to a distance between a center of the motorized wheel and a center of the first contacting element. Dimensions of the length (L) of the wheelbase and of the circumferential waist (d) have the following constraints: a maximum circumference of the waist (d) is constrained by a first ratio between (i) the inner diameter (D) of the at least one curved tube and (ii) a smallest radius of curvature (R) among the at least one curved tube, wherein the ratio is between 0.130 and 0.365. A maximum length (L) of the wheelbase is constrained by the first ratio and the maximum circumference of the waist (d), such that no matter how the vehicle rotates about the longitudinal axis as the vehicle is propelled around any of the at least one curved tube, the maximum circumference of the waist (d) is always observed to prevent any part of the body from contacting any part of the inner surface of the at least one curved tube.

According to some implementations of the present disclosure The waist (d) of the body of the vehicle is constrained by the following formula:

$$d = D - 2\left(R - \sqrt{R^2 - \left(\frac{L}{2}\right)^2}\right).$$

According to some implementations of the present disclosure The waist (d) of the body of the vehicle is constrained by the following formula:

$$d = D - 2*\left(R - \left(R*\cos\frac{\theta}{2}\right)\right),$$

where θ is an angle between a first radius of curvature (R) through the center of the motorized wheel and a second radius of curvature (R) through the center of the first element.

DETAILED DESCRIPTION

Figure 1:
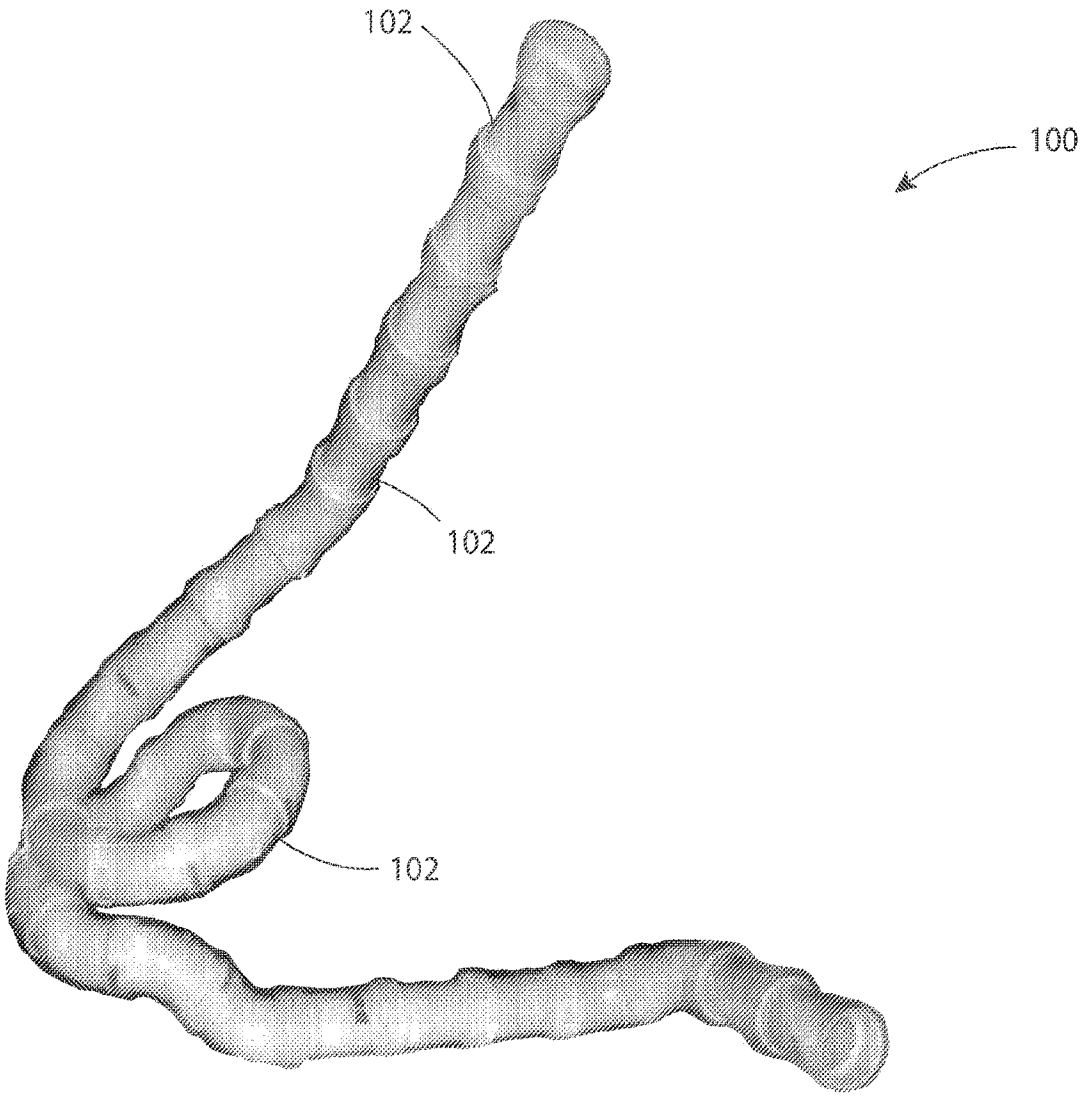
FIG. 1 illustrates two example configurations of tubes connected together into a tube assembly, one called a "table runner," and the other "flying twist"

FIG. 1 illustrates an example configuration of tubes 102 connected together into a tube assembly 100, referred to as a "flying twist" configuration. Other configurations can be a table runner configuration, a long neck snail configuration, and a long loop smoke stack, so named for their resemblance to their description.

Figure 2:
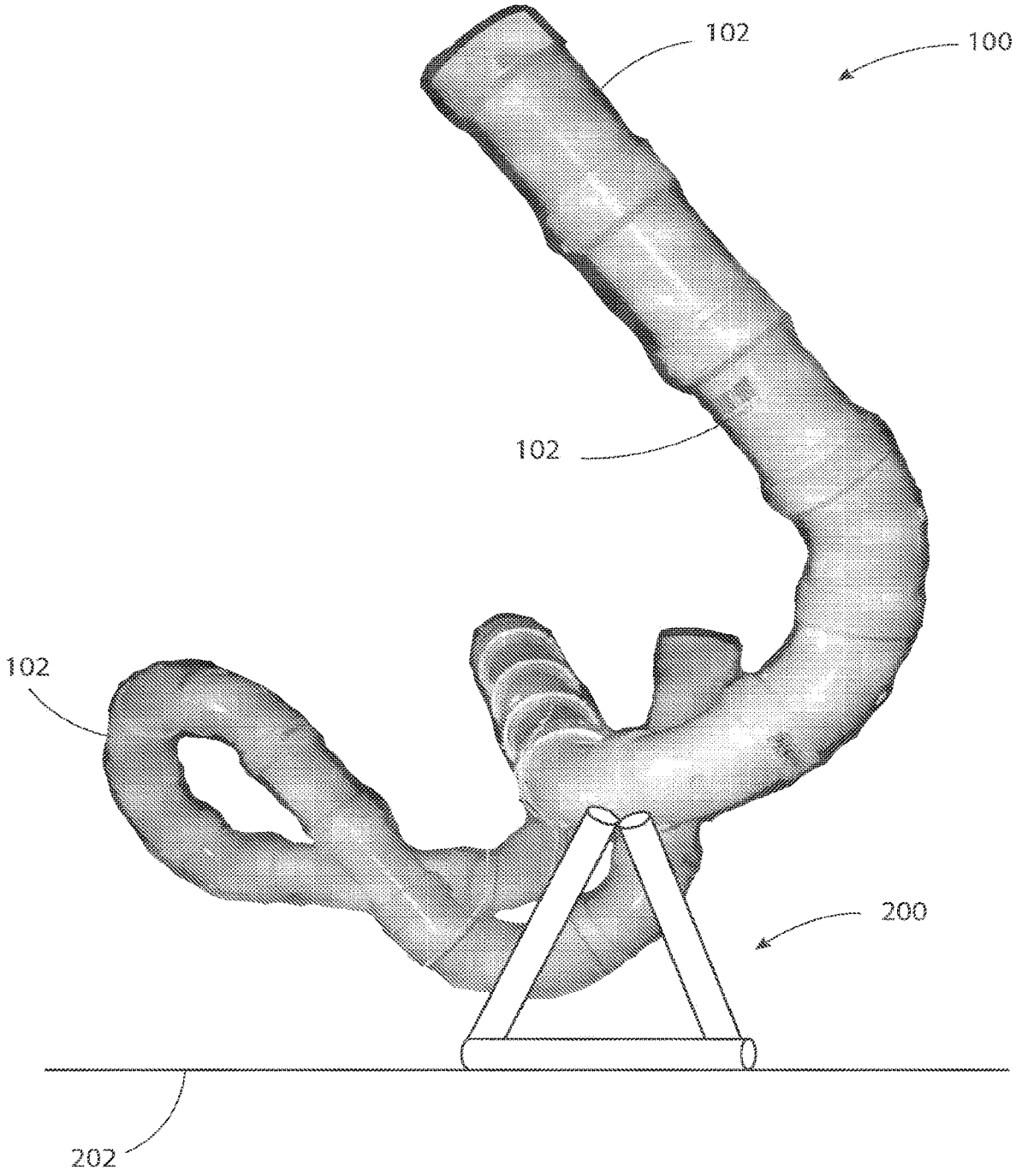
FIG. 2 illustrates an example support system for tube assembly configurations having portions thereof that require support on a horizontal surface to prevent buckling or collapsing of the tube assembly.

FIG. 2 illustrates an example support system 200 for tube assembly configurations 100 having portions thereof that require support on a horizontal surface 202 to prevent buckling or collapsing of the tube assembly 100.

Figure 3:
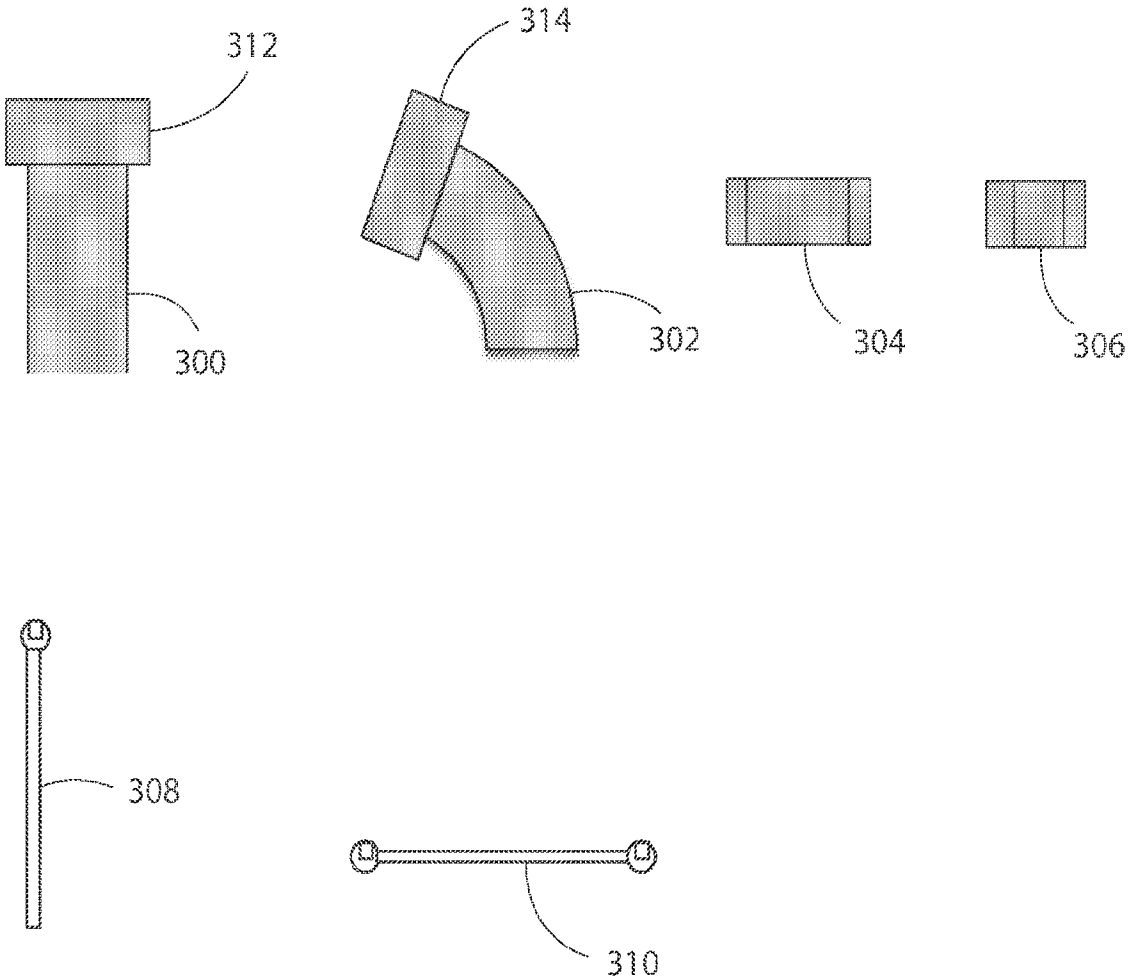
FIG. 3 illustrate a variety of example tube sections and support posts or base supports, as well as different collar examples that are used as interconnects between adjacent tube sections.

FIG. 3 illustrates a variety of example tube sections 300, 302, 304, 306 and support posts or base supports 308, 310, as well as different collar examples 312, 314 that are used as interconnects between adjacent tube sections 102.

Figure 4:
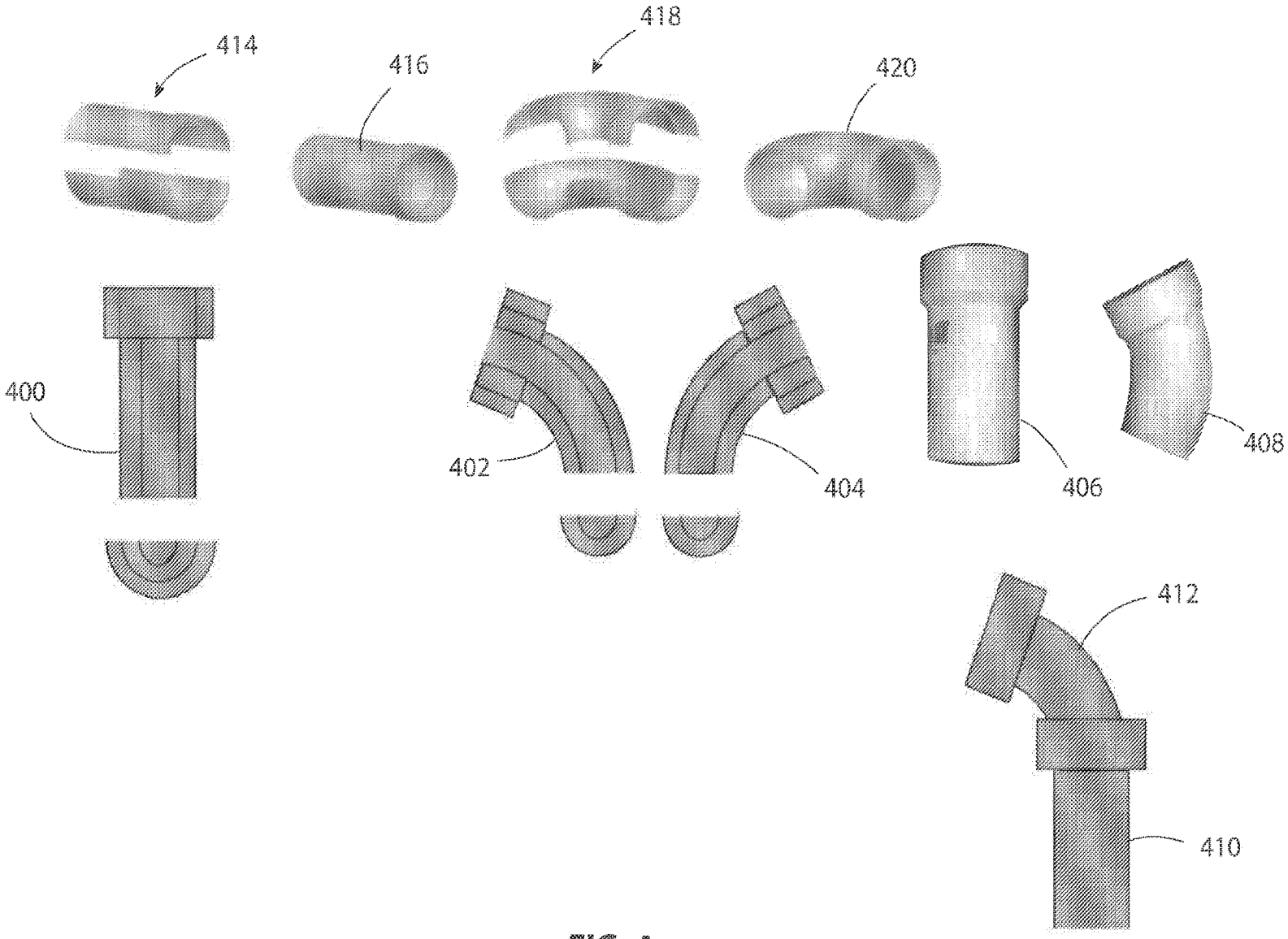
FIG. 4 illustrates further example tube sections, including straight and curved sections, as well as sections that are joined together as two halves.
Figure 5:
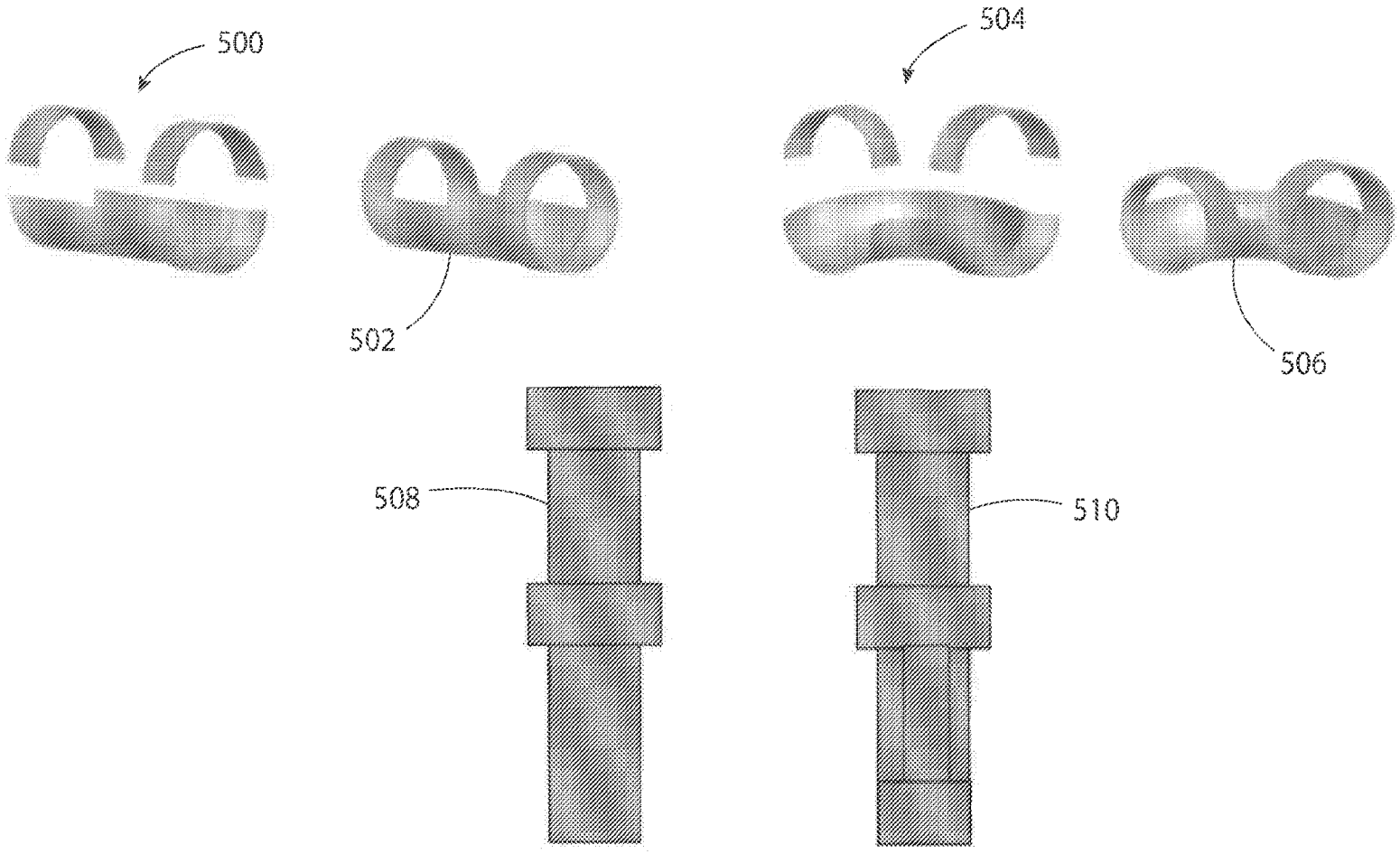
FIG. 5 illustrates several examples of tube collars that form "half pipes" in either straight or curved sections, along with collar examples to join adjacent tube sections together.

FIG. 4 illustrates further example tube sections 102, including straight 400, 406, 410 and curved sections 402, 404, 408, 412, as well as sections that are joined together as two halves 414, 416, 418, 420;

FIG. 5 illustrates several examples of tube collars 500, 502, 504, 506 that form "half pipes" in either straight or curved sections, along with collar examples 508, 510 to join adjacent tube sections 102 together.

Figure 6:
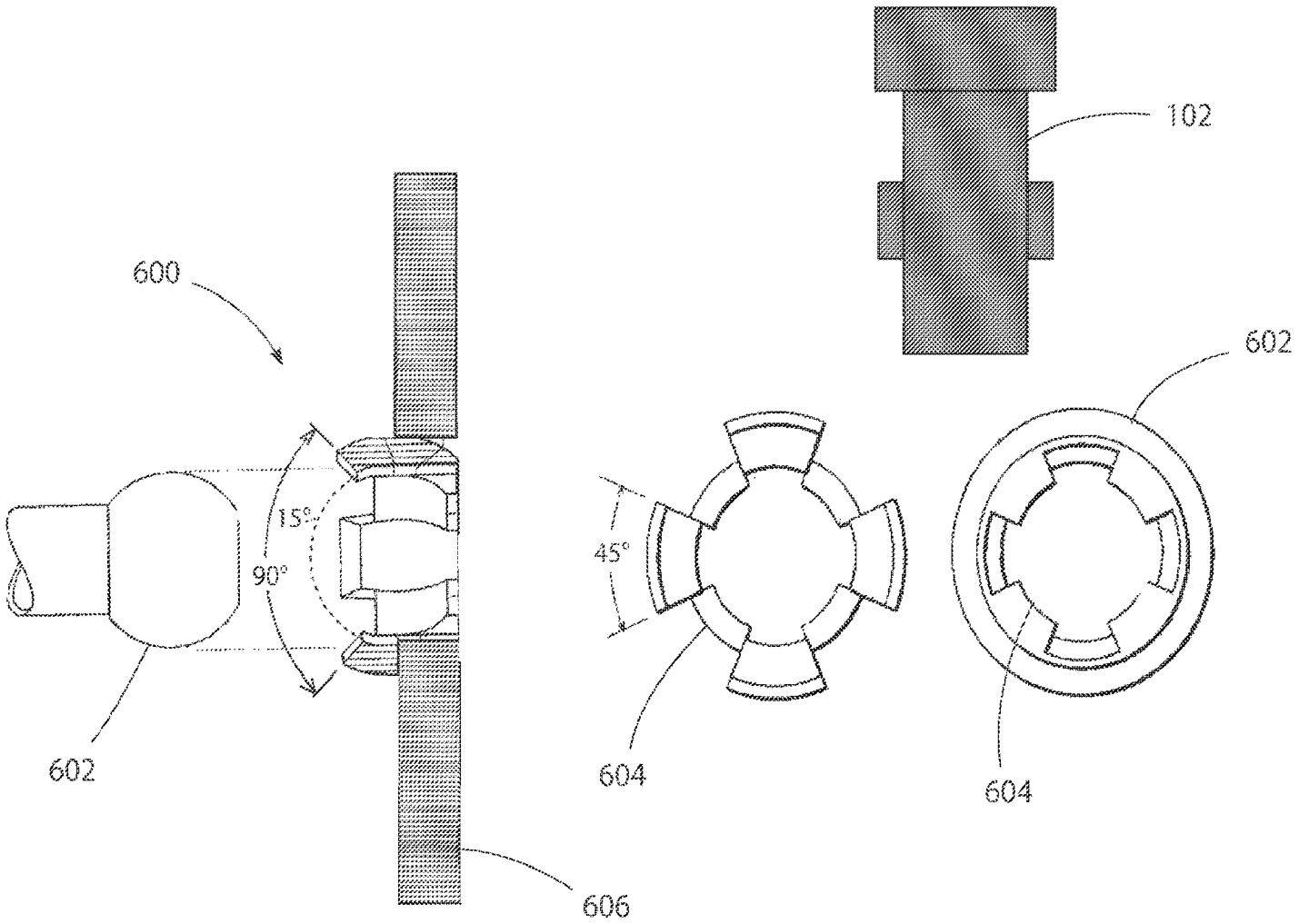
FIG. 6 illustrates an example socket system that can be used to couple supports or posts to the tube sections themselves.

FIG. 6 illustrates an example socket system 600 that can be used to couple supports or posts 602 to the tube sections 102 themselves. The sockets 604 can be molded open and shut in the mold without needing side actions. The cross section of the tube 606 shows the wall thickness of the tube section.

Figure 7:
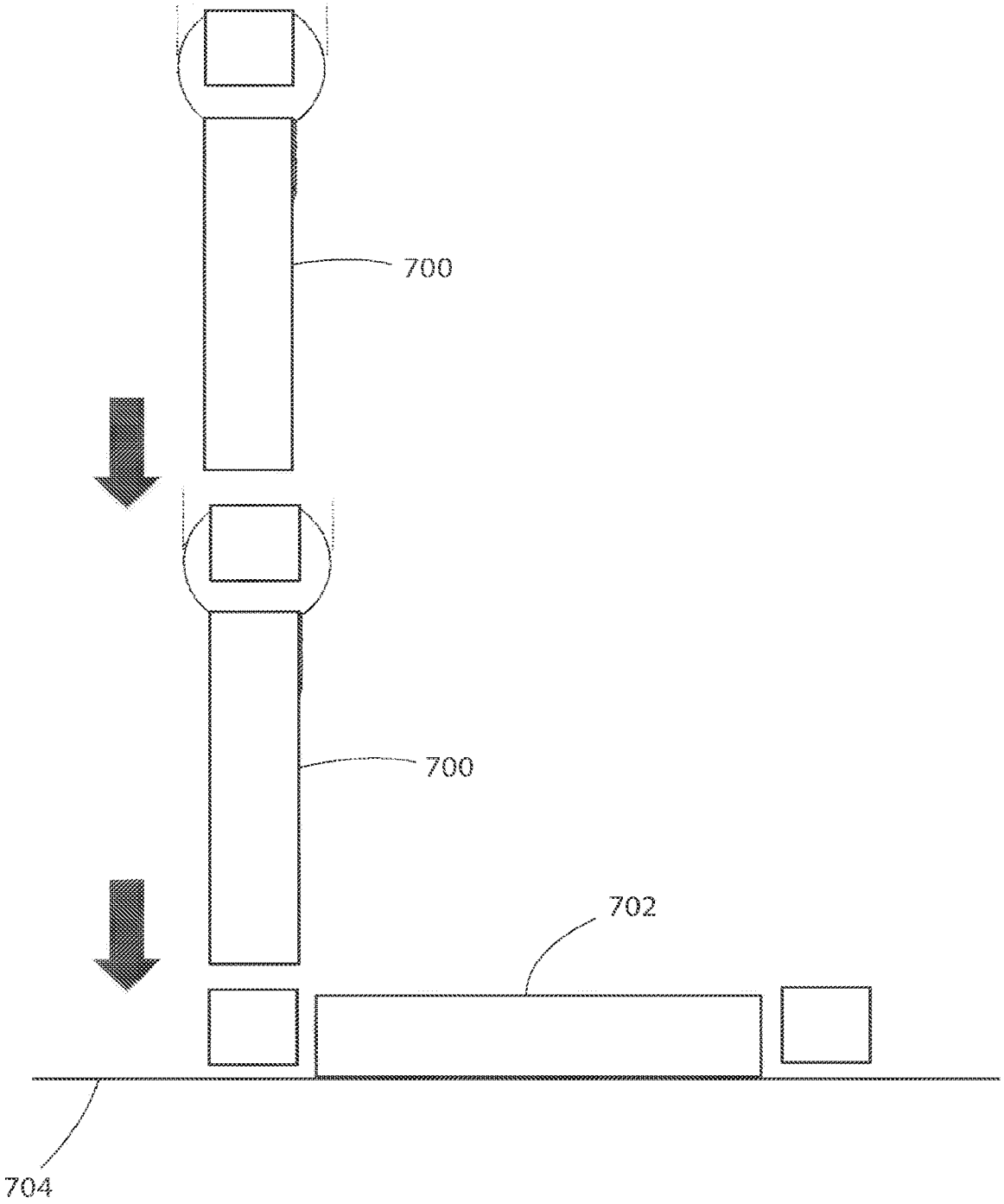
FIG. 7 illustrates an example of how support posts can be coupled to a support base section that rests on a horizontal surface.

FIG. 7 illustrates an example of how support posts 700 can be coupled to a support base section 702 that rests on a horizontal surface 704.

Figure 8:
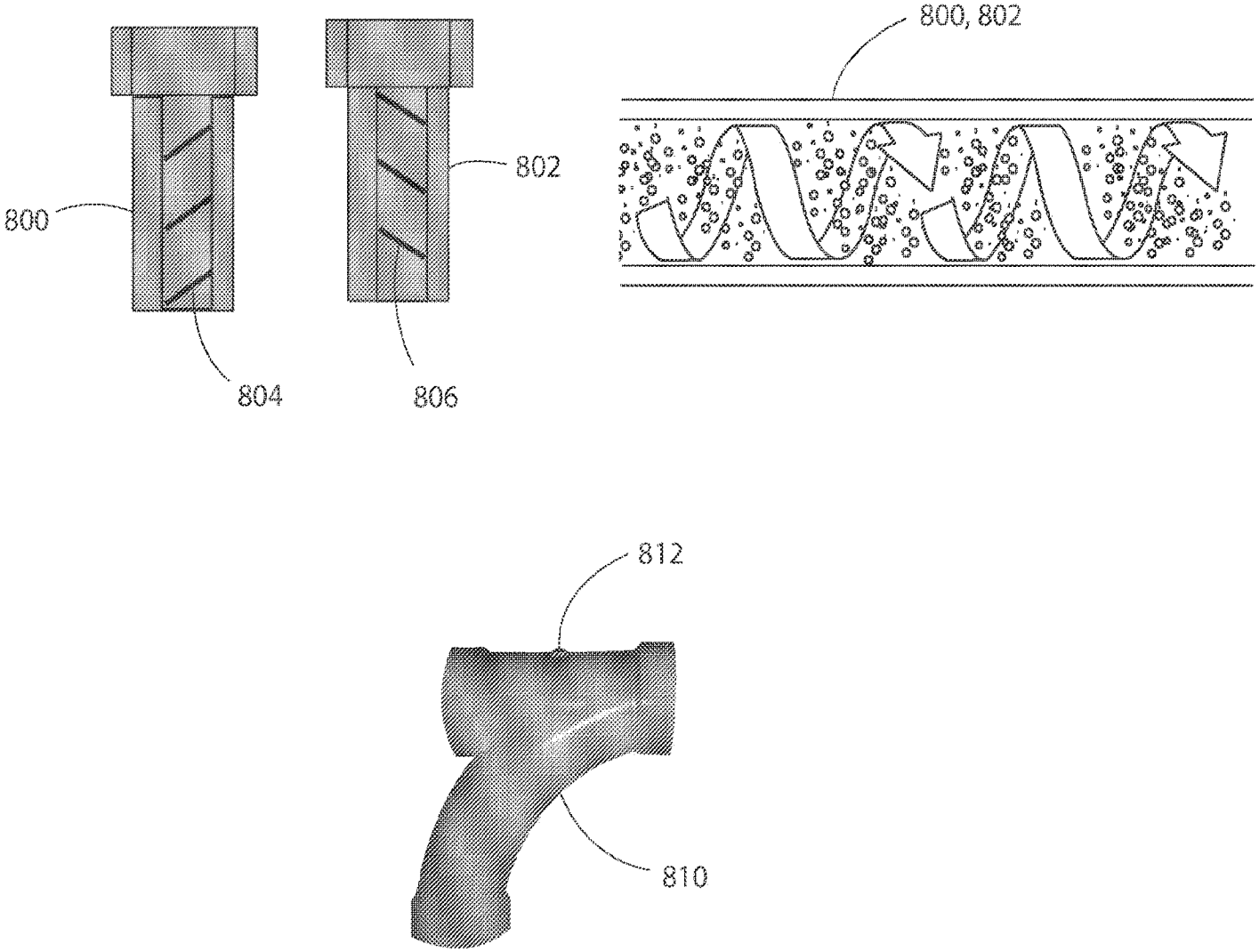
FIG. 8 illustrates a "hurricane pipe" having an inner scored section to cause the racer vehicle to twist and spin through this section as it follows the inner score, and a splitter pipe with an optional remote control valve to direct the racer vehicle through one of multiple path options through the splitter pipe.

FIG. 8 illustrates a "hurricane pipe" 800, 802 having an inner scored section 804, 806 to cause the racer vehicle to twist and spin through this section as it follows the inner score 804, 806, and a splitter pipe 810 with an optional remote control valve 812 to direct the racer vehicle through one of multiple path options through the splitter pipe 810.

Figure 9:
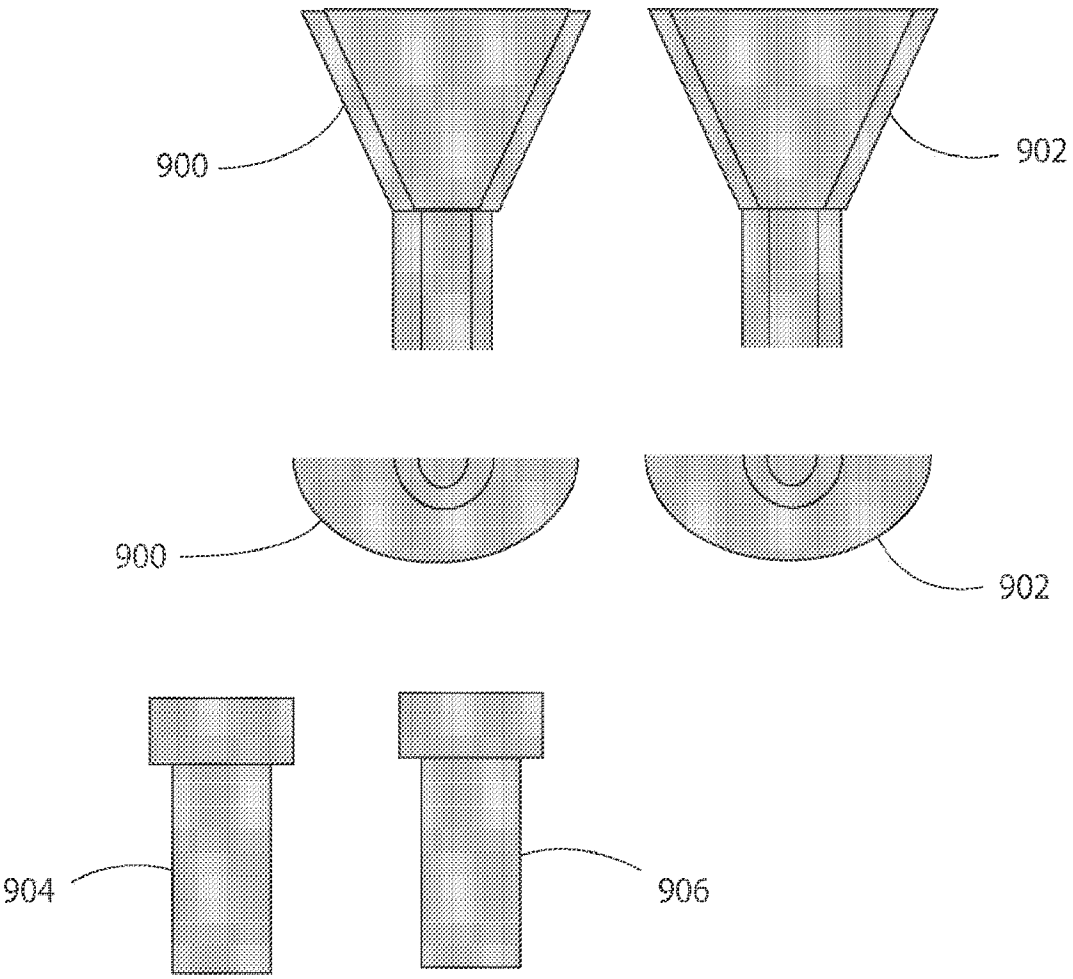
FIG. 9 illustrates several funnels that can be connected to tube sections to allow the racer vehicle to jump out of one end of a tube section and follow an arc dictated by gravity until it is caught by a catch funnel a distance away from the jump funnel to continue the racer's journey through the pipe assembly, and timer tubes that have sensors to allow time and speed of the racer through the tube assembly to be determined.

FIG. 9 illustrates several funnels 900, 902 that can be connected to straight tube sections 904, 906 to allow the racer vehicle to jump out of one end of a tube section 102 and follow an arc dictated by gravity until it is caught by a catch funnel a distance away from the jump funnel (see FIG. 15) to continue the racer's journey through the pipe assembly, and timer tubes that have sensors (e.g., at the "starting gate" and finish line) to allow time and speed of the racer through the tube assembly to be determined. While not shown, the time can be transmitted to a stopwatch display that displays time and speed, since the distance through the tubes is a known quantity.

Figure 10:
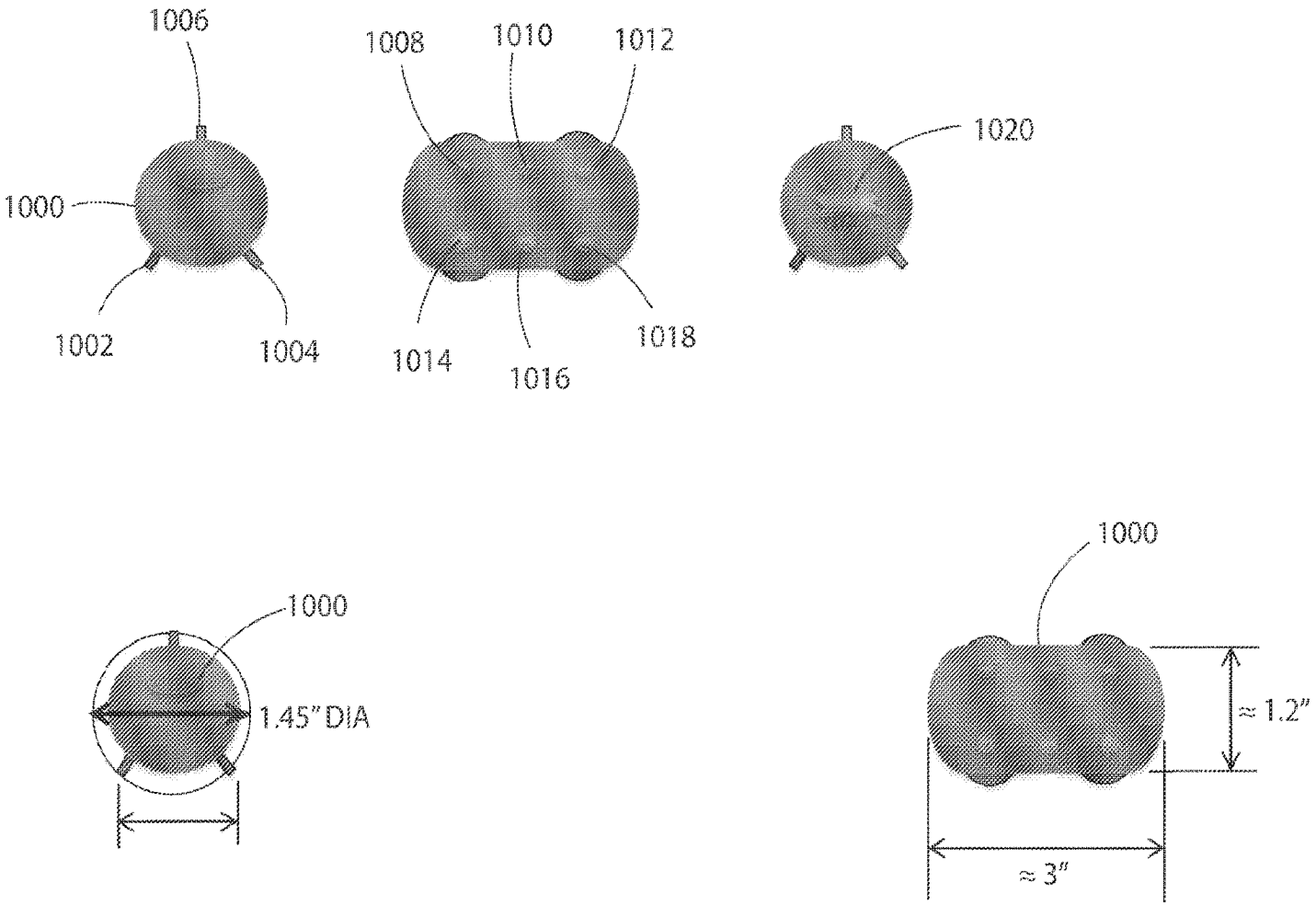
FIG. 10 illustrates an example form factor of a racer vehicle in the form of a space ship having multiple wheels and optional multi-colored LEDs.

FIG. 10 illustrates an example form factor of a racer vehicle 1000 in the form of a space ship having multiple sets of wheels 1002, 1004, 1006 (6 wheels total) and optional multi-colored LEDs 1008, 1010, 1012, 1014, 1016, 1018, 1020. The example dimensions are shown in inches. The vehicle 1000 has an outer diameter (measured to the point of contact of the wheels) of 1.45 inches, a height of 1.2 inches, and a length of about 3 inches. Each of the six wheels 1002, 1004, 1006 can be a non-slip driving surface, and can be driven by one battery-powered motor for constant speed. Alternately, fewer than six of the wheels, such as four wheels, can be powered, such as 2 wheels in the front and 2 wheels in the rear, powered by the same motor. The multi-colored LEDs 1008, 1010, 1012, 1014, 1016, 1018, 1020 can comprise 3 or 4 differently colored LEDs on the side and/or the rear of the vehicle 1000. Or, holes can be formed in the housing and the LEDs 1008, 1010, 1012, 1014, 1016, 1018, 1020 can be mounted internally so that fewer LEDs can be used thereby drawing less power. The view of the vehicle in the upper left corner is a front view, the view to the right of that one is a side view, and the view in the upper right corner is a rear view.

Figure 11:
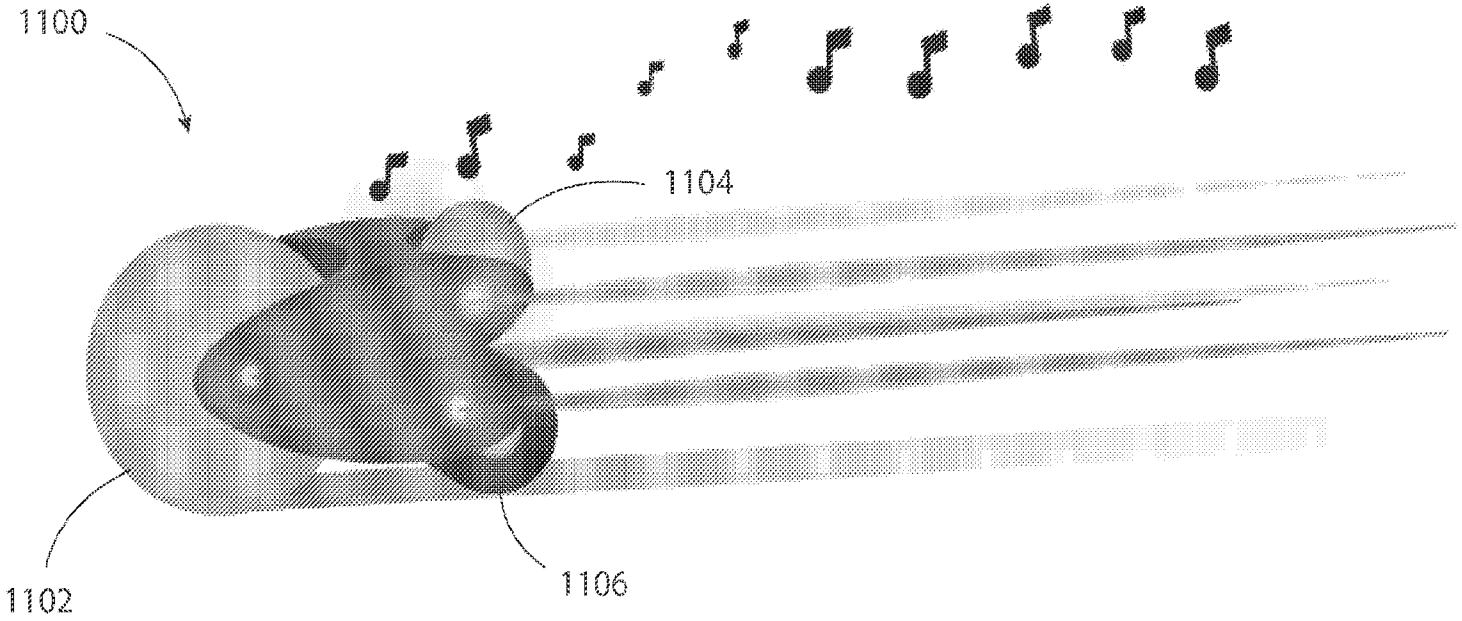
FIG. 11 illustrates another example of a racer vehicle having three wheels, at least one of which is motorized, and multiple LEDs, with the vehicle's wheels making a racing sound as it whizzes through the pipes.

FIG. 11 illustrates another example of a racer vehicle 1100 having three wheels 1102, 1104, 1104, at least one of which is motorized, and multiple LEDs. The vehicle 1000 can include a speaker to make sound, or the vehicle can make its own racing sound as it whizzes through the tubes.

Figure 12:
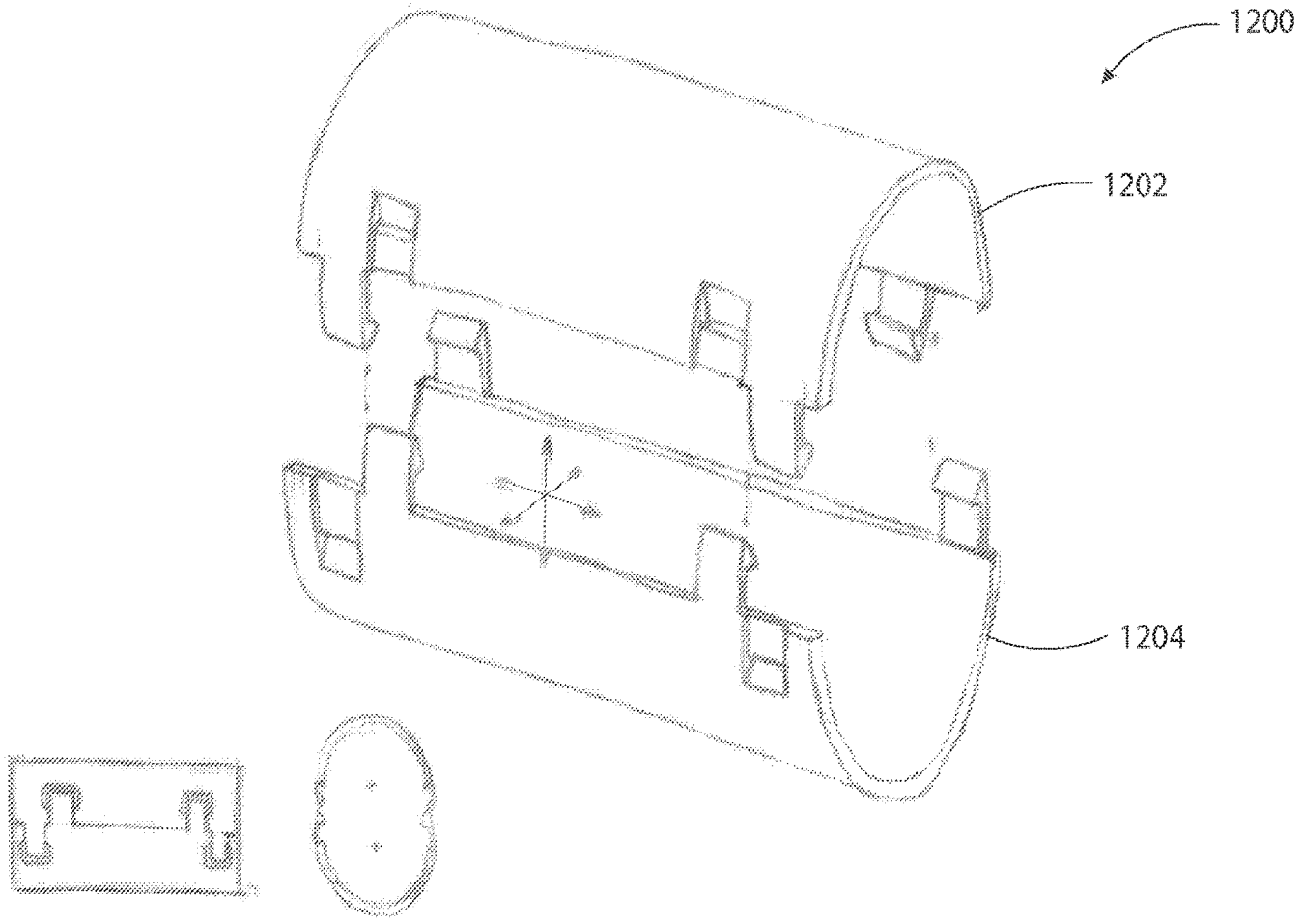
FIG. 12 illustrates a straight tube section formed by two halves that removably snap together as shown.

FIG. 12 illustrates a straight tube section 1200 formed by two halves 1202, 1204 that removably snap together as shown.

Figure 13:
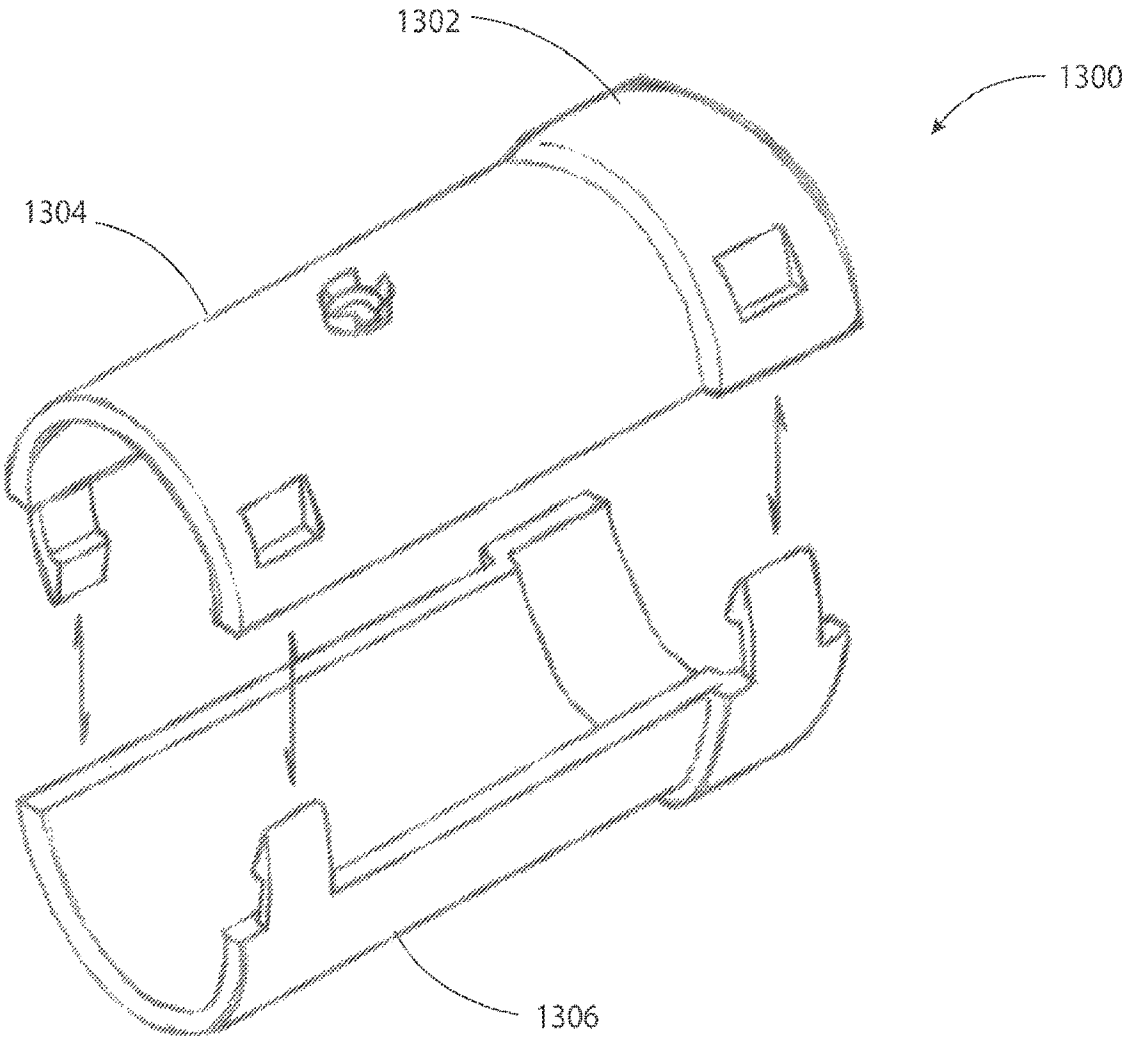
FIG. 13 illustrates a straight tube section having a collar at one end and formed by two halves that removably snap together as shown.

FIG. 13 illustrates a straight tube section 1300 having a collar 1302 at one end and formed by two halves 1304, 1306 that removably snap together as shown.

Figure 14:
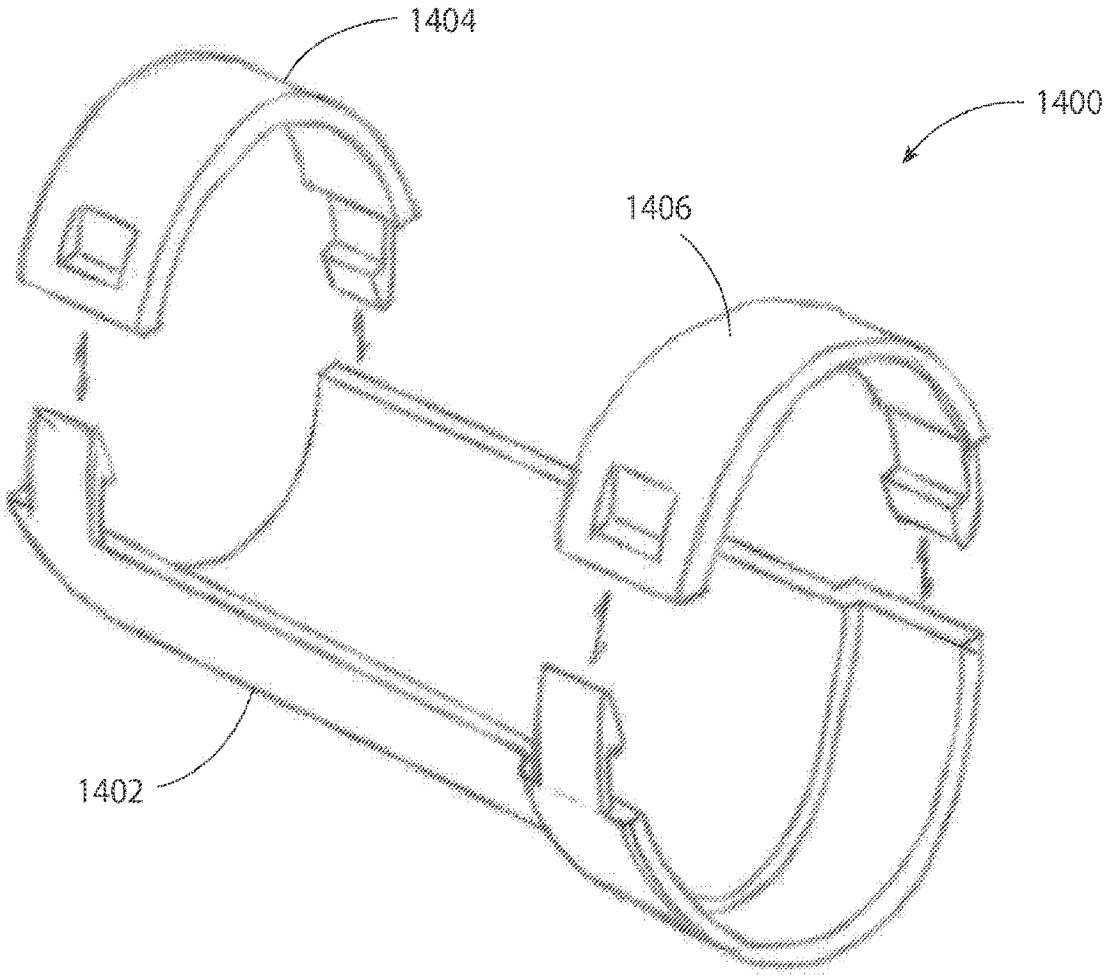
FIG. 14 illustrates a straight half pipe section formed by bottom and top pieces that removably snap together as shown.

FIG. 14 illustrates a straight half pipe section 1400 formed by a bottom piece 1402 and top pieces 1404, 1406 that removably snap together as shown.

It should be noted that the support posts (vertical) and base supports (horizontal) can removably snap together to form an unlimited variety of "scaffolding" support structures to support any configuration of a tube assembly. The various curved tube sections can be coupled together by respective collars to produce an endless variety of angles and curves that are configurable in accordance with the teachings of the present disclosure.

Figure 15:
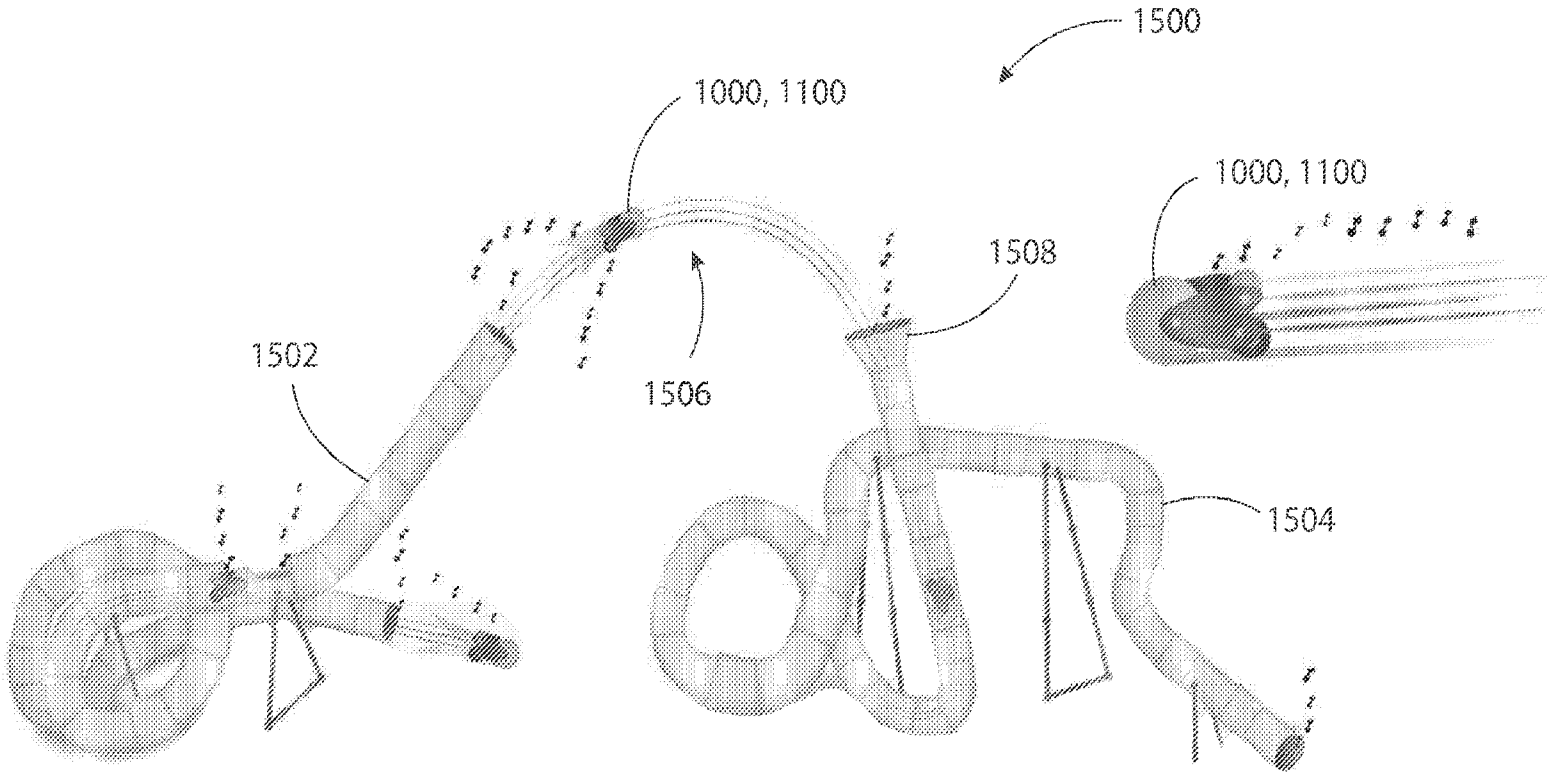
FIG. 15 illustrates an example rendering of a tube assembly with a racer vehicle zipping through the pipes and jumping across an open space between two pipe sections, making racing sounds and illuminating the interior of the tube along the way with various colors.

FIG. 15 illustrates an example illustration of a two tube assembly 1500 with a racer vehicle 1000, 1100 zipping through the pipes 1502, 1504, making racing sounds and illuminating the interior of the tube along the way with various colors. The two pipe assemblies 1502, 1504 form a gap 1506 across which the racer vehicle 1000, 1100 exits the tube assembly 1502 and falls into a funnel tube section 1508 of the tube assembly 1504.

Figure 16:
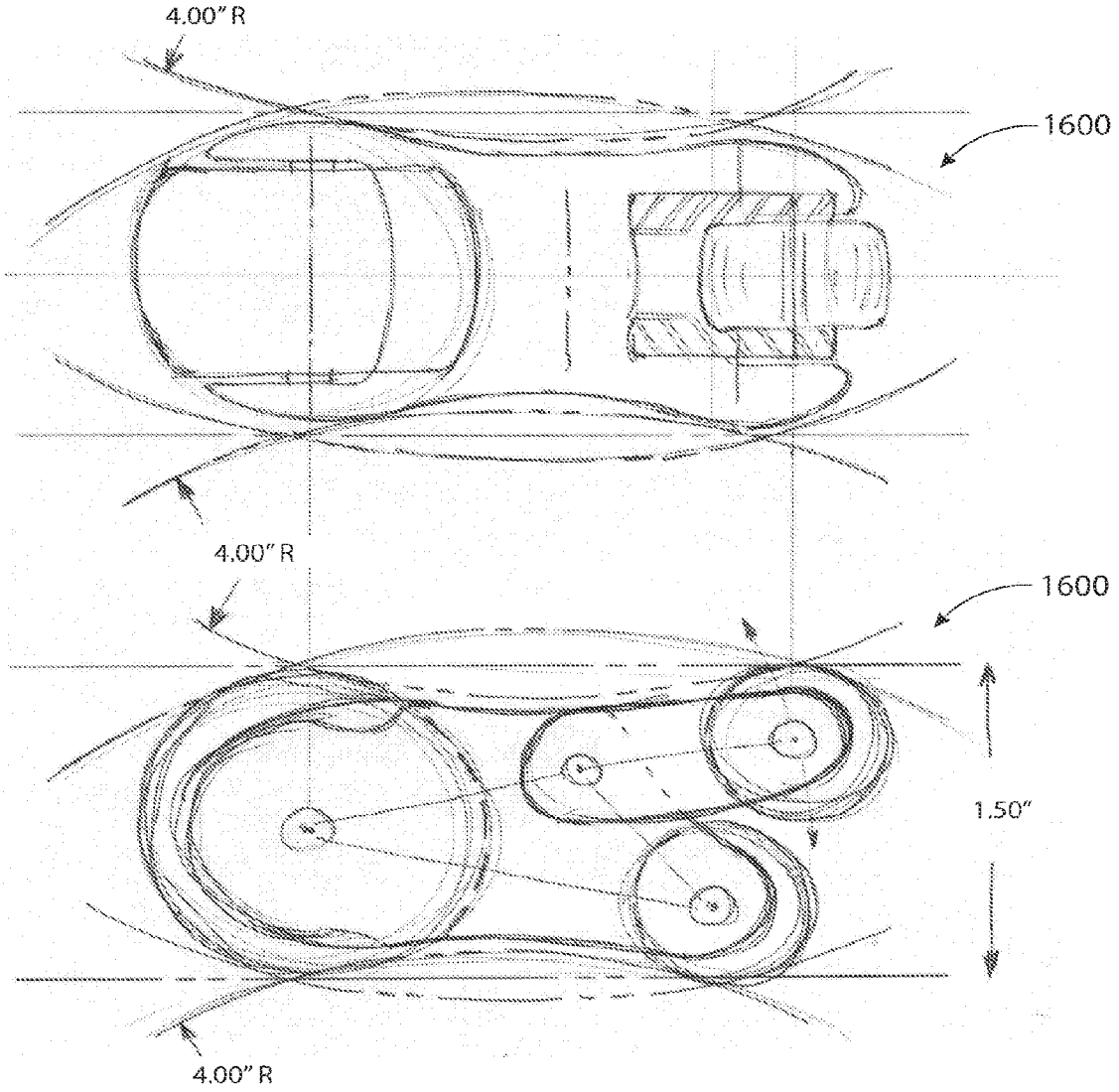
FIG. 16 illustrates top and side views of an example vehicle and exemplary dimensions in inches.

FIG. 16 illustrates top and side schematic views, respectively, of an example vehicle 1600 and exemplary dimensions of various radii in inches.

Figure 17:
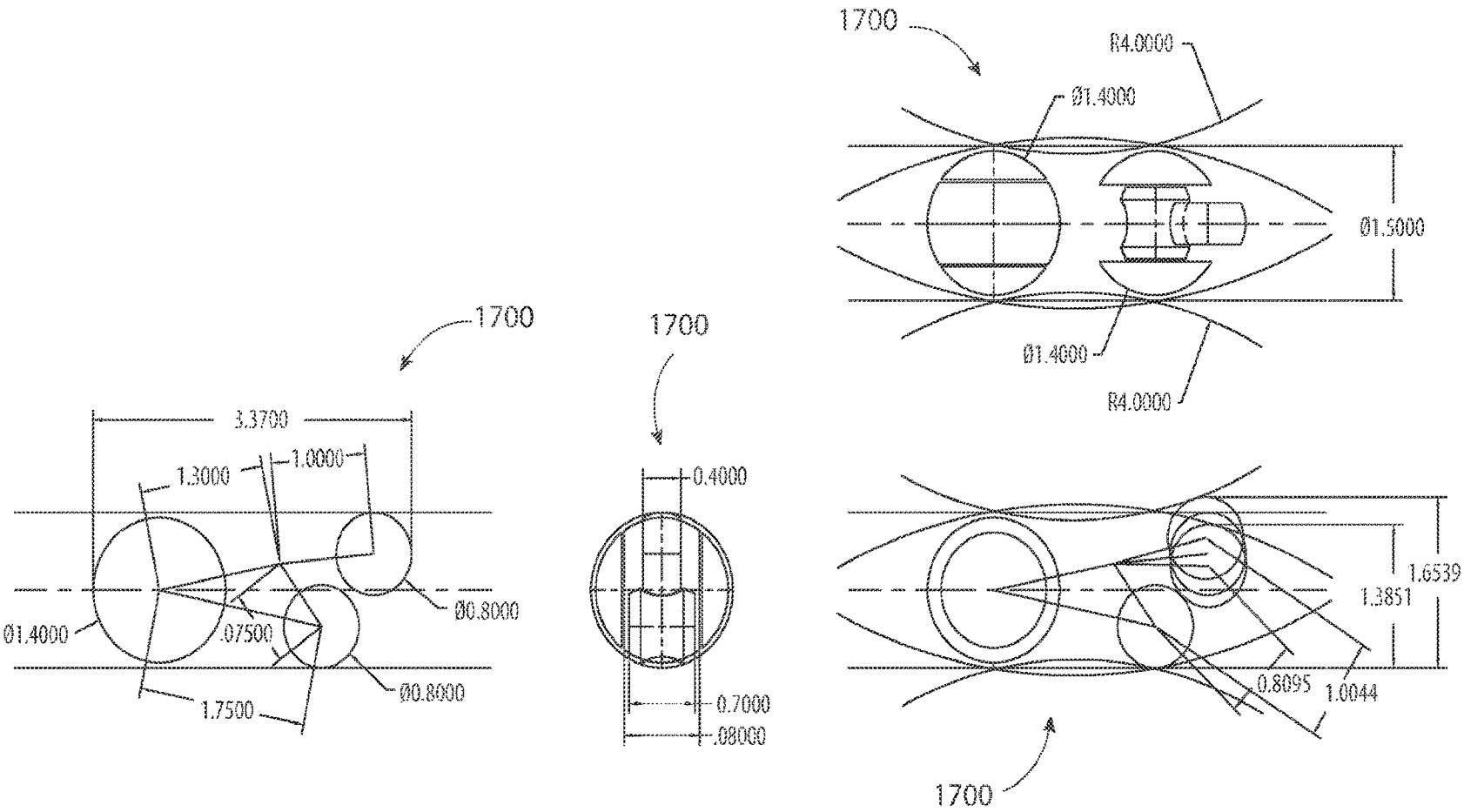
FIG. 17 is a schematic showing various views of another example vehicle and exemplary dimensions in inches.

FIG. 17 is a schematic showing various views of another example vehicle 1700 and exemplary dimensions in inches.

Figure 18:
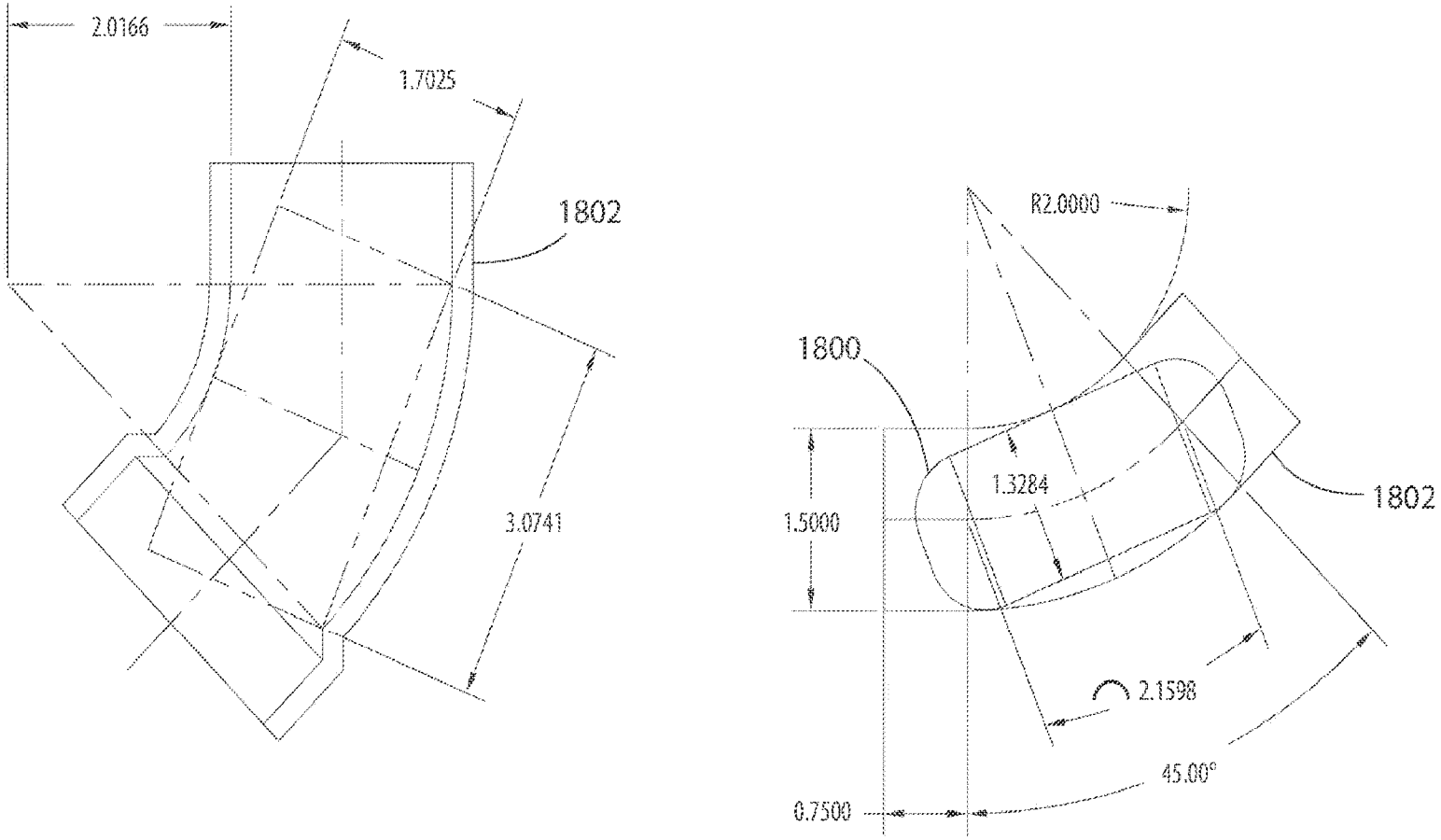
FIG. 18 illustrates maximum dimensions of a vehicle inside curved tube segments having various inner diameters and curve radii as shown.

FIG. 18 illustrates maximum dimensions of a vehicle 1800 inside curved tube segments 1802 having various inner diameters and curve radii (in inches) as shown.

Figure 19:
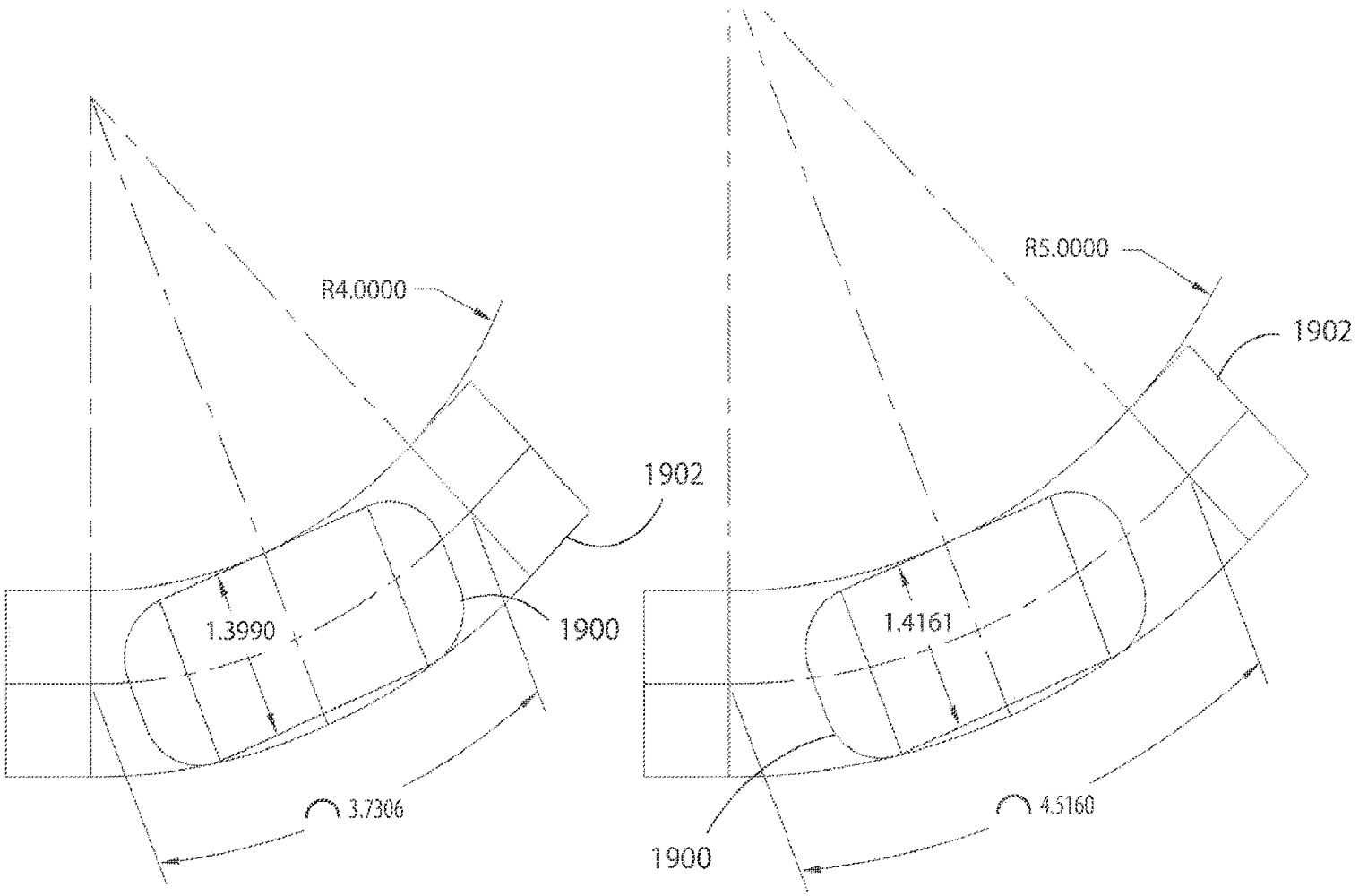
FIG. 19 illustrates maximum dimensions of a vehicle inside curved tube segments having various inner diameters and curve radii as shown.

FIG. 19 illustrates maximum dimensions of a vehicle 1900 inside curved tube segments 1902 having various inner diameters and curve radii (in inches) as shown.

Figure 20:
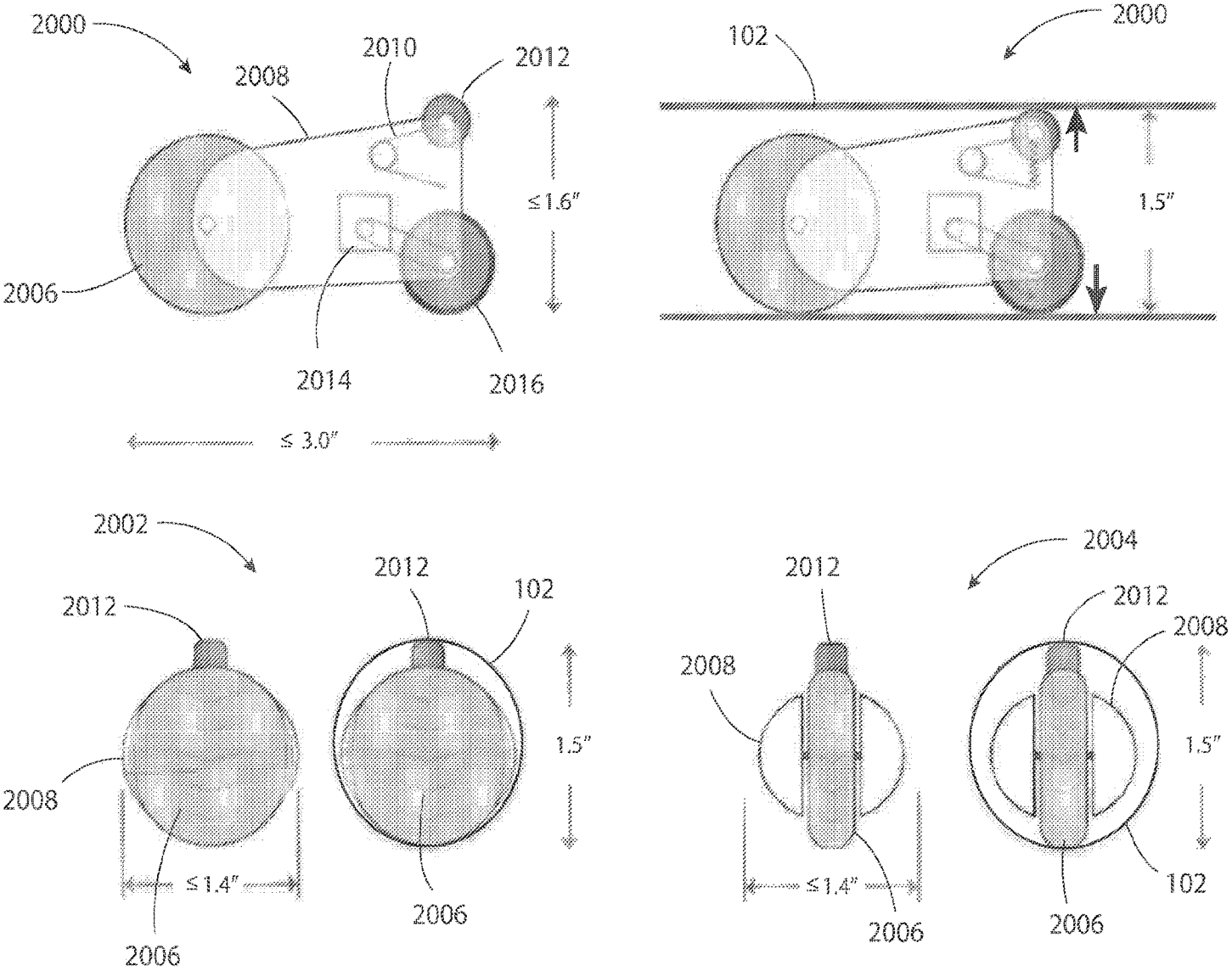
FIG. 20 illustrates various side views and first wheel options of an example vehicle.

FIG. 20 illustrates various side views and first wheel options 2002, 2004 of an example vehicle 2000. The vehicle 2000 includes a free-wheeling front wheel 2006, a housing 2008, a spring 2010 biased against a free-wheeling spring-loaded compression wheel 2012, a battery-powered motor 2014, and a motor-driven wheel 2016 with a rubber traction surface. In this example, the unsprung height of the vehicle is about 1.6 inches, but when the spring 2010 is under compression when the vehicle 2000 is inserted inside a tube section 102, the spring 2010 compresses, collapsing the height of the vehicle 2000 to 1.5 inches. This creates opposing pressure forces against the opposing inner walls of the tube sections 102 as the vehicle 2000 races therethrough. In the lower left corner, a first front wheel option 2002 is shown, in which the front wheel 2006 has a ball-like shape, and the unsprung compression wheel 2012 compresses when inserted inside a tube segment as shown in the figure to the right. An example width of the housing 2008 is 1.4 inches. In the lower right corner, a second front wheel option 2004 is shown, in which the front wheel 2006 has the shape of a bicycle wheel instead of a ball shape.

Figure 21:
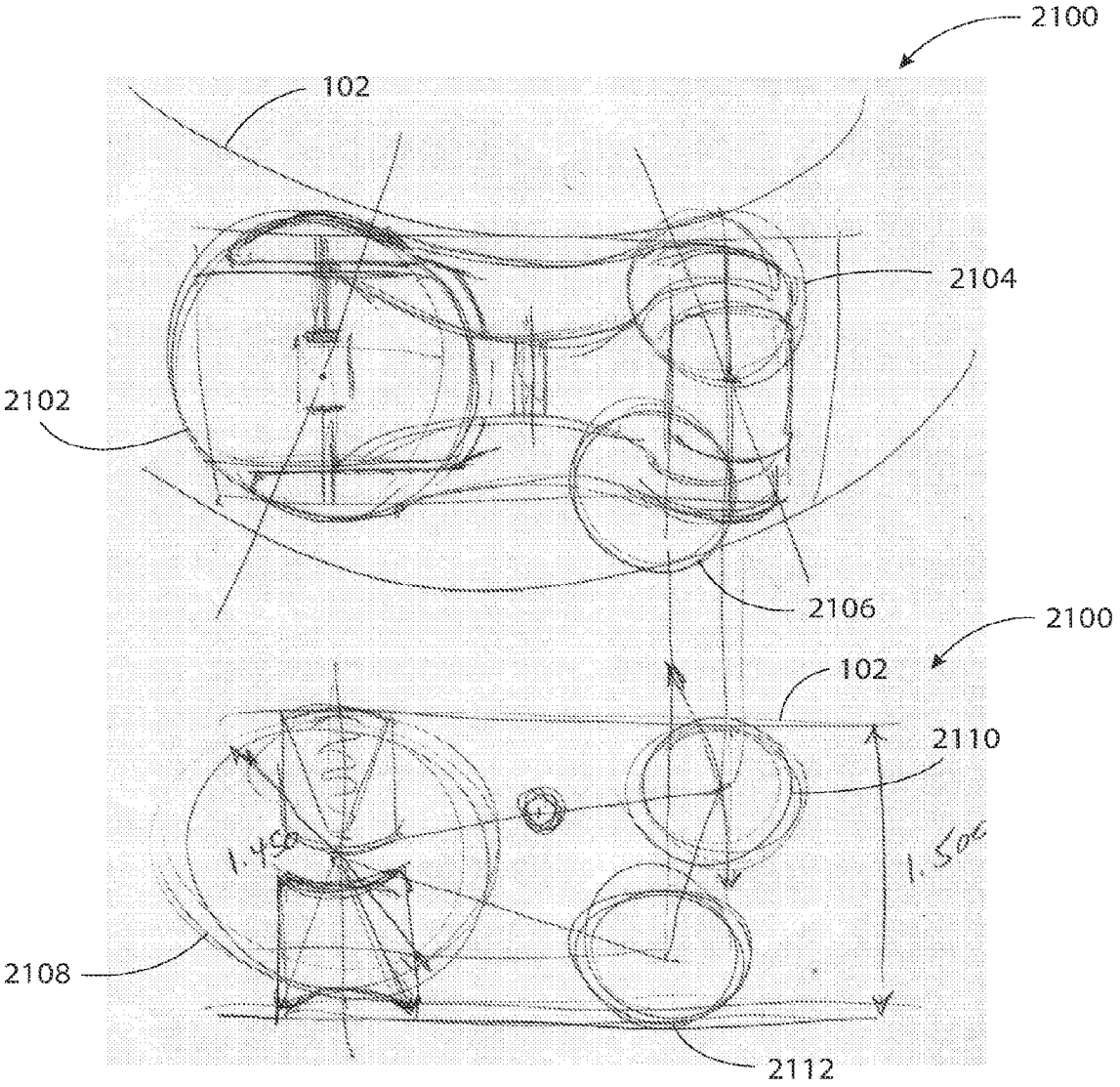
FIG. 21 illustrates side views of a vehicle inside a curved tube segment with wheels in different configurations.

FIG. 21 illustrates side views of a vehicle 2100 inside a curved tube segment 102 with wheels 2102, 2104, 2106, 2108, 2110, 2112 in different configurations.

The embodiments disclosed below in connection with FIG. 22 can use resilient rubber wheels to take up tolerance in the tube and provide traction force. The resilient rubber wheels can be in conjunction with or as an alternative to the spring loaded arm/assembly.

Embodiment 1

Helical Gear Drive is more normal in the tube and on the floor.

Embodiment 2

Belt Drive. It will be very strange on the ground as the spine will not be horizontal in many possible configurations. The belts can also be replaced with a train of idler gears if gears are preferred to belt.

Figure 22:
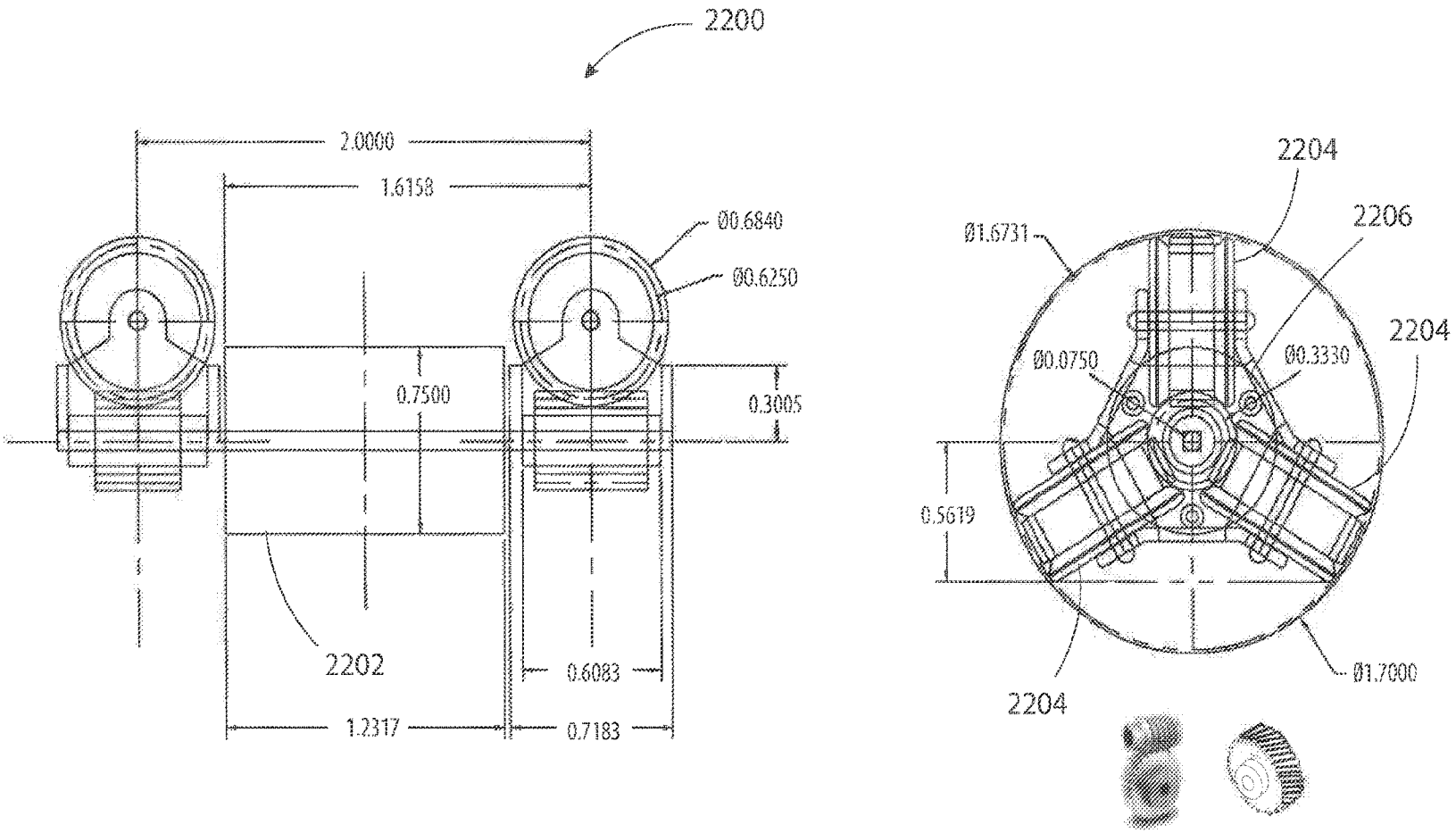
FIG. 22 illustrates a vehicle featuring a helical gear drive.

FIG. 22 illustrates a vehicle featuring a helical gear drive 2200 (Embodiment 1). The helical gear drive embodiment features:

A) A central drive gear directly coupled to the motor 2206, and 3 equally spaced driven gears 2204.

B) The driven gears are over-molded with rubber tires that straddle the central gear.

C) The drive housing is split for assembly. The motor 2206 snaps into the drive housing and connects to the central gear.

D) The associated electronics, connectors, PCB, batteries, etc. can nest in the voids around the motor or on a cage frame around the motor.

E) This arrangement allows any two wheel tangencies to drive on a flat surface, and allows space within to house a modestly sized vehicle body. If a non-flat surface vehicle is created, the body area will increase accordingly.

F) We used actual gear sizes, the smallest of which is shown in FIG. 22. This allows larger diameter outboard gears to be used, keeping the space maximized. The grouping shown increases the inner diameter of the tube by 0.200" to 1.700".

G) This configuration can be used singly or in pairs, with a single or dual shaft motor. It applies to vehicle layouts 1, 3, 5 and 7.

H) Double shaft motor will drive 6 wheels. Single shaft motor drives 3 wheels. And the other 3 wheels free-wheel.

Alternately, a vehicle featuring a belt drive drivetrain is contemplated as Embodiment 2. The belts can also be replaced with a train of idler gears if gears are preferred to belt.

Figure 23:
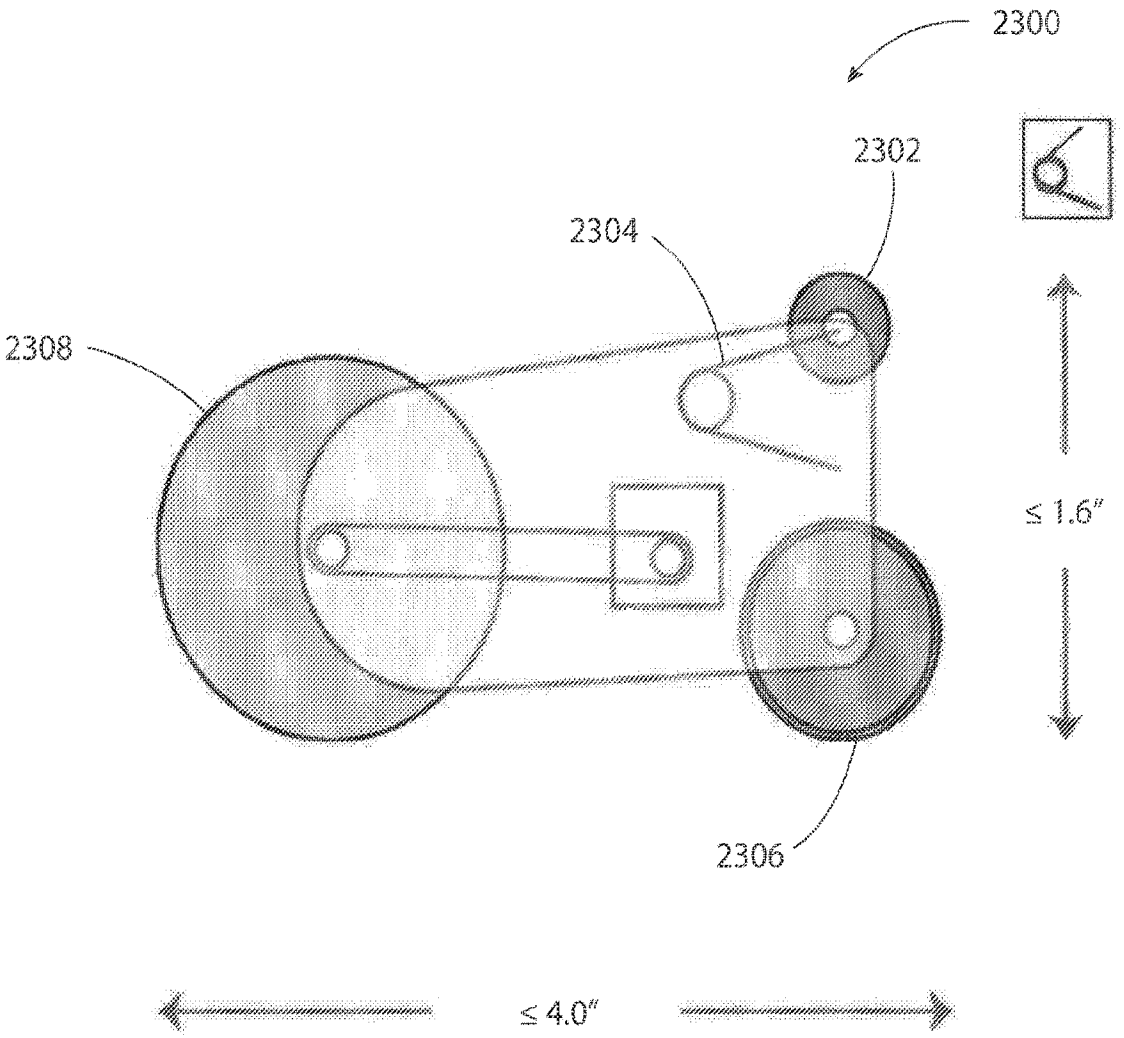
FIG. 23 illustrates a side view of a vehicle having a spring-loaded compression wheel and a free, unpowered wheel.

FIG. 23 illustrates a side view of a vehicle 2300 having a spring-loaded 2304 compression wheel 2302 and a free, unpowered wheel 2306, and a belt- or gear-driven front wheel 2308. The example dimensions are given in inches.

Figure 24:
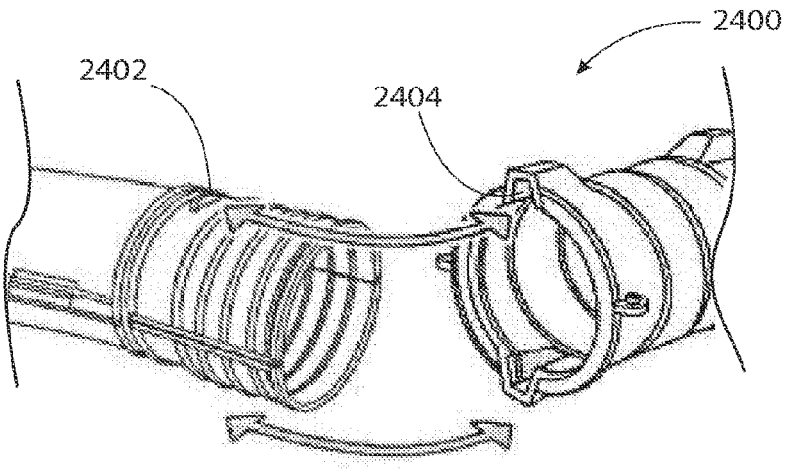
FIG. 24 illustrates a connecting system for connecting two tube sections together.

FIG. 24 illustrates a "twist to lock" connector system to connect two tube/pipe sections 2400. Tabs 2402 on the connector of one tube/pipe section are lined up with corresponding grooves 2404 on the connector of another tube/pipe section. Once the tabs 2402 and grooves 2404 are aligned, one tube/pipe section is twisted relative to the other tube/pipe section to lock the two tube/pipe sections together. Such a configuration permits 360 degrees of rotation of the tube/pipe relative to the connector and/or relative to another tube/pipe connected to the connector. The tab 2402 can be slightly wider than the groove 2404 which aids in preventing the tube/pipe from releasing itself from the connector when the tab and groove are aligned during rotation. By slightly wider it is meant, for example, about one percent wider, or about two percent wider, or about three percent wider, or about five percent wider, or about ten percent wider, or about twenty percent wider, etc. The slightly wider tab 2402 also provides an interlock that aids in further supporting the relative 360 degrees of rotation of the tube/pipe.

Figure 25:
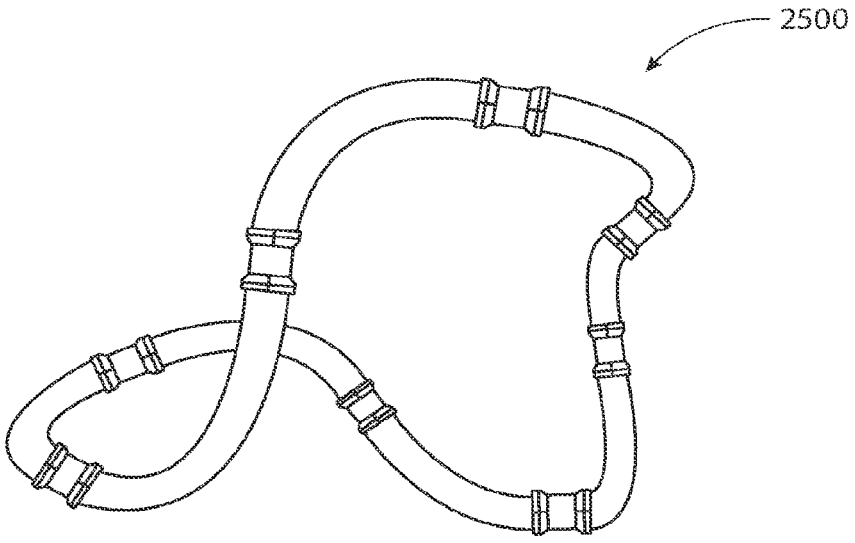
FIG. 25 illustrates an example closed loop configuration in which the tube sections are connected to form a continuous, closed loop from end to end.
Figure 26:
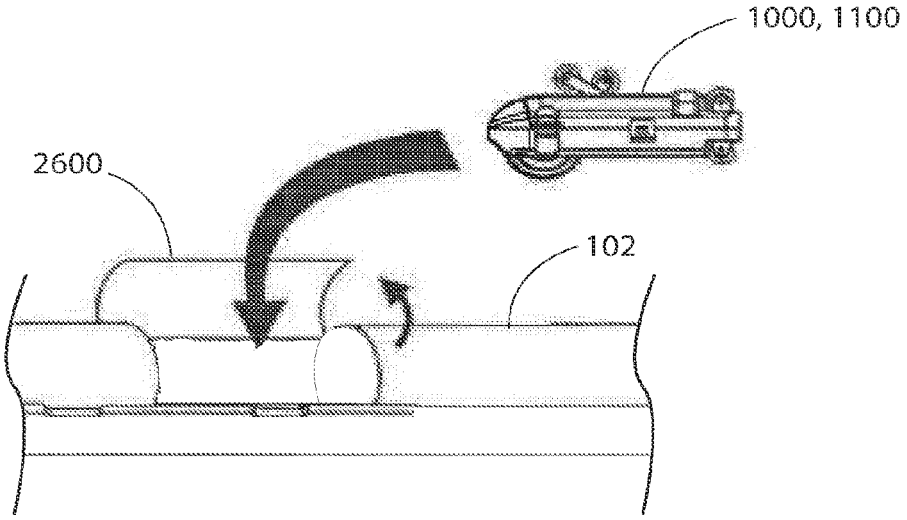
FIG. 26 illustrates a door in a tube section that can be opened to introduce the racer vehicle into a tube section, such as in the closed loop configuration shown in FIG. 25.
Figure 27:
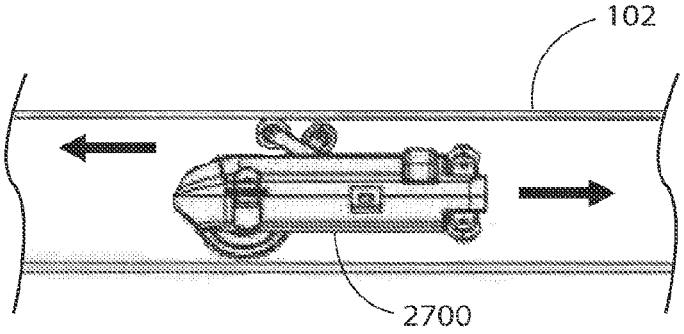
FIG. 27 illustrates a side view of a racer vehicle inside a straight tube segment with a different wheel configuration.

FIG. 25 illustrates an example of a closed-loop pipe assembly 2500, where the racer vehicle, e.g., 1000, 1100, can traverse the inner pipes in a closed loop as many times as the vehicle's battery will allow. As shown in FIG. 26, a hinged door 2600 in one of the pipe sections 102 can be accessed to introduce the racer vehicle 1000, 1100 inside the pipe section 102 of the pipe assembly. FIG. 27 illustrates another racer vehicle 2700 in a straight tube 102.

Figure 28A:
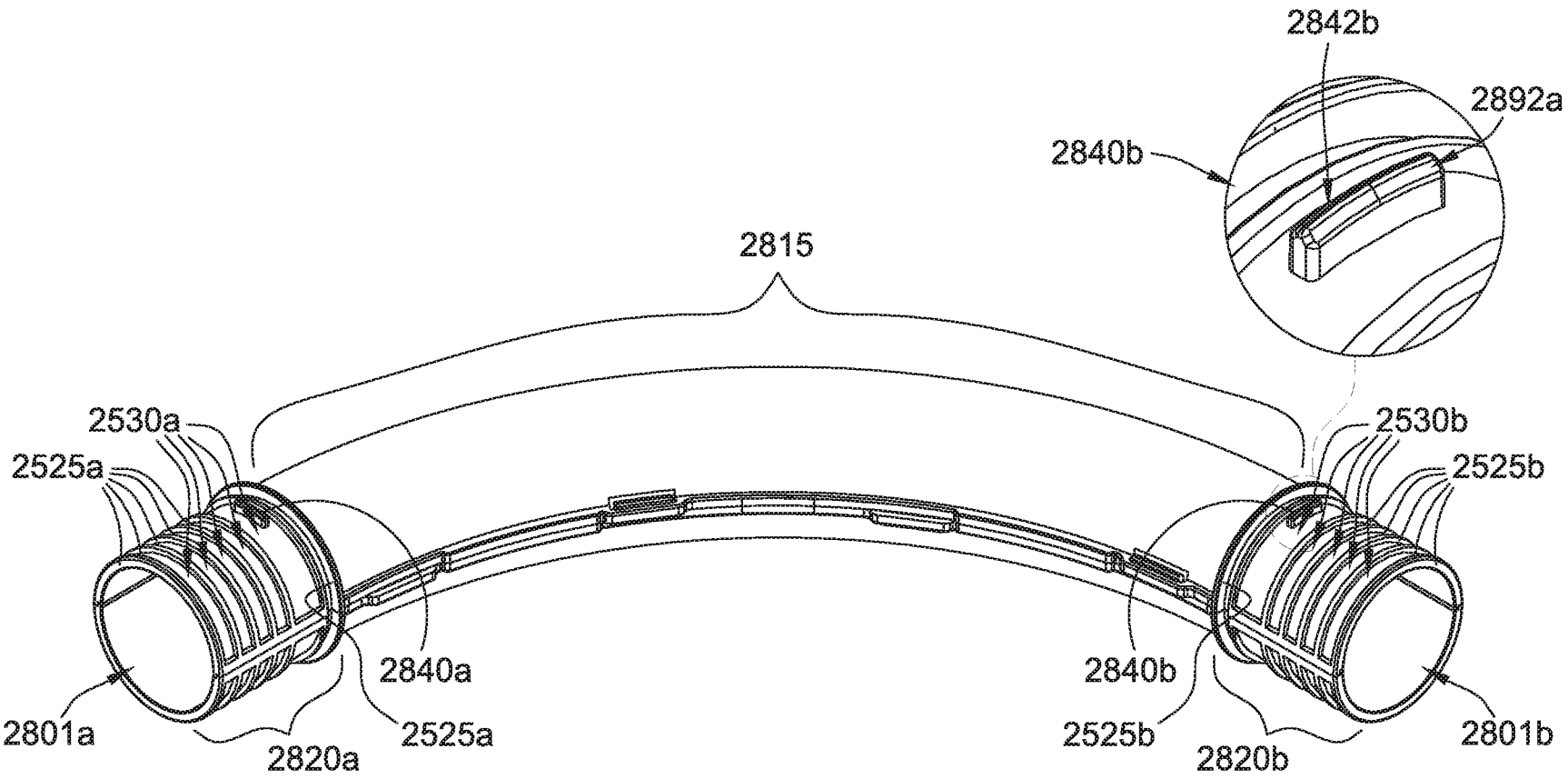
FIG. 28A is an assembled perspective view of a curved tube according to some aspects of the present disclosure.
Figure 28B:
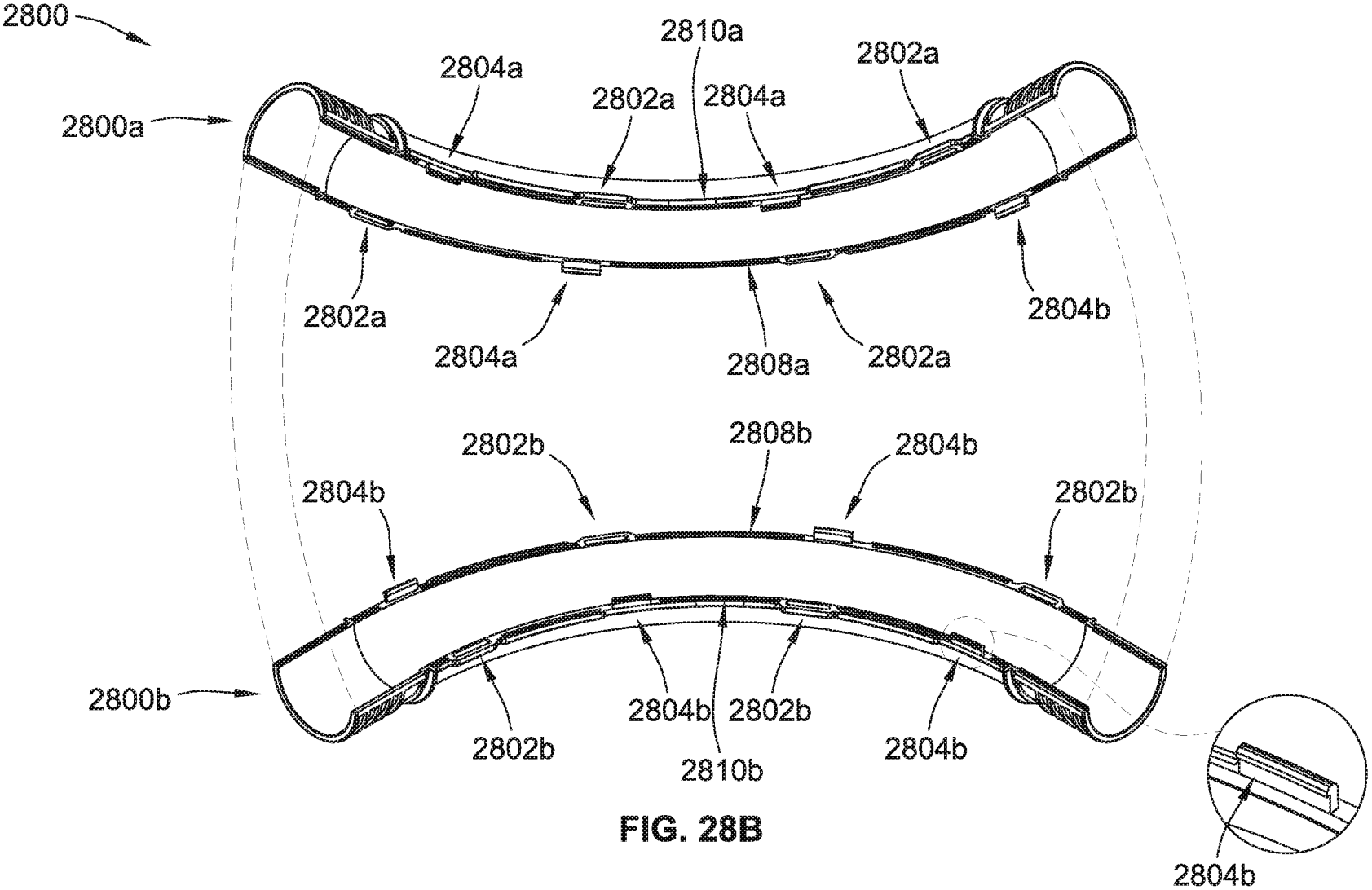
FIG. 28B is an exploded perspective view of the curved tube of FIG. 28A.
Figure 28C:
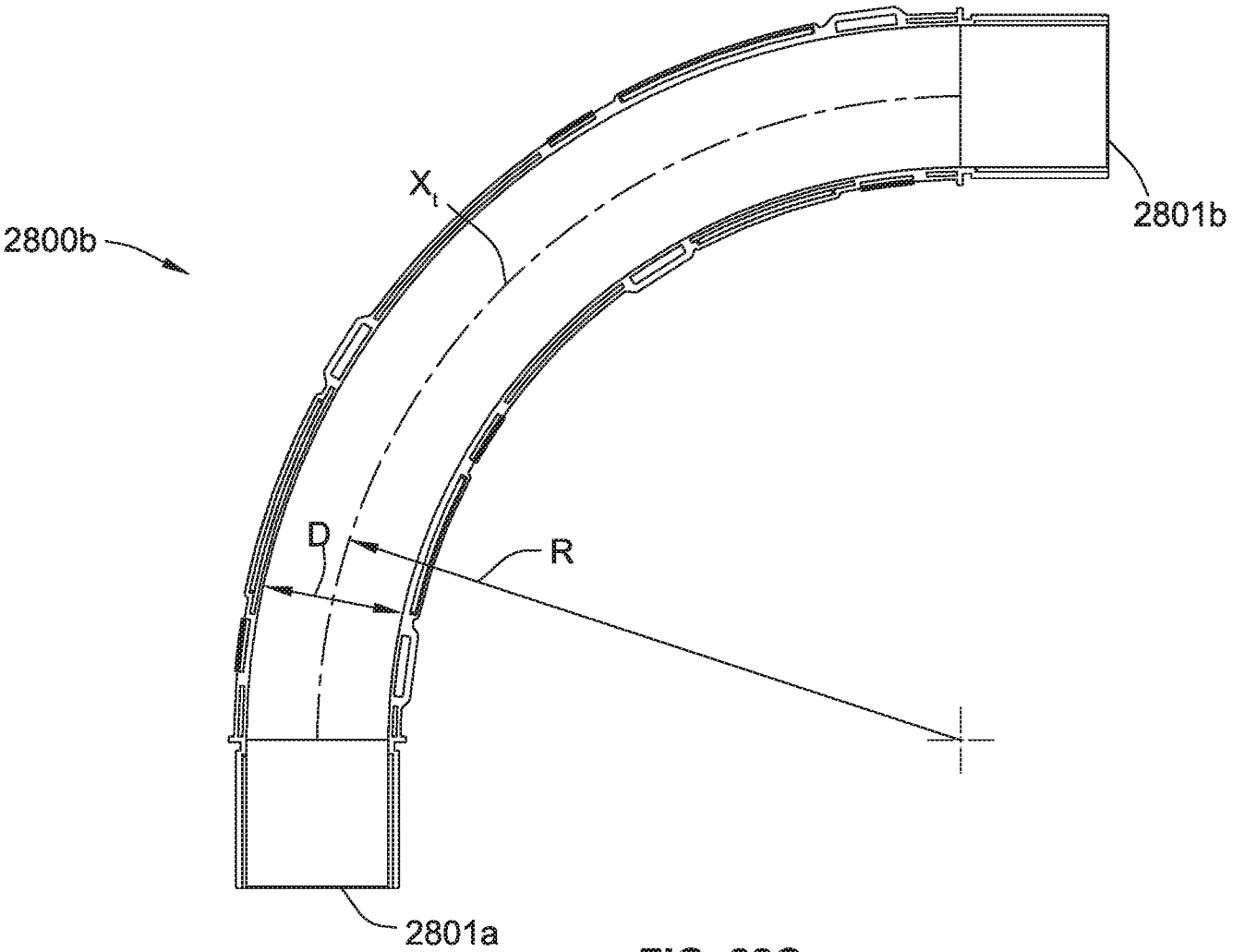
FIG. 28C is a plan view of a lower half of the curved tube of FIG. 28A.

Referring to FIGS. 28A-28C, a curved tube 2800 is shown, which can be included in a physical network of interconnected tubes (e.g., curved tubes, straight tubes, intersection tubes, etc.) through which one or more vehicles disclosed herein can move and/or be propelled independently from one another and at the same or different times. The curved tube 2800 is defined by its generally constant inner diameter, D, its radius of curvature, R, and its length along its longitudinal axis, $X_t$, between ends 2801*a,b* (FIGS. 28A and 28C), each of which is best shown in FIG. 28C.

The inner diameter, D, of the curved tube 2800 can be any number, such as, for example, about 0.5 inches, or about 0.75 inches, or about 1.0 inch, or about 1.25 inches, or about 1.5 inches, or about 1.75 inches, or about 2.0 inches, or about 2.25 inches, or about 2.5 inches, or about 2.75 inches, or about 3.0 inches, or about 3.25 inches, or about 3.5 inches, or about 3.75 inches, or about 4.0 inches, or about 4.25 inches, or about 4.5 inches, or about 4.75 inches, or about 5.0 inches, etc., or about 10.0 inches, or about 20.0 inches, etc. or any number in between, above, or below such recited examples. In some implementations, the inner diameter, D, of the curved tube 2800 is between about 0.75 inches and about 3.0 inches, or between about 1.0 inches and about 2.5 inches, or between about 1.25 inches and about 2.0 inches, or between about 1.25 inches and about 2.75 inches, etc.

The radius of curvature, R, of the curved tube 2800 can be any number, such as, for example, about 3 inches, or about 3.5 inches, or about 4 inches, or about 4.5 inches, or about 5 inches, or about 5.5 inches, or about 6 inches, or about 6.5 inches, or about 7 inches, or about 7.5 inches, or about 8 inches, or about 8.5 inches, or about 9 inches, or about 9.5 inches, or about 10 inches, or about 10.5 inches, or about 11 inches, or about 11.5 inches, or about 12 inches, etc., or any number in between, above, or below such recited examples. In some implementations, radius of curvature, R, of the curved tube 2800 is between about 4 inches and about 12 inches, or between about 5 inches and about 10 inches, or between about 6 inches and about 9 inches, or between about 8 inches and about 10 inches, etc.

The length of the longitudinal axis, $X_t$, between the ends 2801*a,b* of the curved tube 2800 can be any number, such as, for example, about 5 inches, or about 5.5 inches, or about 6 inches, or about 6.5 inches, or about 7 inches, or about 7.5 inches, or about 8 inches, or about 8.5 inches, or about 9 inches, or about 9.5 inches, or about 10 inches, or about 10.5 inches, or about 11 inches, or about 11.5 inches, or about 12 inches, or about 12.5 inches, or about 13 inches, or about 13.5 inches, or about 14 inches, or about 14.5 inches, or about 15 inches, or about 15.5 inches, or about 16 inches, etc., or any number in between, above, or below such recited examples. In some implementations, the length of the longitudinal axis, $X_t$, between the ends 2801*a,b* of the curved tube 2800 is between about 5 inches and about 20 inches, or between about 8 inches and about 15 inches, or between about 9 inches and about 13 inches, or between about 10 inches and about 12 inches, etc.

As shown in FIG. 28B, the curved tube 2800 is made from two halves 2800*a,b* that are snapped together to form a rigid curved tube having a continuous inner surface throughout a curved portion of the tube. Each of the two halves 2800*a,b* is identical and can be made from the same mold. Each of the halves 2800*a,b* includes coupling features 2802*a,b* and 2804*a,b* that couple with corresponding coupling features of the other half. Specifically, as shown in FIG. 28B, the upper half 2800*a* includes coupling features 2802*a* and 2804*a*, which alternate along the outer edge 2808*a* and the inner edge 2810*a* of the upper half 2800*b* and the lower half 2800*b* includes coupling features 2802*b* and 2804*b*, which alternate along the outer edge 2808*b* and the inner edge 2810*b* of the lower half 2800*b*. Because the upper and lower halves 2800*a,b* are identical, when the upper and lower halves 2800*a,b* are flipped and rotated 180 degrees relative to each other and positioned to be attached together and form the curved tube 2800, the coupling features 2802*a* of the upper half 2800*a* align with the coupling features 2804*b* of the lower half 2800*b* and the coupling features 2804*a* of the upper half 2800*a* align with the coupling features 2802*b* of the lower half 2800*b*.

As shown, the coupling features 2802*a,b* are slots positioned along and/or within the outer and inner edges 2808*a,b* and 2810*a,b* of the halves 2800*a,b* and the coupling features 2804*a,b* are elongated hooks positioned along and/or protruding from the outer and inner edges 2808*a,b* and 2810*a,b* of the halves 2800*a,b* that deflect to enter the slots and then clip or snap into place, thereby holding the first and the second halves 2800*a,b* together. While the curved tube 2800 is shown and described as being two separate and distinct elements, the curved tube 2800 can be made from any number of parts (e.g., one, two, three, four, ten, twenty, etc.) and/or the curved tube 2800 can be a single monolithic part.

By forming the curved tube 2800 from two identical parts, the process for making the curved tube 2800 can be simplified using fewer steps and molding parts. This also permits the shipping container/box including one or more of the curved tubes 2800 to be made relatively smaller as the two halves 2800*a,b* can be nested within one another and/or nested within other like halves of additional curved tubes 2800 included in, for example, a set of tubes having multiple ones of the curved tubs 2800.

As best shown in FIG. 28A, the curved tube 2800 has a central portion 2815 and opposing coupling portions 2820*a,b*. The coupling portions 2820*a,b* are sized and shaped to be coupled with a tube-coupler (e.g., tube-coupler 3000 described in detail below) by, for example, being at least partially accepted within the tube-coupler in a locking manner (e.g., a twist-to-lock manner). Each of the coupling portions 2820*a,b* includes a multitude of circumferentially extending ridges 2825*a,b*, which can add rigidity to the curved tube 2800 at the coupling junction (e.g., where the coupling portions 2820*a,b* and the tube-coupler overlap). One or more of the circumferentially extending ridges 2825*a,b* can be broken into one or more circumferentially extending structures and may or may not circumscribe the entire outer circumference of the coupling portion 2820*a,b*. Further, the ridges 2825*a,b* define relief spaces 2830*a,b* therebetween, which aid the coupling portions 2820*a,b* when being inserted into the tube-coupler by providing air gaps and permitting some flexibility and ease of assembly of the tubes/tube-couplers.

Figure 30A:
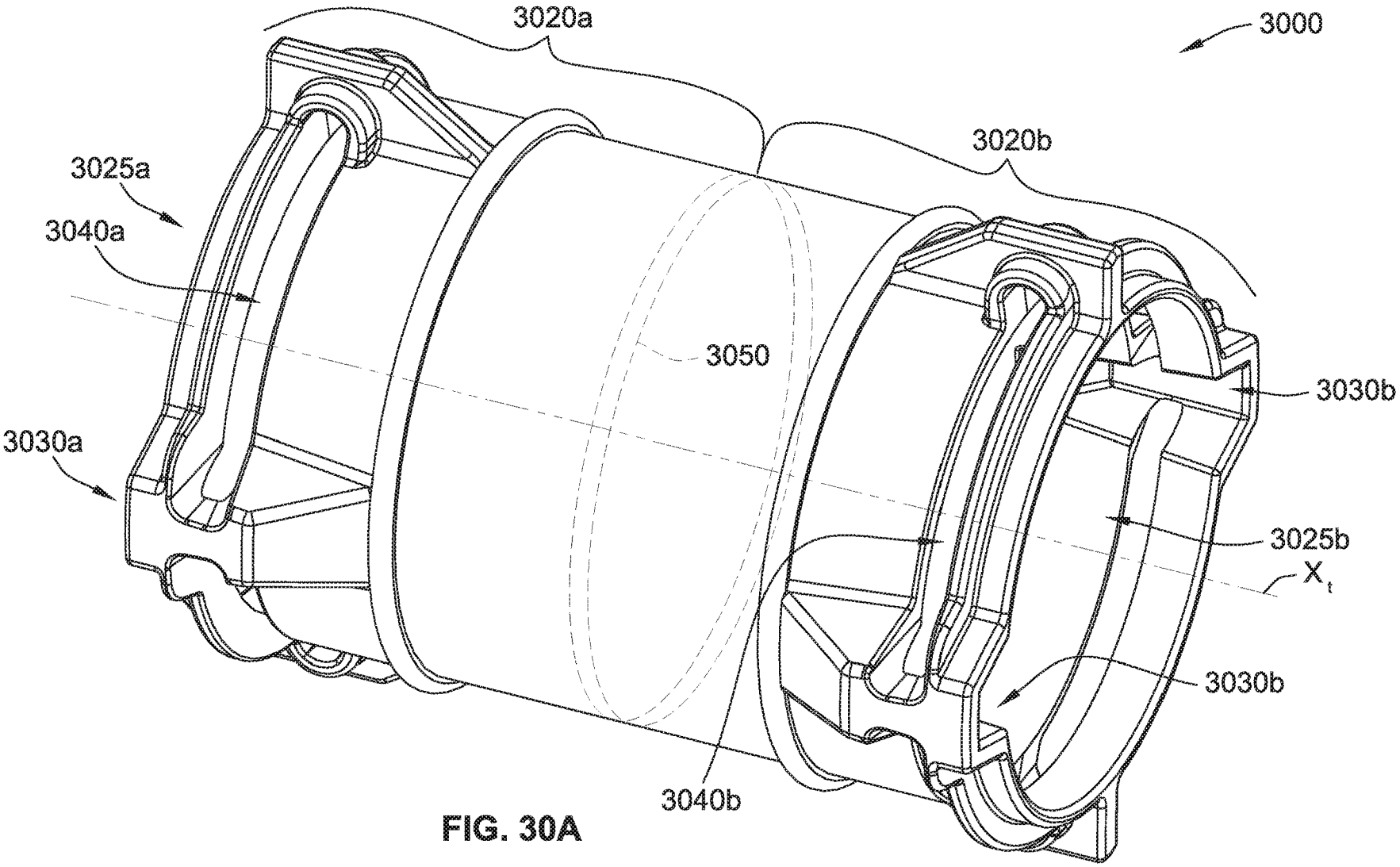
FIG. 30A is a perspective view of a tube-coupler according to some aspects of the present disclosure.
Figure 30B:
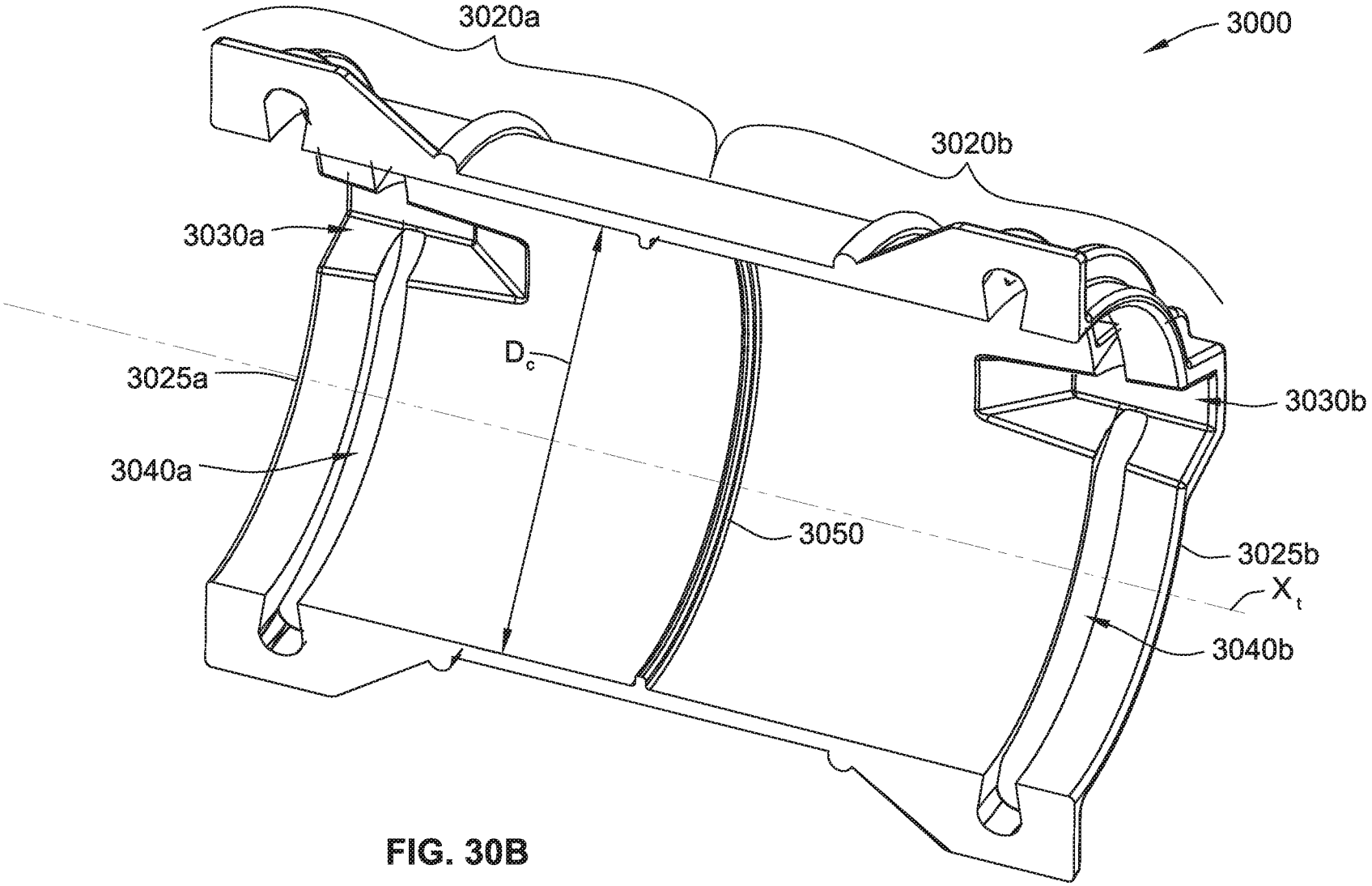
FIG. 30B is a partial perspective view of the tube-coupler of FIG. 30A.

Each of the coupling portions 2820*a,b* further includes a pair of opposing tabs 2840*a,b* (only the top one of each pair is shown in FIG. 28A). Each of the tabs 2840*a,b* protrudes outwardly from an outer surface of the coupling portions 2820*a,b* of the curved tube 2800. As best shown in the enlarged detail of FIG. 28A, each of the tabs 2840*a,b* has dual inwardly tapered surfaces 2842*a,b* that taper inwardly from both a front (2842*a*) and rear (2842*b*) of the tab 2840*a,b*. Such a dual taper aids in the coupling/decoupling of the coupling portions 2820*a,b* with the tube-coupler (e.g., tube-coupler 3000). Similarly to the discussion of tabs 2402 in connection with FIG. 24, the tabs 2840*a,b* can be slightly wider or oversized tabs that are, for example, slightly wider than a portion of the pair of opposing inwardly tapered grooves 3030*a,b* (shown in FIGS. 30A and 30B and described below) that directly leads into the circumferentially extending channel 3040*a,b* (FIGS. 30A and 30B) of the tube-coupling portions 3020*a,b* (FIGS. 30A and 30B). In some such implementations (e.g., oversized/slightly wider tabs), the dual taper of the tabs 2840*a,b* aids the oversized tabs 2804*a,b* in being easily forced into the circumferentially extending channel 3040*a,b* (FIGS. 30A and 30B).

Figure 29A:
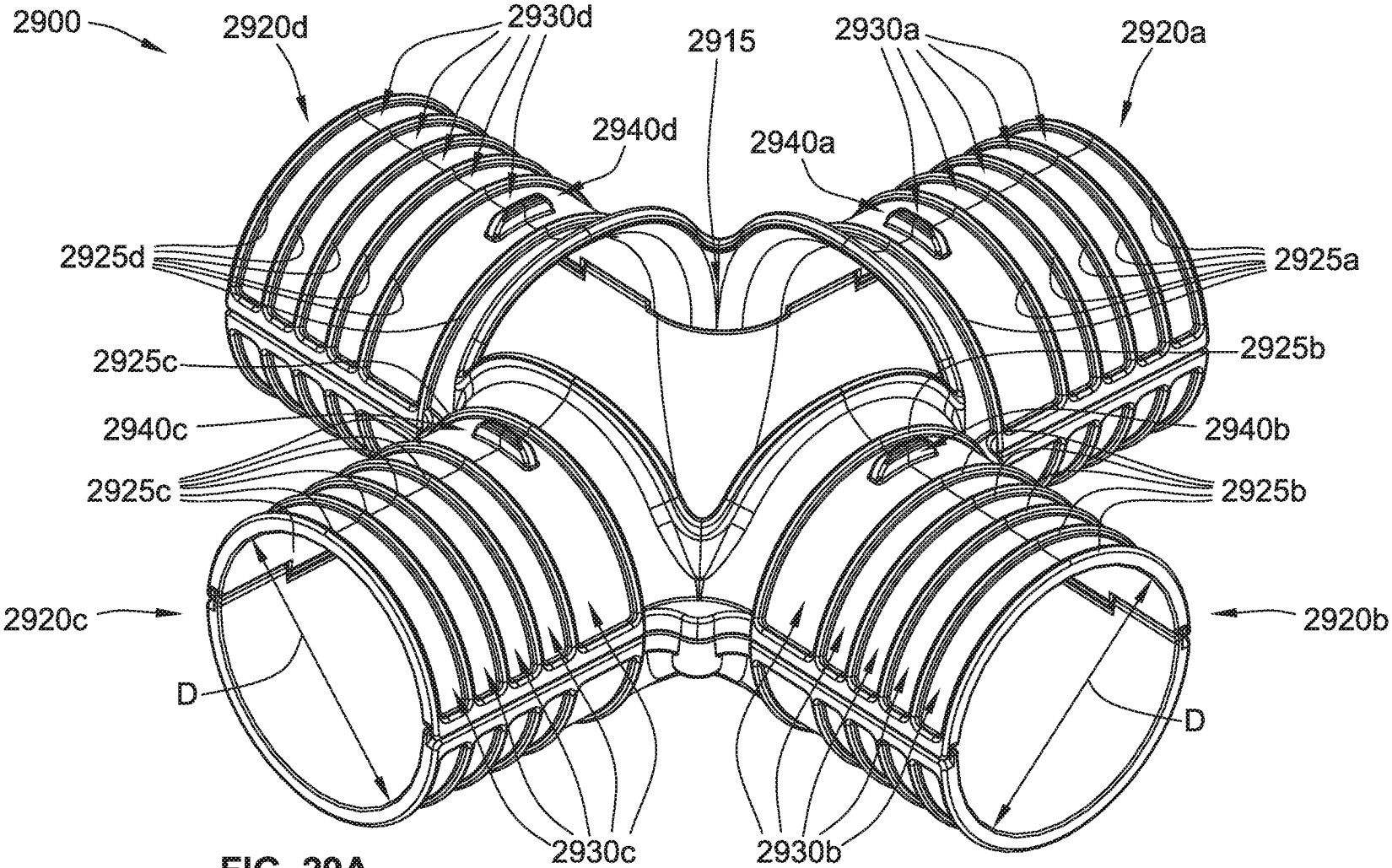
FIG. 29A is an assembled perspective view of an intersection tube according to some aspects of the present disclosure.
Figure 29B:
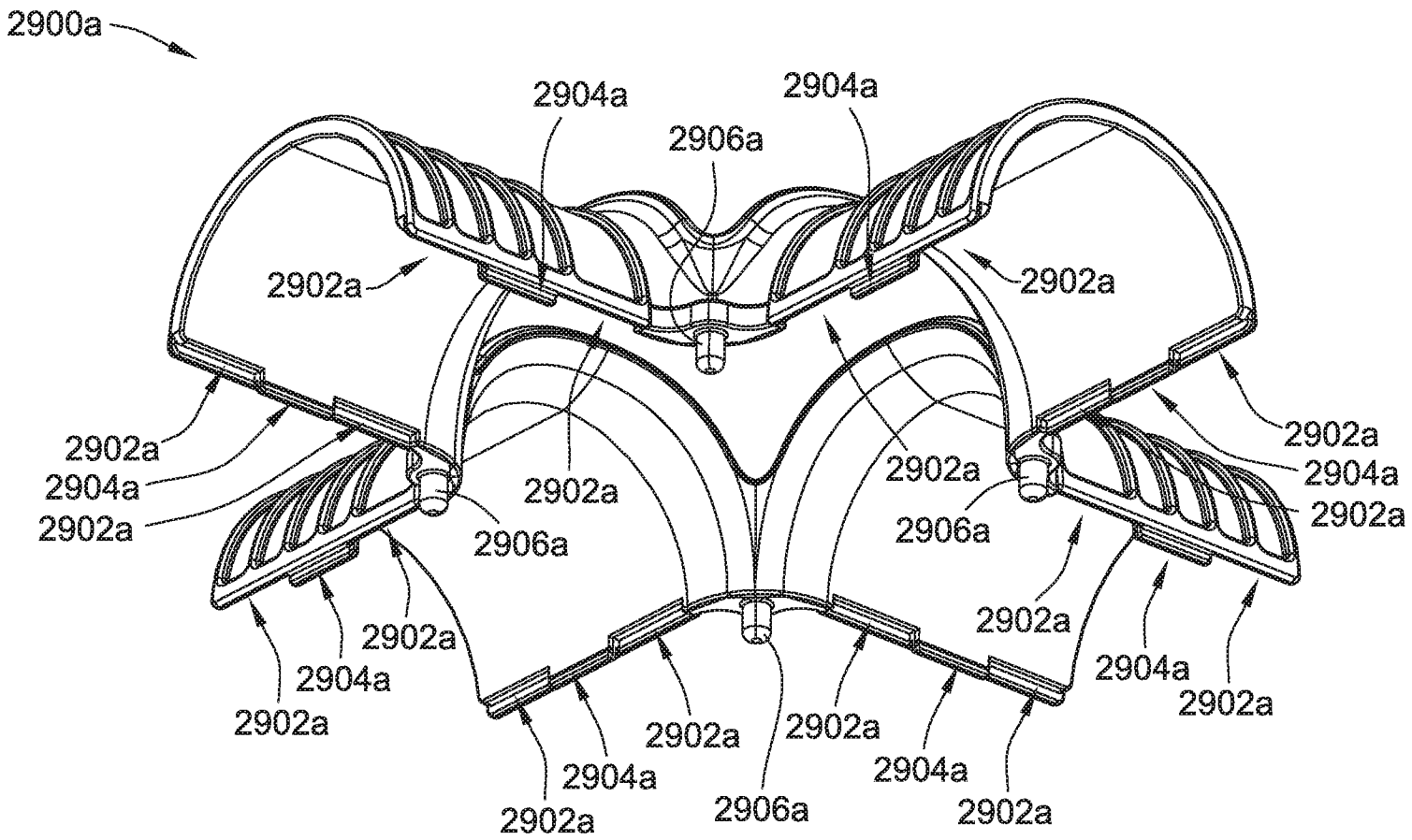
FIG. 29B is a perspective view of an upper half of the intersection tube of FIG. 29A.
Figure 29C:
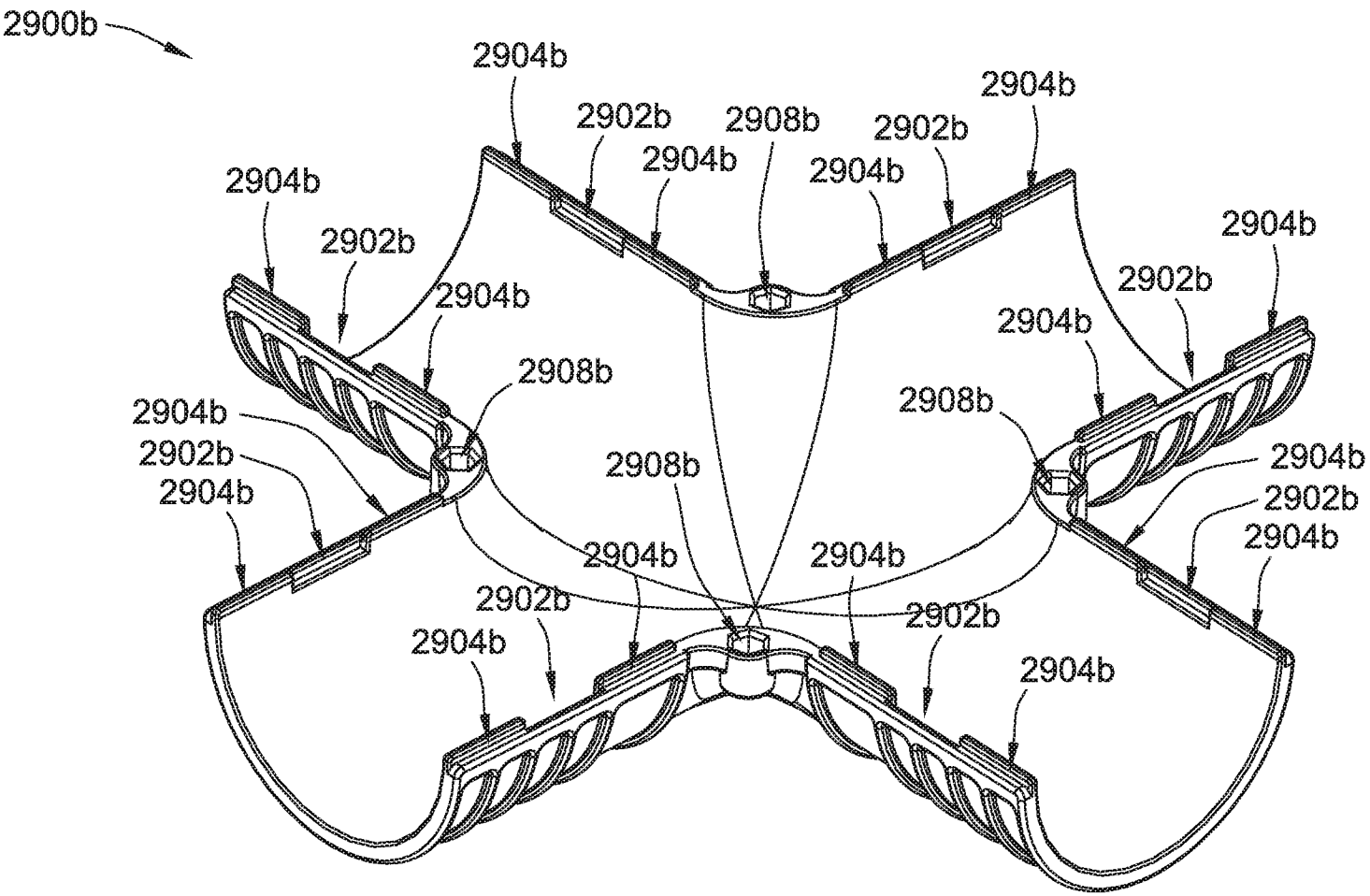
FIG. 29C is a perspective view of a lower half of the intersection tube of FIG. 29A.

Now referring to FIGS. 29A-29C, an intersection tube 2900 is shown, which can be included in a network of interconnected tubes (e.g., curved tubes, straight tubes, intersection tubes, etc.) through which one or more vehicles can move and/or be propelled independently from one another and at the same or different times. The intersection tube 2900 is defined by its generally constant inner diameter, D, which is the same as, or similar to, the inner diameter, D, of the curved tube 2800 described above, and its four coupling portions 2920*a,b,c,d*, which extend from a central portion 2915 such that the intersection tube 2900 has a generally X-shape or a generally cross-shape.

As shown in FIGS. 29B and 29C, the intersection tube 2900 is made from two halves 2900*a,b* that are coupled together. Each of the halves 2900*a,b* includes coupling features 2902*a,b*, 2904*a,b*, 2906*a*, and 2908*b* that couple with corresponding coupling features of the other half. Specifically, as shown in FIG. 29B, the upper half 2900*a* includes coupling features 2902*a* and 2904*a*, which alternate along the edges of the upper half 2900*b* and as shown in FIG. 29C the lower half 2900*b* includes coupling features 2902*b* and 2904*b*, which alternate along the edges of the lower half 2900*b*. Additionally, the upper half 2900*a* includes coupling features 2906*a*, which protrude from the edges of the upper half 2900*b* and the lower half 2900*b* includes coupling feature 2908*b*, which are recessed within the edges of the lower half 2900*b*. When the upper and lower halves 2900*a,b* are positioned to be attached together and form the intersection tube 2900, the coupling features 2902*a* of the upper half 2900*a* align with the coupling features 2904*b* of the lower half 2900*b*; the coupling features 2904*a* of the upper half 2900*a* align with the coupling features 2902*b* of the lower half 2900*b*; and the coupling features 2906*a* of the upper half 2900*a* align with the coupling features 2908*b* of the lower half 2900*b*.

As shown, the coupling features 2902*a,b* are channels along and/or within the edges of the halves 2900*a,b* and the coupling features 2904*a,b* are wide protrusions or tabs along the edges of the halves 2900*a,b* that deflect to enter the channels and then hold in place (e.g., press fit, friction fit, snap-fit, click, etc. or a combination thereof), thereby holding the first and the second halves 2900*a,b* together. Further, the coupling features 2906*a* are protruding posts positioned at four corners of the central portion 2915 (FIG. 29A) of the upper half 2900*a* of the intersection tube 2900 and the coupling features 2908*b* are bores positioned at four corresponding corners of the central portion 2915 of the lower half 2900*b* of the intersection tube 2900 that receive corresponding ones of the posts therein and hold the posts in place (e.g., press fit, friction fit, snap-fit, click, etc. or a combination thereof). While the intersection tube 2900 is shown and described as being two separate and distinct elements, the intersection tube 2900 can be made from any number of parts (e.g., one, two, three, four, ten, twenty, etc.) and/or the intersection tube 2900 can be a single monolithic part.

The coupling portions 2920*a,b,c,d* of the intersection tube 2900 are the same as, or similar to, the coupling portions 2820*a,b* described above in connection with the curved tube 2800. Specifically, each of the coupling portions 2920*a,b,c,d* includes a multitude of circumferentially extending ridges 2925*a,b,c,d*, relief spaces 2930*a,b,c,d*, and a pair of opposing tabs 2940*a,b,c,d*, which are the same as, or similar to, the multitude of circumferentially extending ridges 2825*a,b*, relief spaces 2830*a,b*, and the pairs of opposing tabs 2840*a,b* described above in connection with the curved tube 2800.

The upper half 2900*a* of the intersection tube 2900 mainly differs from the lower half 2900*b* of the intersection tube 2900 in that the central portion 2915 is open in the upper half 2900*a* and closed in the lower half 2900*b*. The opening in the central portion 2915 of the upper half 2900*a* permits a user/operator of the network of interconnected tubes including the intersection tube 2900 to manipulate one or more vehicles, which might be stopped or disabled in the intersection tube 2900 due to, for example, a crash between two vehicles therein. The intersection tube 2900 can also be referred to as a crash tube as it provides an intersection path in which two vehicles traveling in the same or opposite or crossing/orthogonal directions can collide and crash. The opening in the upper half 2900*a* also provides a means for introducing vehicles into an otherwise closed loop or network of interconnected tubes.

Referring to FIGS. 30A-30B, a tube-coupler 3000 is shown, which can be included in a network of interconnected tubes (e.g., curved tubes, straight tubes, intersection tubes, etc.) through which one or more vehicles can move and/or be propelled independently from one another and at the same or different times. The tube-coupler 3000 is defined by (i) its generally constant inner diameter, Dc, which is the same as, or similar to, an outer diameter of the curved tube 2800, (ii) its two opposing tube-coupling portions 3020*a,b*, which extend generally from a central portion of the tube-coupler 3000 such that the tube-coupler 3000 has a generally straight shape, and (iii) its length along its longitudinal axis, $X_t$, between generally circular openings defining ends 3025*a,b* of the tube-coupler 3000.

Various other shapes for the tube-coupler 3000 are contemplated such that the tube-coupler 3000 can couple two tubes together (e.g., two curved tubes, two straight tubes, two intersection tubes, one straight tube with one curved tube, etc.). For example, the tube-coupler 3000 can have a generally curved L-shape, a generally U-shape, a generally curved angled shaped, a curved/arc shape, etc. or any combination thereof.

The tube-coupler 3000 can be short or long, where the length of the tube-coupler along its longitudinal axis, $X_t$, between the ends 3025*a,b* of the tube-coupler 3000 can be any number, such as, for example, about 1 inch, or about 1.25 inches, or about 1.5 inches, or about 1.75 inches, or about 2 inches, or about 2.25 inches, or about 2.5 inches, or about 2.75 inches, or about 3 inches, or about 3.25 inches, or about 3.5 inches, or about 3.75 inches, or about 4 inches, or about 4.25 inches, or about 4.5 inches, or about 4.75 inches, or about 5 inches, or about 5.5 inches, or about 6 inches, or about 8 inches, or about 10 inches, etc. or any number in between, above, or below such recited examples. In some implementations, the length of the longitudinal axis, $X_t$, between the ends 3025*a,b* of the tube-coupler 3000 is between about 1 inch and about 20 inches, or between about 1.5 inches and about 10 inches, or between about 1.5 inches and about 5 inches, or between about 2 inches and about 3 inches, etc.

The tube-coupler 3000 is shown as a monolithic part; however, the tube-coupler 3000 can be made from any number of parts (e.g., one, two, three, four, ten, twenty, etc.).

The first tube-coupling portion 3020*a* of the tube-coupler 3000 is configured to lockingly couple (e.g., twist-to-lock) with a coupling portion of a first tube (e.g., curved tube 2800, intersection tube 2900, a straight tube, etc.) and the second tube-coupling portion 3020*b* of the tube-coupler 3000 is configured to lockingly couple (e.g., twist-to-lock) with a coupling portion of a second tube (e.g., curved tube 2800, intersection tube 2900, a straight tube, etc.) that is separate and distinct from the first tube. Likewise, the same tube-coupling portions 3020*a*, 3020*b* can be decoupled from the corresponding tubes 2800, 2900 by aligning a tab with a corresponding groove as described below using a twist-and-pull-to-unlock manipulation in which the coupling portion and tube are twisted relative to one another and then pulled apart once the tab aligns with the groove to decouple the two parts from one another.

Each of the tube-coupling portions 3020*a,b* defines a generally circular opening 3025*a,b* through which the coupling portion of the tube is inserted. Each of the tube-coupling portions 3020*a,b* also includes a pair of opposing inwardly tapered grooves 3030*a,b*, which are sized and position to receive therein a pair of opposing tabs (e.g., the pair of opposing tabs 2840*a,b*, the pair of opposing tabs 2940*a,b,c,d*) of a coupling portion of a tube. The inwardly tapered grooves 3030*a,b* provide access for the opposing tabs into a circumferentially extending channel 3040*a,b* of the tube-coupling portions 3020*a,b*. While the circumferentially extending channel 3040*a,b* is shown to include the entire circumference, it is contemplated that the circumferentially extending channel 3040*a,b* is only partially circumscribing (e.g., only 50 percent circumscribing, only 60 percent circumscribing, only 70 percent circumscribing, only 80 percent circumscribing, only 90 percent circumscribing, etc. or any amount below, above, or in between such recited examples).

Responsive to a pair of opposing tabs of a tube being received in one of the circumferentially extending channels 3040*a,b*, the tube can be "locked" with the tube-coupler 3000 by twisting and/or rotating the tube and/or the tube-coupler 3000 relative to one another such that the pair of opposing tabs of the tube are offset from (e.g., not aligned with) the inwardly tapered grooves 3030*a,b*. As such, the tube and the tube-coupler 3000 are locked and/or held together/coupled. Similar to the tabs 2402 described above, the tabs 2840*a,b* can be slightly wider/oversized than the entrance(s) to the circumferentially extending channel 3040*a,b* which aids in preventing tubes from inadvertently releasing or decoupling from the tube-coupler 3000 when the tabs 2840*a,b* and entrance(s) to the circumferentially extending channel 3040*a,b* are aligned during relative rotation. By slightly wider it is meant, for example, about one percent wider, or about two percent wider, or about three percent wider, or about five percent wider, or about ten percent wider, or about twenty percent wider, etc. The slightly wider tabs 2840*a,b* also provides an interlock that aids in further supporting relative 360 degrees of rotation of the tube and tube-coupler 3000.

As best shown in FIG. 30B, the tube-coupler 3000 includes a circumferentially extending stop or ridge 3050 located at a middle of the tube-coupler 3000. Depending on the length of the tube-coupler 3000 along its longitudinal axis, $X_t$, the tube-coupler 3000 can include two separate and distinct ridges 3050 (e.g., one for each tube-coupling portion 3020*a,b*). The ridge 3050 is sized and positioned such that tubes being coupled with the tube-coupler 3000 are not over inserted (e.g., inserted or pushed too far) into the tube-coupler 3000 and instead abut the ridge 3050 when fully inserted. The ridge 3050 can be broken into one or more circumferentially extending structures and may or may not circumscribe the entire inner circumference of the tube-coupler 3000.

Figure 31A:
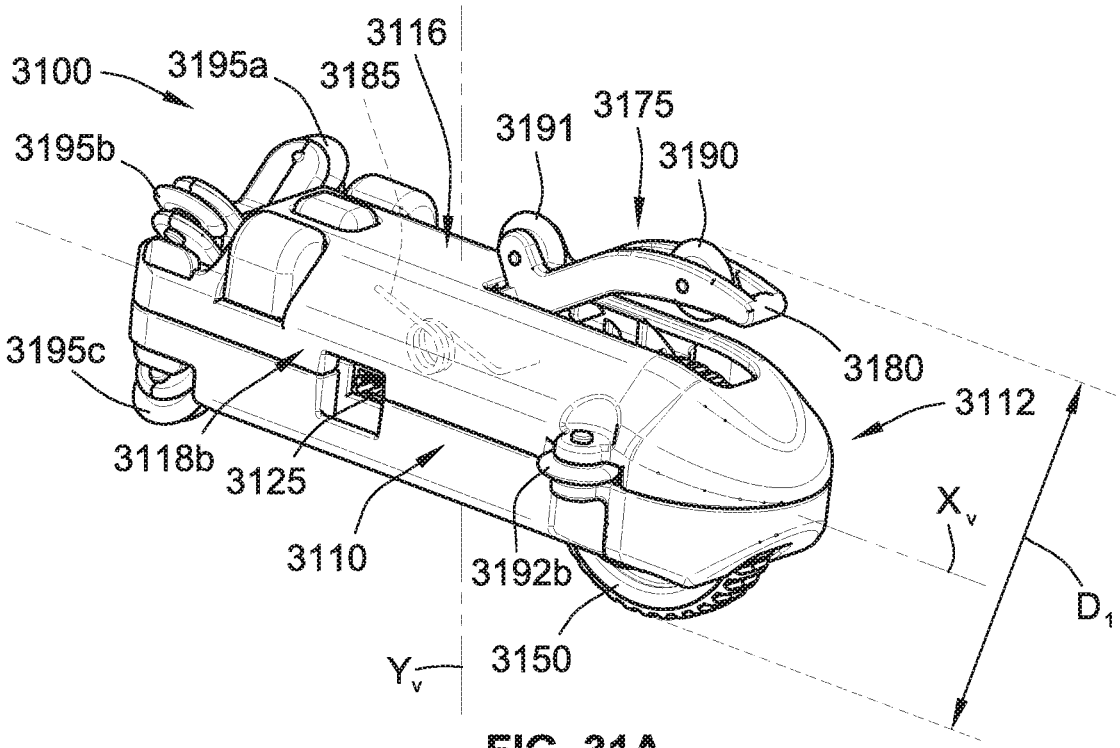
FIG. 31A is a top assembled perspective view of a vehicle according to some aspects of the present disclosure.
Figure 31B:
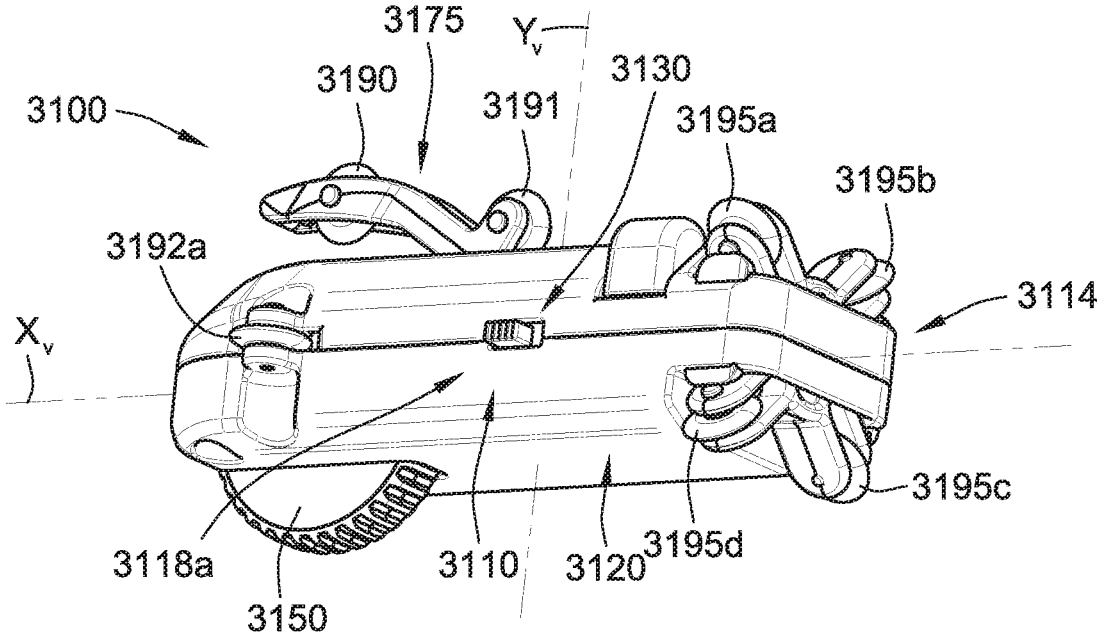
FIG. 31B is a bottom assembled perspective view of the vehicle of FIG. 31A.
Figure 31C:
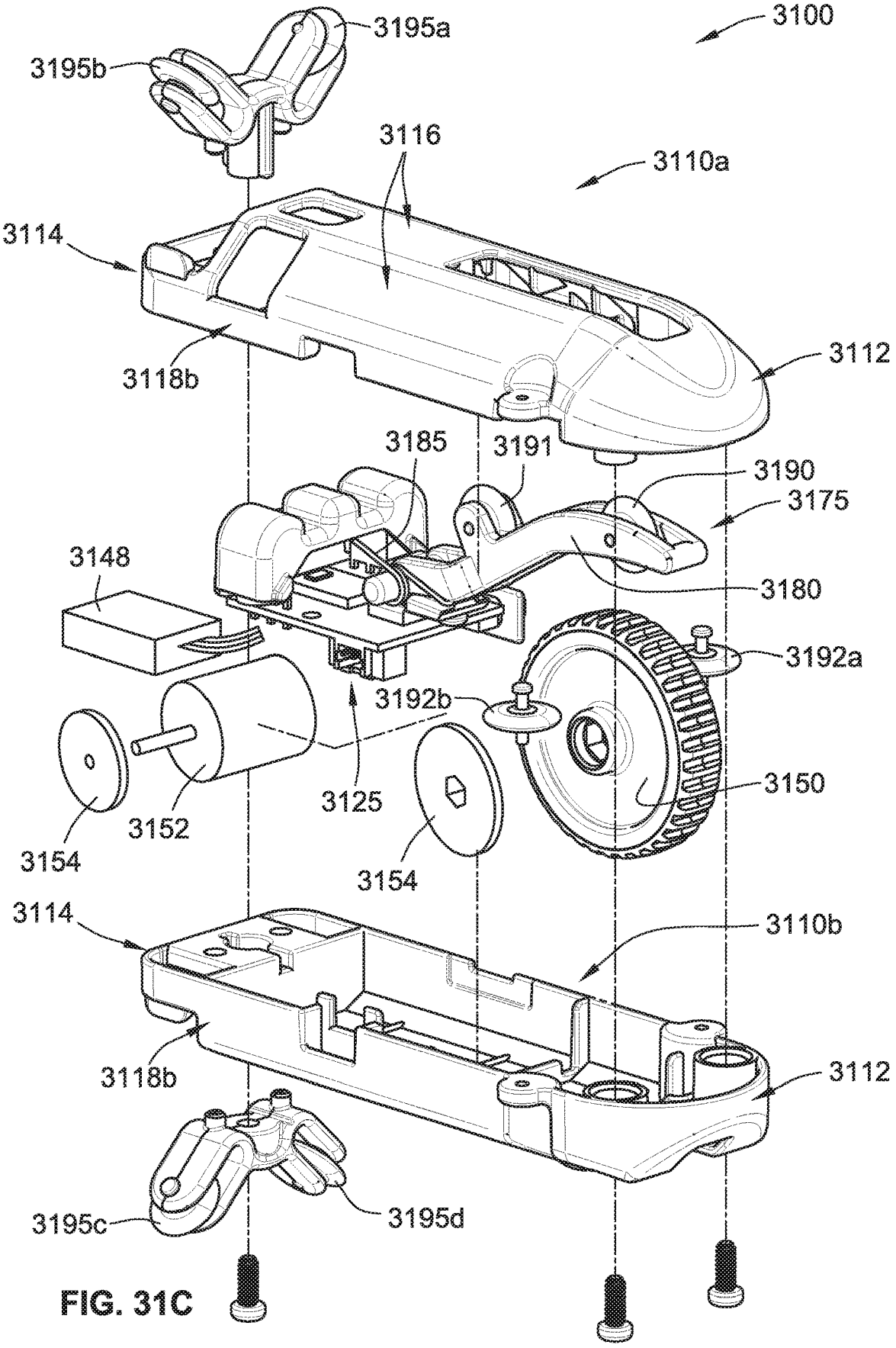
FIG. 31C is an exploded perspective view of the vehicle of FIG. 31A.

Referring to FIGS. 31A-31C, a vehicle 3100 is shown, which can be positioned within a network of interconnected tubes (e.g., curved tubes, straight tubes, intersection tubes, etc.) such that the vehicle 3100 can move under its own power and/or be propelled (e.g., self-propelled via an on-board motor and/or via gravity) therein in any direction in a 3-dimensional volumetric space defined by the network of interconnected tubes, including in directions opposing gravity. The vehicle 3100 includes a housing or body 3110, a driven and/or motorized wheel 3150, and a biasing assembly 3175.

The body 3110 can be formed from any number of separate parts coupled together (e.g., two parts, three parts, five parts, ten parts, etc.) and/or the body 3110 can be a single monolithic part. As shown in FIG. 31C, the body 3110 includes an upper portion 3110*a* and a lower portion 3110*b*. The body 3110 can have any type and/or size of shape such that the body 3110 and any of the other elements/portions of the vehicle 3100 protruding from an outer surface of the body 3110 can be positioned within an unobstructed network of interconnected tubes and be propelled therethrough without the vehicle 3100 getting stuck or jammed. That is, the vehicle 3100 will not get stuck or jammed regardless of the rotational orientation of the vehicle 3100 about a longitudinal axis, $X_v$, of the vehicle, which is positioned through a geometric center of the body 3110. Of course, if an obstacle (e.g., another vehicle, a block, etc.) is positioned with the network of interconnected tubes creating an obstruction therein, the obstacle could cause the vehicle to be stopped in the network of interconnected tubes.

As shown, the body 3110 has a shape that approximates the shape of a rectangular cuboid having a tapered and/or curved front end 3112 (e.g., for aerodynamics) and a generally flat rear end or tail 3114. Note that the terms front and rear denote opposite ends of the body, and not necessarily a direction of travel as the vehicle can travel in either direction. If the vehicle has the motorized wheel on one end that propels the vehicle forward from the motorized wheel, the end of the body where the motorized wheel is located can be referred to as the front end. An upper surface 3116 (FIG. 31A) of the body 3110 is generally flat and tapers toward the sides 3118*a,b*. A lower surface 3120 (FIG. 31B) of the body 3110 is generally flat. Again, because the vehicle can rotate circumferentially 360 degrees about a center axis of its body as it is propelled through the network of interconnected tubes, the upper and lower surfaces denote opposite surfaces of the body. As such, the body 3110 and the overall vehicle 3100 has a shape that is generally symmetrical about the longitudinal axis, $X_v$, of the vehicle 3100. Further, the body 3110 and the overall vehicle 3100 has a shape that is also generally symmetrical about a transverse axis, $Y_v$, of the vehicle 3100, which is positioned through the geometric center of the body 3110. Alternatively, the body 3310 and the overall vehicle 3100 can have any shape or combination of shapes that are and/or are not symmetrical about the longitudinal axis, $X_v$, and/or the transverse axis, $Y_v$, of the vehicle 3100. A body as used herein can be seen as the corpus of the vehicle, excluding appendages such as arms, antenna, wheels, or protruding bearing surfaces (e.g., skis) that may extend from the corpus.

The length of the body 3110 between the ends 3112 and 3114 can be any number, such as, for example, about 1.0 inch, or about 1.25 inches, or about 1.5 inches, or about 1.75 inches, or about 2.0 inches, or about 2.25 inches, or about 2.5 inches, or about 2.75 inches, or about 3.0 inches, or about 3.25 inches, or about 3.5 inches, or about 3.75 inches, or about 4.0 inches, or about 4.25 inches, or about 4.5 inches, or about 4.75 inches, or about 5.0 inches, or about 5.25 inches, or about 5.5 inches, or about 5.75 inches, or about 6.0 inches, etc. or any number in between, above, or below such recited examples. In some implementations, the length of the body 3110 is between about 1 inch and about 6.0 inches, or between about 1.5 inches and about 4 inches, or between about 2 inches and about 3.5 inches, or between about 2.5 inches and about 3 inches, etc. In some implementations, the length of the body 3110 is 2.98 inches, or about 2.98 inches, or between 2.9 inches and 3.1 inches.

The height of the body 3110 between the upper surface 3116 and the lower surface 3120 and/or the width of the body 3110 between the left and right sides 3118*a,b* can be any number, such as, for example, about 0.25 inches, or about 0.5 inches, or about 0.75 inches, or about 1.0 inch, or about 1.25 inches, or about 1.5 inches, or about 1.75 inches, or about 2.0 inches, or about 2.25 inches, or about 2.5 inches, or about 2.75 inches, or about 3.0 inches, or about 3.25 inches, or about 3.5 inches, or about 3.75 inches, or about 4.0 inches, etc. or any number in between, above, or below such recited examples. In some implementations, the height and/or the width of the body 3110 is between about 0.25 inches and about 4.0 inches, or between about 0.5 inches and about 3 inches, or between about 0.5 inches and about 2 inches, or between about 0.75 inches and about 1.25 inches, etc. In some implementations, the height of the body 3110 is 0.79 inches, or about 0.79 inches, or between 0.75 inches and 0.85 inches. In some implementations, the width of the body 3110 is 0.95 inches, or about 0.95 inches, or between 0.90 inches and 1.00 inches. As disclosed herein, the particular dimensions of the parts of the vehicle can be constrained by the geometries of the most restrictive curved tube (e.g., radius and/or inner diameter) through which the vehicle is propelled inside the network of interconnected tubes, so any dimensions given herein are intended to be combined with other dimensions according to the formulas described below and other constraints or ratios disclosed herein.

As best shown in FIG. 31A, a charging port 3125 of the vehicle 3100 is accessible through an opening in the right side 3118*b* of the body 3110 to permit charging of a battery 3148 (FIG. 31C) stored within the body 3110. As best shown in FIG. 31B, an ON-OFF switch 3130 of the vehicle 3100 protrudes from the left side 3118*a* of the body 3110 to permit a user to manually power the vehicle 3100 ON and/or OFF. In some implementations, once the ON-OFF switch 3130 is set to ON, the motorized wheel 3150 starts to rotate in a first direction. In some implementations, a remote control is used to cause the motorized wheel 3150 to rotate in the first direction and/or an opposing second direction, such that the vehicle 3100 can move forward (e.g., the front end 3112 leads) and such that the vehicle 3100 can move backwards (e.g., the rear end 3114 leads) within the network of interconnected tubes.

The motorized wheel 3150 is coupled to a motor 3152 (FIG. 31C) positioned within the body 3110. The motor 3152 is coupled to the battery 3148 such that the battery 3148 powers the motor 3152. The motorized wheel 3150 can be coupled directly to the motor 3152 or via one or more gears 3154 (FIG. 31C) and/or belts, etc. or any combination thereof. In some implementations, a transmission is positioned between the motor 3152 and the motorized wheel 3150.

The biasing assembly 3175 is coupled to the body 3110 and includes a pivotable arm 3180, one or more springs or biasing elements 3185 (FIG. 31C, and a sprung/biased wheel 3190. In some implementations, the biasing assembly 3175 further includes a guide wheel 3191. The pivotable arm 3180 is pivotally coupled to the body 3110 such that the pivotable arm 3180 can move between a fully extended or uncompressed position (FIG. 31A) and a fully retracted or compressed position. As best shown in FIG. 31C, the one or more springs 3185 are coupled to the pivotable arm 3180 such that the one or more springs 3185 bias the pivotable arm 3180 into the fully extended or uncompressed position. The sprung wheel 3190 is coupled to the pivotable arm 3180 such that a central axis of the sprung wheel 3190 is generally positioned above a central axis of the motorized wheel 3150 (e.g., when the vehicle 3100 is positioned within a network of interconnected tubes).

As best shown in FIG. 31A, when the pivotable arm 3180 is in the fully extended position, the distance between the outermost point of the sprung wheel 3190 and the outermost point of the motorized wheel 3150 is defined as distance, $D_1$. In some implementations, the distance, $D_1$, is 1.52 inches, or about 1.52 inches, or between 1.4 inches and 1.6 inches. The distance, $D_1$, changes with the position of the pivotable arm 3180. For example, when the vehicle 3100 is positioned within a network of interconnected tubes having a tube inner diameter, D, the distance, $D_1$, is automatically set to equal the inner diameter, D, of the tubes because of the nature of the sprung wheel 3190 being pivotable/movable. As such, the biasing assembly 3175 automatically adjusts the position of the sprung wheel 3190 when positioned within a network of interconnected tubes. As such, a force is exerted and maintained on the motorized wheel 3150 that aids in maintaining the motorized wheel 3150 in contact with the inside surface of the network of interconnected tubes. The magnitude of the force is dependent upon the spring constant(s) of the one or more springs 3185.

The biasing assembly 3175 can aid in traction and preventing and/or minimizing wobbling or jittery or stochastic/erratic movements of the vehicle 3100 when moving through the network of interconnected tubes. That is, by forcing the motorized wheel 3150 to maintain a first point of contact with the inside surface of the tubes and also forcing the sprung wheel 3190 to maintain a second point of contact with the inside surface of the tubes, the front end 3112 of the vehicle is stabilized (e.g., wobble reduction/prevention) in the up-down and/or vertical dimension, where vertical is relative to the orientation of the vehicle 3100. It is noted that the vehicle 3100 can have any rotational position within the network of interconnected tubes as the tubes can be designed/assembled to cause the vehicle 3100 to rotate about its longitudinal axis X, go upside down (e.g., with respect to earth), etc.

Other elements can be included to further limit wobbling of the vehicle 3100 during operation, which can aid the vehicle 3100 in having a smoother ride within the tubes. For example, a biasing assembly (not shown), similar to the biasing assembly 3175 can be positioned adjacent to the rear 3114 of the vehicle 3100 to ensure two more points of contact between the vehicle 3100 and the inside surface of the tubes are maintained, thereby reducing/preventing wobbling of the rear end 3114 of the vehicle 3100, for example, in the up-down and/or vertical dimension, in the side-to-side or horizontal direction, or in any direction in between vertical and horizontal (e.g., on an angle relative to vertical and/or horizontal), or any combination thereof. In other implementations, wobbling or other stochastic movements of the vehicle may be desirable as it is propelled through the network of interconnected tubes to create unpredictability, surprise, or other visual or aural effects to the user who is controlling or observing the vehicle.

For another example, a pair of side bumper wheels 3192*a,b* coupled to the left side 3118*a* and the right side 3118*b*, respectively, can be included in the vehicle 3100 to aid in reducing or suppressing wobbling of the vehicle 3100 during operation (e.g., in a side-to-side or horizontal orientation). A transverse distance between the outermost point of a first of the side bumper wheels 3192*a* and the outermost point of a second of the side bumper wheels 3192*b* is defined as distance, $D_2$ (not shown in the drawings). In some implementations, the distance, $D_2$, is 1.34 inches, or about 1.34 inches, or between 1.3 inches and 1.4 inches. Unlike the distance, $D_1$, the distance, $D_2$, is fixed and is selected based on the inner diameter, D, of the network of interconnected tubes such that the vehicle 3100 readily fits with the tubes, but also provides anti-wobbling assistance by preventing relatively large side-to-side or horizontal movements of the front end 3112 of the vehicle 3100 within the tubes during operation, particularly around curved sections of the network of interconnected tubes. Specifically, for example, the pair of side bumper wheels 3192*a,b* can define the distance, $D_2$, such that the vehicle 3100 can move side-to-side a distance that is less than about fifteen percent of the inner diameter of the tubes, less than about twelve percent of the inner diameter of the tubes, less than about ten percent of the inner diameter of the tubes, less than about eight percent of the inner diameter of the tubes, less than about five percent of the inner diameter of the tubes, less than about three percent of the inner diameter of the tubes, less than about two percent of the inner diameter of the tubes, or less than about one percent of the inner diameter of the tubes, etc. In some implementations, one or both of the pair of side bumper wheels 3192*a,b* are sprung in the same, or similar, fashion as the sprung wheel 3190.

As best shown in FIG. 31B, the vehicle 3100 can further include one or more rear or trailing wheels and/or elements 3195*a-d* that can aid in the vehicle 3100 moving through the network of interconnected tubes. As shown, the one or more rear or trailing wheels and/or elements 3195*a-d* are non-powered wheels, however, it is contemplated that one or more of the one or more rear or trailing wheels and/or elements 3195*a-d* can be powered/driven by the motor 3152 driving the driven wheel 3150 and/or one or more different motors. It is further contemplated that one or more of the one or more rear or trailing wheels and/or elements 3195*a-d* are not wheels at all, but instead are just a bearing surface (e.g., like a ski or sled rail) that glides along/over the inner surface of the network of interconnected tubes. In some such implementations, the bearing surface is provided by and/or integral with the body 3110.

Figure 32A:
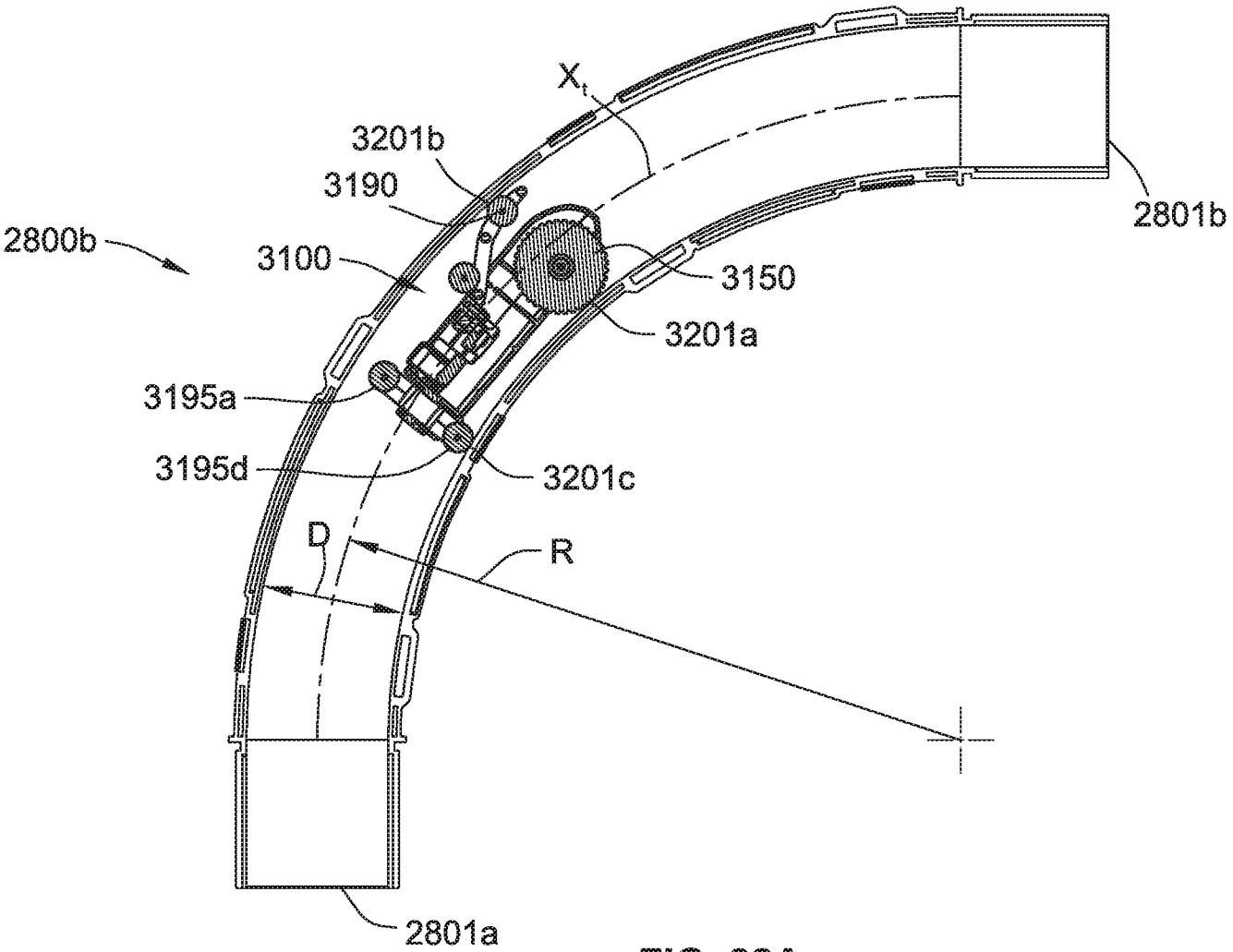
FIG. 32A is a cross-sectional view of the lower half of the curved tube of FIG. 28A with the vehicle of FIG. 31A positioned therein according to some aspects of the present disclosure.
Figure 32B:
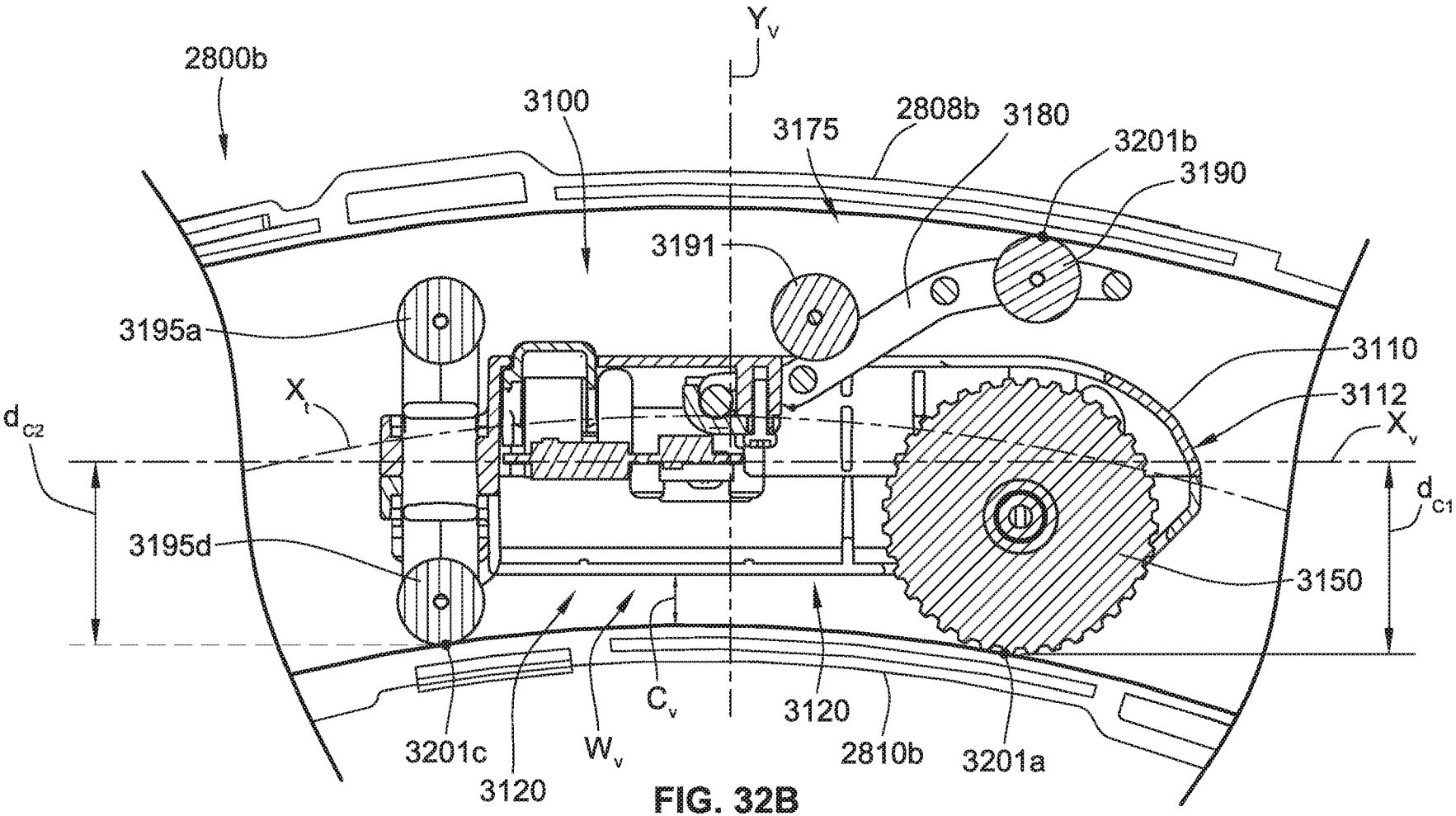
FIG. 32B is an enlarged cross-sectional view of a portion of FIG. 32A including the vehicle therein.

Now referring to FIGS. 32A and 32B, an instantaneous position of the vehicle 3100 is shown in the curved tube 2800 to illustrate the fit of the vehicle 3100 within the curved tube 2800, example contact points between the vehicle 3100 and the curved tube 2800, and example clearances of the body 3110 of the vehicle 3100 in the curved tube 2800. Specifically, as shown, the vehicle 3100 has three contact points 3201*a-c* with the inside surface of the curved tube 2800. The motorized wheel 3150 contacts the inside surface of the curved tube 2800 at point 3201*a*. The sprung wheel 3190 contacts the inside surface of the curved tube 2800 at point 3201*b*. The rear or trailing wheel and/or element 3195*d* contacts the inside surface of the curved tube 2800 at point 3201*c*. Thus, the vehicle 3100 has three instantaneous contact points with the curved tube 2800.

As discussed above, the motorized wheel 3150 and the sprung wheel 3190 are biased such that the two contact points 3201*a,b* are generally maintained during operation of the vehicle 3100. However, the contact point 3201*c* can be sporadic due to movement of the vehicle 3100 through the network of interconnected tubes. Thus, in some other instantaneous positions of the vehicle 3100, instead of and or in addition to the rear or trailing wheel and/or element 3195*d* contacting the inside surface of the curved tube 2800 at point 3201*c*, one or more or none of the other rear or trailing wheels and/or elements 3195*a-c* may contact the inside surface of the curved tube 2800.

As best shown in FIG. 32B, a waist, $W_v$, of the vehicle 3100 is shown, which is generally located at a central portion of the body 3110 of the vehicle 3100. The waist, $W_v$, of the vehicle 3100 is the portion of the body 3110 along the longitudinal axis, $X_v$, that has the tightest or smallest clearance, $C_v$, to the inside surface of the curved tube 2800. The location of the waist, $W_v$, of the vehicle 3100 is shifted from the transverse axis, $Y_v$, (which is at the center of the body 3110) towards the rear end 3114 of the vehicle 3100 due to the relatively smaller diameter of the rear or trailing wheel and/or element 3195*d* that contacts the inner surface of the curved tube 2800 as compared to the diameter of the motorized wheel 3150. Put another way, the location of the waist, $W_v$, of the vehicle 3100 is shifted from the transverse axis, $Y_v$, towards the rear end 3114 of the vehicle 3100 due to contact points 3201*a,c* being different distances from the longitudinal axis, $X_v$, of the body 3110. As shown, the contact point 3201*a* is positioned a first distance, $d_{c1}$, from the longitudinal axis, $X_v$, and the contact point 3201*c* is positioned a second distance, $d_{c2}$, from the longitudinal axis, $X_v$, which is less than the first distance, $d_{c1}$. In some implementations, when first distance, $d_{c1}$, and the second distance, $d_{c2}$, are equal, the waist, $W_v$, of the vehicle 3100 is positioned at the center of the body 3110 and/or the transverse axis, $Y_v$.

The waist, $W_v$, of the vehicle 3100 is a key design factor for designing the dimensions of the body 3110 and the contact points such that the vehicle 3100 can move freely within the network of interconnected tubes without being jammed or getting stuck therein as described above. Put another way, the waist, $W_v$, of the vehicle 3100 needs to have appropriate dimensions such that when the vehicle 3100 moves through the curved tube 2800, the lower surface 3120 of the body 3110 does not touch or bind with any part of the circumferential inner surface of the curved tube 2800. Similarly, it is not just the waist, $W_v$, of the vehicle 3100 that needs to be addressed, but the entirety of the lower surface 3120 needs to avoid the inner surface of the curved tube 2800 along all sections of the curved tube 2800. In an extreme example, the lower surface 3120 of the body 3110 can form an arc shape located between the contact points 3201*a,c* and that corresponds and conforms in shape to the radius of curvature of the curved tube 2800. By "lower surface" it is understood that the lower surface 3120 is discussed just for the illustrated views for explanatory purposes and that because the vehicle can rotate 360 degrees about its longitudinal axis, $X_v$, the "lower surface" for purposes of designing the required clearances of the body 3110 and the vehicle 3100 can be any of the surfaces of the vehicle 3100 (e.g., the upper surface 3116, the lower surface 3120, the side surfaces 3118*a,b*, or any combination thereof).

Other dimensional factors that impact the design, shape, and size of the body 3110 and the vehicle 3100 generally include the inner diameter, D, of the tubes (e.g., curved tube 2800, intersection tube 2900, tube-coupler 3000, straight tubes, etc.), and the radius of curvature, R, of the curved tube 2800. The relationship of these three dimensional factors can be expressed in terms of equations that define the size and/or shape of the body 3110 and/or the vehicle 3100 generally.

Figure 33:
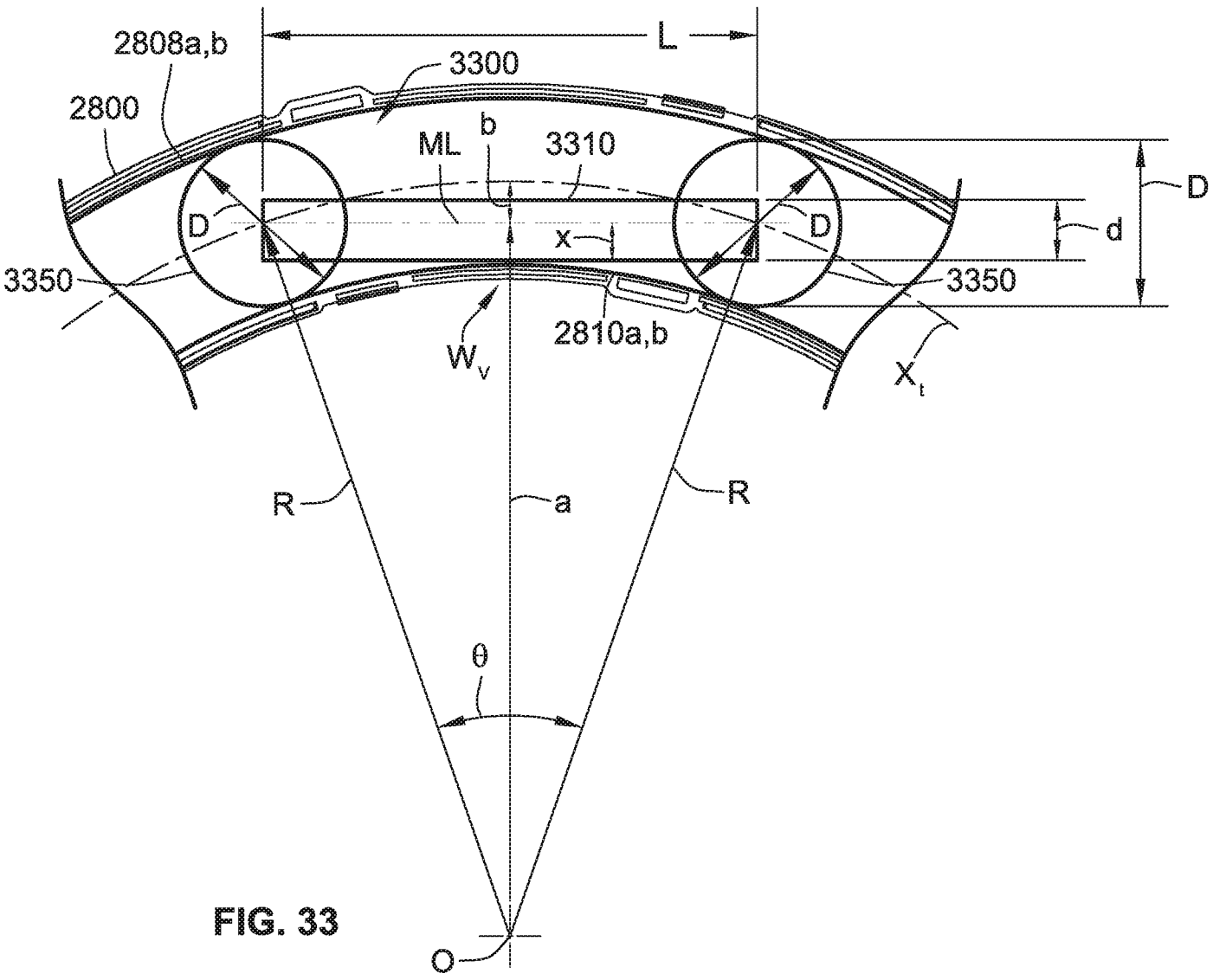
FIG. 33 is a cross-sectional view of the lower half of the curved tube of FIG. 28A with a generic vehicle positioned therein according to some aspects of the present disclosure.

To better understand the relationships of the waist, $W_v$, of the vehicle 3100, the contact points between the vehicle 3100 and curved tube 2800, the inner diameter, D, of the tubes, and the radius of curvature, R, of the curved tube 2800, reference is made to FIG. 33 illustrating a generic vehicle 3300 within the curved tube 2800, where the generic vehicle 3300 is represented by a rectangular body 3310 and two outer circles 3350 corresponding to theoretical maximum values for contact points of wheels or bearing surfaces of the generic vehicle 3300.

The maximum overall height for the body 3310 at the waist, $W_v$, of the vehicle 3300 is d, which dimension must be observed circumferentially entirely about the body 3310. The following equations can be used to solve for d. A midline, ML, of the body 3310 splits the body 3310 at its center. A central axis, $X_t$, of the curved tube 2800 splits the curved tube 2800 at is center. The distance between the midline, ML, of the body 3310 and the central axis, $X_t$, of the curved tube 2800 is defined as b. The distance between the midline, ML, of the body 3310 and the inside edge 2810*a,b* of the curved tube 2800 at the waist, $W_v$, of the vehicle 3300 is defined as "x." The distance between the midline, ML, of the body 3310 and a center or origin of curvature, O, of the curved tube 2800 is defined as "a." The distance between the centers of the circles 3350 is defined as L, also referred to as the wheelbase of the vehicle 3300. The term "wheelbase" is used to describe the distance even when one of the "wheels" is not a wheel and rather just a bearing surface, such as, for example, a ski or sled rail. The diameter of the circles 3350 is defined as "D," which is equal to the inner diameter of the curved tube 2800 such that each of the circles 3350 maintains two points of contact with the inner surface of the curved tube 2800 at all times in the same, or similar, manner as the motorized wheel 3150 and the sprung wheel 3190. The radius of curvature of the curved tube 2800 is defined by "R" from the center or origin of curvature, O, of the curved tube 2800 to the central axis, $X_t$, of the curved tube 2800. An angle, θ, is defined as the angle between radius of curvatures, R, between the centers of the circles 3350.

To solve for "d" (i.e., the maximum overall height for the body 3310 at the waist, $W_v$, of the vehicle 3300), (equation 1) is:

$$\left[\frac{D}{2} = b + x\right],$$

which is a known relationship based on the diameter of the circles 3350 being equal to the inner diameter of the curved tube 2800. It is known from FIG. 33, that (equation 2) is: [d=2x or x=d/2] because if "d" is greater than 2x, the body 3310 would cross the inside edge 2810*a,b* of the curved tube 2800 and cause the vehicle 3300 to be stuck or bind on the curved tube 2800. Plugging (equation 2) into (equation 1) yields (equation 3):

$$\left[\frac{D}{2} = b + \frac{d}{2}\right].$$

Solving for "d," yields (equation 4): [d=D−2b].

(Equation 5) is: [a+b=R or b=R−a]. Plugging (equation 5) into (equation 4) yields (equation 6): [d=D−2(R−a)]. Based on the Pythagorean theorem, (equation 7) is:

$$\left[a^2 + \left(\frac{L}{2}\right)^2 = R^2\right].$$

Solving (equation 7) for "a" yields (equation 8):

$$\left[a = \sqrt{R^2 - \left(\frac{L}{2}\right)^2}\right].$$

Plugging (equation 8) into (equation 6) yields (equation 9):

$$\left[d = D - 2\left(R - \sqrt{R^2 - \left(\frac{L}{2}\right)^2}\right)\right].$$

As shown by equation 9, the maximum overall height for the body 3310 at the waist, $W_v$, of the vehicle 3300 or "d," is based on the inner diameter, D, of the curved tube 2800, the radius of curvature, R, of the curved tube 2800, and the length of the wheelbase, L, of the vehicle 3300.

With reference to (equation 9), Table 1 shows various example values for the maximum overall height for the body 3310 at the waist, $W_v$, of the vehicle 3300, d, with varying values for D, R, and L, and calculated ratio values for D/R as given below.

TABLE 1

| Example # | D (inches) | R (inches) | L (inches) | d (inches) | D/R |
|---|---|---|---|---|---|
| 1 | 1.35 | 9 | 2.15 | 1.221136 | 0.15 |
| 2 | 1.35 | 8 | 2.15 | 1.204889 | 0.16875 |
| 3 | 1.35 | 7 | 2.15 | 1.183926 | 0.192857 |
| 4 | 1.35 | 6.5 | 2.15 | 1.170979 | 0.207692 |
| 5 | 1.35 | 6.25 | 2.15 | 1.163712 | 0.216 |
| 6 | 1.35 | 6.15 | 2.15 | 1.160636 | 0.219512 |
| 7 | 1.35 | 5.75 | 2.15 | 1.147234 | 0.234783 |
| 8 | 1.35 | 5 | 2.15 | 1.11614 | 0.27 |
| 9 | 1.35 | 4.25 | 2.15 | 1.073594 | 0.317647 |
| 10 | 1.35 | 4 | 2.15 | 1.05568 | 0.3375 |
| 11 | 2.25 | 6.15 | 2.15 | 2.060636 | 0.365854 |
| 12 | 2 | 6.15 | 2.15 | 1.810636 | 0.325203 |
| 13 | 1.75 | 6.15 | 2.15 | 1.560636 | 0.284553 |
| 14 | 1.5 | 6.15 | 2.15 | 1.310636 | 0.243902 |
| 15 | 1.25 | 6.15 | 2.15 | 1.060636 | 0.203252 |
| 16 | 1.1 | 6.15 | 2.15 | 0.910636 | 0.178862 |
| 17 | 1 | 6.15 | 2.15 | 0.810636 | 0.162602 |
| 18 | 0.9 | 6.15 | 2.15 | 0.710636 | 0.146341 |
| 19 | 0.8 | 6.15 | 2.15 | 0.610636 | 0.130081 |
| 20 | 1.35 | 6.15 | 3 | 0.978537 | 0.219512 |
| 21 | 1.35 | 6.15 | 2.8 | 1.027061 | 0.219512 |
| 22 | 1.35 | 6.15 | 2.5 | 1.093255 | 0.219512 |
| 23 | 1.35 | 6.15 | 2.3 | 1.133046 | 0.219512 |
| 24 | 1.35 | 6.15 | 2.1 | 1.169406 | 0.219512 |
| 25 | 1.35 | 6.15 | 2 | 1.186309 | 0.219512 |
| 26 | 1.35 | 6.15 | 1.9 | 1.202366 | 0.219512 |
| 27 | 1.35 | 6.15 | 1.8 | 1.21758 | 0.219512 |
| 28 | 1.35 | 6.15 | 1.5 | 1.258194 | 0.219512 |

As shown in the specific examples of Table 1, as the radius of curvature, R, of the curved tube 2800 decreases (examples 1-10), the maximum overall height for the body 3310 at the waist, $W_v$, of the vehicle 3300, d, also decreases. As the inner diameter, D, of curved tube 2800 decreases (examples 11-19), the maximum overall height for the body 3310 at the waist, $W_v$, of the vehicle 3300, d, also decreases. As the length, L, of the wheelbase of the vehicle 3300 decreases (examples 20-28), the maximum overall height for the body 3310 at the waist, $W_v$, of the vehicle 3300, d, increases.

An alternative equation to solve for "d" (i.e., the maximum overall height for the body 3310 at the waist, $W_v$, of the vehicle 3300), can be provided, which uses equations 1, 2, 3, and 4 above. Further, it is known from FIG. 33 that (equation 10) is:

$$\left[\cos\frac{\theta}{2} = \frac{a}{R}\right].$$

Solving for "a" yields (equation 11):

$$\left[a = R*\left(\cos\frac{\theta}{2}\right)\right].$$

It is also known from FIG. 33 that (equation 12) is: [a+b=R or b=R−a]. Plugging equation 12 into equation 4 yields (equation 13): [d=D−2*(R−a)]. Plugging equation 11 into equation 13 yields (equation 14).

$$\left[d = D - 2*\left(R - \left(R*\cos\frac{\theta}{2}\right)\right)\right].$$

As shown by equation 14, the maximum overall height for the body 3310 at the waist, $W_v$, of the vehicle 3300, d, is based on the inner diameter, D, of the curved tube 2800, the radius of curvature, R, of the curved tube 2800, and the angle, θ, between the centers of the circles 3350, which corresponds to the wheelbase, L, of the vehicle 3300.

With reference to (equation 14), Table 2 shows various values for the maximum overall height for the body 3310 at the waist, $W_v$, of the vehicle 3300, d, with varying values for D, R, and θ, and calculated ratio values for D/R as given below.

TABLE 2

| Example # | D (inches) | R (inches) | θ (radians) | d (inches) | D/R |
|---|---|---|---|---|---|
| 1 | 1.35 | 9 | 0.3490659 | 1.07654 | 0.15 |
| 2 | 1.35 | 8 | 0.3490659 | 1.106924 | 0.16875 |
| 3 | 1.35 | 7 | 0.3490659 | 1.137309 | 0.192857 |
| 4 | 1.35 | 6.5 | 0.3490659 | 1.152501 | 0.207692 |
| 5 | 1.35 | 6.25 | 0.3490659 | 1.160097 | 0.216 |
| 6 | 1.35 | 6.15 | 0.3490659 | 1.163135 | 0.219512 |
| 7 | 1.35 | 5.75 | 0.3490659 | 1.175289 | 0.234783 |
| 8 | 1.35 | 5 | 0.3490659 | 1.198078 | 0.27 |
| 9 | 1.35 | 4.25 | 0.3490659 | 1.220866 | 0.317647 |
| 10 | 1.35 | 4 | 0.3490659 | 1.228462 | 0.3375 |
| 11 | 2.25 | 6.15 | 0.3490659 | 2.063135 | 0.365854 |
| 12 | 2 | 6.15 | 0.3490659 | 1.813135 | 0.325203 |
| 13 | 1.75 | 6.15 | 0.3490659 | 1.563135 | 0.284553 |
| 14 | 1.5 | 6.15 | 0.3490659 | 1.313135 | 0.243902 |
| 15 | 1.25 | 6.15 | 0.3490659 | 1.063135 | 0.203252 |
| 16 | 1.1 | 6.15 | 0.3490659 | 0.913135 | 0.178862 |
| 17 | 1 | 6.15 | 0.3490659 | 0.813135 | 0.162602 |
| 18 | 0.9 | 6.15 | 0.3490659 | 0.713135 | 0.146341 |
| 19 | 0.8 | 6.15 | 0.3490659 | 0.613135 | 0.130081 |
| 20 | 1.35 | 6.15 | 0.5235988 | 0.930888 | 0.219512 |
| 21 | 1.35 | 6.15 | 0.4886922 | 0.984637 | 0.219512 |
| 22 | 1.35 | 6.15 | 0.4537856 | 1.034752 | 0.219512 |
| 23 | 1.35 | 6.15 | 0.418879 | 1.081215 | 0.219512 |
| 24 | 1.35 | 6.15 | 0.3839724 | 1.124014 | 0.219512 |
| 25 | 1.35 | 6.15 | 0.296706 | 1.214895 | 0.219512 |
| 26 | 1.35 | 6.15 | 0.2617994 | 1.244772 | 0.219512 |
| 27 | 1.35 | 6.15 | 0.2094395 | 1.282619 | 0.219512 |
| 28 | 1.35 | 6.15 | 0.1745329 | 1.303195 | 0.219512 |

As shown in the specific examples of Table 2, as the radius of curvature, R, of the curved tube 2800 decreases (examples 1-10), the maximum overall height for the body 3310 at the waist, $W_v$, of the vehicle 3300, d, increases. As the inner diameter, D, of curved tube 2800 decreases (examples 11-19), the maximum overall height for the body 3310 at the waist, $W_v$, of the vehicle 3300, d, also decreases. As the angle, θ, between the radius of curvatures, R, of the centers of the circles 3350 (corresponding to the wheelbase of the vehicle 3300) decreases (examples 20-28), the maximum overall height for the body 3310 at the waist, $W_v$, of the vehicle 3300, d, increases.

As mentioned above, the particular example values of the dimensions of the various parts disclosed herein can be combined in any combination (and plugged into the equations above) so long as the combined dimensions produce a waist dimension that accords with at least one of the formulas given above (e.g., the combined dimensions produce a positive number for d). An important ratio discovered by the inventors is D/R, which in the above tables, can range from 0.130 to 0.365, which constrains the waist dimension, d, to values that will allow the body of the vehicle to travel through any curved tube having a given radius of curvature, R, and a given inner diameter, D.

A spherical-shaped or spheroid object can be also introduced into the tubes in front of the vehicle. The rolling object can include a vibration-sensitive sensor that activates one or more LEDs and/or one or more speakers that produce sound inside the tube, so that when the vehicle comes into contact with the object, the object is propelled ahead of the vehicle or pushed by the vehicle, flashing lights and/or making sounds like car engine noises. These sounds can be carried and amplified through the tubes, creating a three-dimensional sound effect in the tubes that appears to the human operator remotely controlling the vehicle that the sounds are emanating from a volumetric space around the operator. When the tubes are in a dark environment, a strobing or flashing light pattern on the LEDs in the rolling object can create a moving pattern of strobing or flashing lights through the transparent or semi-transparent (non-opaque) tube sections. Holes or other sound amplifiers can be provided in parts of the walls of the tube sections to create interesting sound effects as the ball and/or vehicle traverses the holes or other amplifiers.

What is claimed is:

1. A toy racer vehicle configured to propel through a network of interconnected tubes including a curved tube having a generally constant inner diameter, the toy racer vehicle comprising:

an elongated body defining a longitudinal axis therethrough and having a length between about 1.0 inch and about 4.0 inches, a weight of the toy racer vehicle not exceeding four ounces;

a motor coupled to a battery that powers the motor;

a non-steerable motorized wheel proximate a first end of the toy racer vehicle and mechanically coupled to the motor, the non-steerable motorized wheel at least partially extending out from the elongated body such that the non-steerable motorized wheel is configured to directly contact an inner surface of the network of interconnected tubes, the network of interconnected tubes including the curved tube, at least some of the tubes of the network of interconnected tubes being transparent or semi-transparent to permit the toy racer vehicle to be visible therethrough;

a free, non-biased, unpowered wheel extending from the elongated body, the free, non-biased, unpowered wheel having a diameter smaller than a diameter of the non-steerable motorized wheel;

a biasing assembly configured to cause the non-steerable motorized wheel to maintain direct contact, due to a pressure force imparted by the biasing assembly, with the inner surface of the network of interconnected tubes such that the non-steerable motorized wheel is configured to directly contact the inner surface of the network of interconnected tubes regardless of a rotational orientation of the toy racer vehicle about the longitudinal axis of the elongated body including in response to the toy racer vehicle being propelled to ascend vertically against gravity or to undergo a twisting or spinning or looping motion within the network of interconnected tubes; and a plurality of side bearing surfaces integral with the elongated body, wherein the non-steerable motorized wheel, the unpowered wheel, the biasing assembly, and at least one of the side bearing surfaces are configured to form respective contact points with the inner surface of the curved tube, and wherein a width distance between two opposing ones of the plurality of side bearing surfaces is configured to aid in causing the first end of the toy racer vehicle to move side-to-side and/or up and down within the curved tube to permit wobbling or stochastic movements of the toy racer vehicle as the toy racer vehicle is propelled freely through the network of interconnected tubes including the at least one curved tube, wherein the toy racer vehicle is configured to be self-propelled through the network of interconnected tubes thereby making racing sounds as the toy racer vehicle whizzes or zips through the tubes to provide an aural experience in addition to a visual experience due to the at least some of the tubes being transparent or semi-transparent, wherein the aural and visual experiences are aided by the free, non-biased unpowered wheel and the plurality of bearing surfaces making sporadic contact with inner surfaces of the tubes, the width distance being less than 90% of the generally constant inner diameter of the curved tube.

2. The toy racer vehicle of claim 1, wherein the toy racer vehicle has at least three contact points with the inner surface of the curved tube.

3. The toy racer vehicle of claim 1, wherein the toy racer vehicle maintains at least two contact points during operation of the vehicle through the network of interconnected tubes.

4. The toy racer vehicle of claim 3, wherein at least one of the at least two contact points is toward the first end and another of the at least two contact points is toward a second end of the toy racer vehicle, the second end being opposite to the first end.

5. The toy racer vehicle of claim 4, wherein the at least one of the at least two contact points is one of the plurality of bearing surfaces.

6. The toy racer vehicle of claim 1, wherein the generally constant inner diameter of the curved tube is about 1.4 inches, and the width of the toy racer vehicle at the first end is between 0.80 inches and 1.00 inch.

7. The toy racer vehicle of claim 1, in combination with a spherical-shaped or spheroid object having a vibration-sensitive sensor that activates one or more light emitting diodes and/or one or more speakers to produce light and/or sound within the network of interconnected tubes such that when the toy racer vehicle during operation comes into contact with the object, the object is propelled ahead or pushed by the toy racer vehicle causing flashing lights and/or sounds to be emitted through the tubes.

8. The toy racer vehicle of claim 1, wherein the width distance is between 65% and about 75% of the generally constant inner diameter of the curved tube.

9. The toy racer vehicle of claim 1, wherein the generally constant inner diameter of the curved tube is between 1.4 inches and 1.5 inches, and the width of the toy racer vehicle at the first end is between 0.80 inches and 1.00 inch, wherein the width distance is between 50% and 70% of the generally constant inner diameter of the curved tube.

10. A toy racer vehicle configured to propel through a network of interconnected tubes including at least one curved tube having a maximum inner height, the vehicle comprising:

an elongated body defining a longitudinal axis therethrough and having a length between about 1.0 inch and about 4.0 inches, a weight of the toy racer vehicle not exceeding four ounces;

a motor coupled to a battery configured to power the motor;

a non-steerable motorized wheel positioned at a first end of the toy racer vehicle and mechanically coupled to the motor, the non-steerable motorized wheel at least partially extending from the elongated body such that the non-steerable motorized wheel is configured to directly contact an inner surface of the network of interconnected tubes, the network of interconnected tubes including a curved tube, at least some of the tubes of the network of interconnected tubes being transparent or semi-transparent to permit the toy racer vehicle to be visible therethrough;

a free, non-biased, unpowered wheel extending from the body, the free, non-biased, unpowered wheel having a diameter smaller than a diameter of the non-steerable motorized wheel;

a biasing assembly configured to cause the non-steerable motorized wheel to maintain direct contact, due to a pressure force imparted by the biasing assembly, with the inner surface of the network of interconnected tubes such that the non-steerable motorized wheel is configured to directly contact the inner surface of the network of interconnected tubes regardless of a rotational orientation of the toy racer vehicle about the longitudinal axis of the elongated body including in response to the toy racer vehicle being propelled to ascend vertically against gravity or to undergo a twisting or spinning or looping motion within the network of interconnected tubes; and a plurality of bearing surfaces provided by and/or integral with the body, wherein the non-steerable motorized wheel, the unpowered wheel, the biasing assembly, and at least one of the plurality of bearing surfaces form respective contact surfaces on an inside surface of the curved tube, and wherein the plurality of bearing surfaces is configured to aid in causing the toy racer vehicle to move side-to-side and/or up and down within the at least one curved tube to permit wobbling or stochastic movements of the toy racer vehicle as the toy racer vehicle is propelled freely through the network of interconnected tubes including the at least one curved tube, wherein the toy racer vehicle is configured to be self-propelled through the network of interconnected tubes thereby making racing sounds as the toy racer vehicle whizzes or zips through the tubes to provide an aural experience in addition to a visual experience due to the at least some of the tubes being transparent or semi-transparent, wherein the aural and visual experiences are aided by, the free, non-biased unpowered wheel, and the plurality of bearing surfaces making sporadic contact with inner surfaces of the tubes.

11. The toy racer vehicle of claim 10, wherein a width distance between the plurality of bearing surfaces allows the first end of the toy racer vehicle to move side-to-side within the at least one curved tube, the width distance being between 50% and about 80% of the maximum inner height.

12. The toy racer vehicle of claim 10, wherein the toy racer vehicle has at least three contact points that simultaneously contact the inner surface of the curved tube.

13. The toy racer vehicle of claim 12, wherein at least one of the at least three contact points is toward the first end of the toy racer vehicle and an other of the at least three contact points is toward a second end of the toy racer vehicle, the second end of the toy racer vehicle being opposite to the first end of the toy racer vehicle.

14. The toy racer vehicle of claim 13, wherein the at least one of the at least three contact points is one of the plurality of bearing surfaces.

15. The toy racer vehicle of claim 10, in combination with a spherical-shaped or spheroid object having a vibration-sensitive sensor that activates one or more light emitting diodes and/or one or more speakers to produce light and/or sound within the network of interconnected tubes such that when the toy racer vehicle during operation comes into contact with the object, the object is propelled ahead or pushed by the toy racer vehicle causing flashing lights and/or sounds to be emitted through the tubes.

16. The toy racer vehicle of claim 11, wherein the width distance is between 50% and about 70% of the maximum inner height.

17. The toy racer vehicle of claim 11, wherein the maximum inner height is between 1.4 inches and 1.5 inches, the width of the first end of the toy racer vehicle is between 0.80 inches and 1.00 inch, and the width distance is between 50% and 70% of the maximum inner height.

18. A toy racer vehicle configured to propel through a network of interconnected tubes including a curved tube having a maximum inner height, the toy racer vehicle comprising:

an elongated body defining a longitudinal axis therethrough and having a length between about 1.0 inch and about 4.0 inches, a weight of the toy racer vehicle not exceeding four ounces;

a motor coupled to a battery configured to power the motor;

a non-steerable motorized wheel partially protruding or extending away from the elongated body, operatively coupled to the motor, and configured to directly engage an inner surface of the network of interconnected tubes, the network of interconnected tubes including a curved tube, at least some of the tubes of the network of interconnected tubes being transparent or semi-transparent to permit the toy racer vehicle to be visible therethrough;

a free, non-biased, unpowered wheel extending from the elongated body, the free, non-biased, unpowered wheel having a diameter smaller than a diameter of the non-steerable motorized wheel;

a biasing assembly configured to cause the non-steerable motorized wheel to direct contact, due to a pressure force imparted by the biasing assembly, with the inner surface of the network of interconnected tubes during operation of the motor such that the non-steerable motorized wheel is configured to directly contact the inner surface of the network of interconnected tubes regardless of a rotational orientation of the toy racer vehicle about the longitudinal axis of the elongated body including in response to the toy racer vehicle being propelled to ascend vertically against gravity or to undergo a twisting or spinning or looping motion within the network of interconnected tubes; and a plurality of bearing surfaces on or integral with the elongated body, wherein the non-steerable motorized wheel, the unpowered wheel, the biasing assembly, and at least one of the bearing surfaces form respective contact points on an inside surface of the curved tube, and wherein the plurality of bearing surfaces are configured for side-to-side movement of the vehicle at a distance between about 10% and 32% of the maximum inner height of the curved tube to produce wobbling or stochastic movements of the vehicle as the vehicle is propelled freely through the network of interconnected tubes including the at least one curved tube, wherein the toy racer vehicle is configured to be self-propelled through the network of interconnected tubes thereby making racing sounds as the toy racer vehicle whizzes or zips through the tubes to provide an aural experience in addition to a visual experience due to the at least some of the tubes being transparent or semi-transparent, wherein the aural and visual experiences are aided by, the free, non-biased unpowered wheel, and the plurality of bearing surfaces making sporadic contact with inner surfaces of the tubes.

19. The toy racer vehicle of claim 18, wherein the motorized wheel is operatively coupled to the motor via one or more gears.

20. The toy racer vehicle of claim 19, wherein a width distance between the plurality of bearing surfaces has dimensions to permit a first end of the toy racer vehicle to move side-to-side within the curved tube, the width distance being between 50% and about 80% of the maximum inner height.

21. The toy racer vehicle of claim 18, wherein the toy racer vehicle has at least three contact points with the inner surface of the curved tube, wherein the at least three contact points include the at least one of the bearing surfaces.

22. The toy racer vehicle of claim 21, wherein the at least one of the bearing surfaces is toward a first end of the vehicle and an other of the at least three contact points is toward a second end opposing the first end of the toy racer vehicle.

23. The toy racer vehicle of claim 22, wherein the at least one of the at least three contact points is one of the plurality of bearing surfaces.

24. The toy racer vehicle of claim 18, in combination with a spherical-shaped or spheroid object having a vibration-sensitive sensor that activates one or more light emitting diodes and/or one or more speakers to produce light and/or sound within the network of interconnected tubes such that when the toy racer vehicle during operation comes into contact with the object, the object is propelled ahead or pushed by the toy racer vehicle causing flashing lights and/or sounds to be emitted through the tubes.

25. The toy racer vehicle of claim 20, wherein the width distance is between 50% and about 70% of the maximum inner height.

26. The toy racer vehicle of claim 20, wherein the maximum inner height is between 1.4 inches and 1.5 inches, the width of the first end of the toy racer vehicle is between 0.80 inches and 1.00 inch, and the width distance is between 50% and 75% of the maximum inner height.

27. The toy racer vehicle of claim 1, wherein the biasing assembly is a compressible drive wheel.

28. The toy racer vehicle of claim 10, wherein the curved tube has a generally circular opening.

29. The toy racer vehicle of claim 10, wherein each of the bearing surfaces protrudes from the elongated body of the toy racer vehicle.

* * * * *